US007597317B2

(12) United States Patent
Okuda

(10) Patent No.: US 7,597,317 B2
(45) Date of Patent: Oct. 6, 2009

(54) STACKER POSITION CHANGER, RECORDING APPARATUS OR LIQUID EJECTING APPARATUS INCORPORATING THE SAME

(75) Inventor: Yasumichi Okuda, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 97 days.

(21) Appl. No.: 11/723,275

(22) Filed: Mar. 19, 2007

(65) Prior Publication Data

US 2007/0216089 A1 Sep. 20, 2007

(30) Foreign Application Priority Data

Mar. 17, 2006 (JP) ..... 2006-074094
Apr. 14, 2006 (JP) ..... 2006-112338
Apr. 14, 2006 (JP) ..... 2006-112398
Sep. 14, 2006 (JP) ..... 2006-249685
Sep. 15, 2006 (JP) ..... 2006-250935

(51) Int. Cl.
*B65H 1/00* (2006.01)

(52) U.S. Cl. ..... 271/163; 271/162; 271/164; 271/3.03; 271/9.07; 271/9.08; 271/207; 271/213; 271/220; 270/58.078; 270/58.08; 270/58.09; 270/58.11

(58) Field of Classification Search ..... 270/58.07, 270/58.08, 58.09, 58.11; 271/3.03, 9.07, 271/9.08, 162, 163, 164, 207, 213, 220
See application file for complete search history.

(56) References Cited

U.S. PATENT DOCUMENTS 3,989,236 A * 11/1976 Komori et al. ..... 271/4.1
4,893,152 A * 1/1990 Ishiguro et al. ..... 399/403
5,052,669 A * 10/1991 Ueda et al. ..... 271/3.13
5,152,517 A * 10/1992 Ruch et al. ..... 271/9.08
5,573,235 A * 11/1996 Asai ..... 271/121
5,586,758 A * 12/1996 Kimura et al. ..... 271/303
6,003,855 A * 12/1999 Beaufort et al. ..... 271/9.02

(Continued)

FOREIGN PATENT DOCUMENTS

EP 1 348 567 A2 10/2003

(Continued)

*Primary Examiner*—Patrick H Mackey
*Assistant Examiner*—Prasad V Gokhale
(74) *Attorney, Agent, or Firm*—Sughrue Mion, PLLC

(57) ABSTRACT

A recording section includes a recording head operable to record information on a first medium and a second medium. A first stacker has a first face and a second face, and is movable between a first position and a second position. A stacker position changer is operable to move the first stacker placed in the first position in a first direction, and then to move a second direction orthogonal to the first direction, thereby placing the first stacker in the second position. The first face is adapted to receive the first medium conveyed from the recoding section in the first direction, when the first stacker is placed in the first position. The second face is adapted to guide the first medium and the second medium conveyed to the recording section in a third direction opposite to the first direction, and to receive the first medium and the second medium conveyed from the recording section in the first direction, when the first stacker is placed in the second position. The stacker position changer is operable to cause the second face to be parallel to the first direction and a fourth direction which is perpendicular to the first direction and the second direction.

1 Claim, 43 Drawing Sheets

U.S. PATENT DOCUMENTS

| | | | | |
|---|---|---|---|---|
| 6,134,404 | A * | 10/2000 | Iwai et al. | 399/110 |
| 6,412,994 | B1 * | 7/2002 | Collard | 400/624 |
| 6,592,113 | B1 * | 7/2003 | Asao | 270/58.07 |
| 6,848,685 | B2 * | 2/2005 | Katsuyama | 271/162 |
| 6,854,843 | B2 | 2/2005 | Anami et al. | |
| 7,104,538 | B1 * | 9/2006 | Kimura et al. | 271/291 |
| 7,181,157 | B2 * | 2/2007 | Nanno | 399/401 |
| 7,267,338 | B2 * | 9/2007 | Kuwata et al. | 271/213 |
| 7,281,791 | B2 | 10/2007 | Anami et al. | |
| 7,328,894 | B2 * | 2/2008 | Terao et al. | 270/58.15 |
| 7,349,647 | B2 * | 3/2008 | Sugiyama | 399/107 |
| 7,359,656 | B2 * | 4/2008 | Song | 399/110 |
| 7,416,181 | B2 * | 8/2008 | Murakami et al. | 271/162 |
| 2005/0062217 | A1 * | 3/2005 | Asada | 271/162 |
| 2007/0114714 | A1 * | 5/2007 | Kinoshita et al. | 271/220 |

FOREIGN PATENT DOCUMENTS

| | | | |
|---|---|---|---|
| JP | 08-081124 | A | 3/1996 |
| JP | 2003-211760 | A | 7/2003 |
| JP | 2004-009699 | A | 1/2004 |
| JP | 2004-034637 | A | 2/2004 |
| JP | 2004-058297 | A | 2/2004 |
| JP | 2004-090448 | A | 3/2004 |
| JP | 2004-130774 | A | 4/2004 |
| JP | 2004-256232 | A | 9/2004 |
| JP | 2005-014494 | A | 1/2005 |
| JP | 3633509 | B2 | 3/2005 |
| JP | 2005-144931 | A | 6/2005 |
| JP | 2005-144932 | A | 6/2005 |
| JP | 2005-154115 | A | 6/2005 |
| JP | 2005-212432 | A | 8/2005 |
| JP | 2005-212906 | A | 8/2005 |
| JP | 2005-247584 | A | 9/2005 |

* cited by examiner

STACKER POSITION CHANGER, RECORDING APPARATUS OR LIQUID EJECTING APPARATUS INCORPORATING THE SAME

BACKGROUND

1. Technical Field

The present invention relates to a stacker position changer which is operable to move the ejection stacker between a first position adapted to receive a first medium ejected from a recording apparatus (liquid ejecting apparatus), and a second position adapted to feed or receive a first medium and a second medium to or from the recording apparatus (liquid ejecting apparatus). The present invention also relates to a recording apparatus and a liquid ejecting apparatus incorporating such a stacker position changer.

The liquid ejecting apparatus is not limited to a printer, a copier, or a facsimile which employs an ink jet recording head and ejects ink from the recording head to a recording medium, to thus effect recording. The liquid ejecting apparatus is employed to encompasses an apparatus that ejects a liquid appropriate to an application, in place of ink, from a liquid ejecting head corresponding to the ink jet recording head onto a target medium corresponding to a recording medium, thereby causing the liquid to adhere to the medium.

In addition to the recording head, the liquid ejecting head encompasses a coloring material ejecting head used for manufacturing a color filer such as a liquid-crystal display or the-shaped; an electrode material (conductive paste) ejecting head used for forming electrodes, such as an organic EL display or a field emission display (FED) or the-shaped; a bio-organic substance ejecting head used for manufacturing a bio-chip; a sample ejecting head serving as a precision pipette; and the-shaped.

The recording apparatus is not limited to a printer, a copier, or a facsimile which employs an ink jet recording head and ejects ink from the recording head to a recording medium, to thus effect recording. The recording apparatus is employed to encompasses an apparatus that performs recording on a recording medium in a dot-impact manner, a thermal transfer manner, or an electrophotographic manner.

In addition, in the present specification, the "first medium" includes a flexible sheet medium having flexibility such as paper and an OHP (Over Head Projector) sheet, and the "second medium" includes a rigid medium having almost no flexibility such as a disk tray adapted to mount a disk medium (CD-R, DVD-R or the like).

2. Related Art

Recording to a label face of a disk medium like a CD-R as an example of the rigid medium has conventionally been carried out by the ink jet recording apparatus which executes recording to a sheet as an example of the flexible medium. Sheets are stacked in a hopper provided upstream of a conveying path, and only the uppermost sheet of the stacked sheets is picked up by a feeding roller having a D-shape in side view in cooperation with a pivot movement of the hopper.

Then, the sheet is fed from the feeding roller to a conveying roller pair on the downstream side in the sheet conveying direction, and is conveyed to a recording section while being nipped by the conveying roller pair. Further, the sheet is subjected to recording by the recording section, and is then ejected to an ejection stacker by an ejecting roller pair on the downstream side in the sheet conveying direction.

Generally, in order to place the recorded sheet to the ejection stacker, the ejection stacker is arranged below the ejecting roller pair.

On the other hand, when recording is executed on a label face of a disk medium, the disk medium is attached on a disk tray and is subjected to recording in order to convey the disk medium with a good posture. At this time, a path between a feeding roller and a conveying roller in a conveying path for a flexible sheet is not provided linearly in order to separate sheets which are likely to be fed in duplicate. Accordingly, a rigid disk medium and the disk tray cannot be set in the hopper, unlike the sheet medium.

Thus, a conveying path on the downstream side in the sheet conveying direction from the conveying roller pair is provided linearly, the disk tray is inserted from the ejecting roller pair provided on the downstream side in the sheet conveying direction of the sheet medium, and the ejecting roller pair is driven reversely to move the disk tray to a position where an upstream recording head can execute recording to the label face of the disk medium. Also, recording is executed to the label face of the disk medium while the disk tray is moved to the downstream side from a recording start position.

At this time, since the thickness of a sheet medium and the thickness of the disk tray are different from each other, it is necessary to change and adjust the spacing, i.e., platen gap (also referred to as "paper gap") between the recording head and the disk tray. It is also necessary to make a change about the ejecting roller pair. Generally, as an ejecting follower roller on the follower side of the ejecting roller pair, a so-called spur roller is used in order to nip a sheet medium in cooperation with a driving-side roller, and make the contact area with the recording surface of the sheet medium as small as possible.

Meanwhile, when the spur roller is used for movement of the disk tray, there is a possibility of damaging data recorded on the disk medium due to abutment of the roller on the label face of the disk medium. Thus, when recording is executed on the label face of a disk medium, the spur roller is configured to retreat, i.e., be released from the driving-side roller.

Such a configuration is disclosed in, for example, Japanese Patent No. 3633509 (JP-B-3633509) and Japanese Patent Publication Nos. 2004-90448A (JP-A-2004-90448), 2004-34637A (JP-A-2004-34637) and 2003-211760A (JP-A-2003-211760).

However, as the method of releasing the spur roller, there is the only way of taking users operation as a trigger. Moreover, in a case where the ejection stacker is configured to be movable so as to serve as both an ejection stacker and a tray guide, the ejection stacker is manually moved independently from the movement of the spur roller. Accordingly, when the user's operation is inadequate, there is a possibility that operation of the ejection stacker, the spur roller, etc. may become unstable. For example, irrespective of whether the ejection stacker is located in a position to take when recording is executed on a rigid medium, there may be occurred an inconsistent state caused by an erroneous operation that the spur roller is not located in a position to take when recording is executed on the rigid medium.

For example, Japanese Patent Publication Nos. 2005-14494A (JP-A-2005-14494) and 2005-212906A (JP-A-2005-212906) discloses an ejection stacker provided below the ejecting roller pair is moved upward so as to guide the disk tray to the ejecting roller pair. In other words, the ejection stacker is moved to the height of the linear conveying path when recording is executed the label face of the disk medium so that the ejection stacker may serve as both the tray guide and the ejection stacker of the disk tray which receives the disk tray to be ejected after the recording.

However, since the movement direction of the ejection stacker is only a vertical direction, them is a possibility that, if the ejection stacker extends far back to the upstream side in the sheet conveying direction, the disk tray may not be set easily. Also, when recording is executed on the label face of the disk medium, there is a possibility that, if the disk tray holding the disk medium is set in the ejection stacker, a downstream portion of the stacker in the sheet conveying direction during recording of the disk medium (upstream portion of the stacker in the sheet conveying direction before recording) might descend and unstable in posture.

For example, Japanese Patent Publication Nos. 2004-256232A (JP-A-2004-256232) and 2005-154115A (JP-A-2005-154115) disclose a front cover which also serves as an ejection stacker on which a recorded sheet is placed is provided in an ink jet recording apparatus which executes recording to a sheet medium as an example of the flexible medium. In a case where a closed state of the front cover cannot be detected, when the front cover is in the closed state, a recorded sheet cannot be ejected and placed on the front cover which servers as an ejection stacker. Accordingly, there is a possibility that a so-called an ejection jam may be caused.

On the other hand, in a case where the closed state of the front cover can be detected, the ejection jam can be prevented by stopping the sheet ejection. However, recording cannot be continued unless a user opens the front cover to release the state where the sheet ejection has stopped. Although recording can be continued without hindering recording and without causing an ejection jam if a configuration in which the closed state of the front cover can be detected and the front cover can be opened automatically is adopted, there occurs a problem that a configuration only for automatically opening the front cover should be newly provided. There is also a possibility that the structure becomes complicated and the cost becomes high as much as the newly provided configuration.

SUMMARY

It is one advantageous aspect of the invention to provide a stacker position changer capable of moving an ejection stacker to a position to take during recording of the second medium, thereby causing the spur roller to retreat from the ejecting drive roller positively.

It is one advantageous aspect of the invention to provide a stacker position changer capable of easily setting a disk tray on an ejection stacker with a good posture.

It is one advantageous aspect of the invention to provide a method of controlling a stacker position changer which can detect the closed state of a front cover and can open the front cover automatically, without newly providing a configuration only for opening the front cover.

It is an advantageous aspect of the invention is to provide a recording apparatus and a liquid ejecting apparatus incorporating such a stacker position changer.

According to one aspect of the invention, there is provided a recording apparatus, comprising:

a recording section, including a recording head operable to record information on a first medium and a second medium;

a first stacker, having a first face and a second face, and being movable between a first position and a second position; and a stacker position changer, operable to move the first stacker placed in the first position in a first direction, and then to move a second direction orthogonal to the first direction, thereby placing the first stacker in the second position, wherein:

the first face is adapted to receive the first medium conveyed from the recoding section in the first direction, when the first stacker is placed in the first position;

the second face is adapted to guide the first medium and the second medium conveyed to the recording section in a third direction opposite to the first direction, and to receive the first medium and the second medium conveyed from the recording section in the first direction, when the first stacker is placed in the second position; and the stacker position changer is operable to cause the second face to be parallel to the first direction and a fourth direction which is perpendicular to the first direction and the second direction.

With this configuration, since the first stacker moves toward a user when the recording with respect to the second medium is performed, the user can easily set the first medium or the second medium on the first stacker. In addition, the first stacker can stably support the set medium in the vicinity of the weighted center thereof.

The recording apparatus may further comprise a second stacker, disposed in a downstream side of the first stacker in the first direction, and having a third face adapted to receive the first medium conveyed from the recording section together with the first stacker placed in the first position.

The stacker position changer may be operable to ascend a downstream end portion in the first direction of the first stacker than an upstream end portion in the first direction of the second stacker, thereby bringing the first stacker in an inclined state.

The stacker position changer may be operable to move the first stacker in the first direction while maintaining the inclined state.

The stacker position changer may be operable to ascend an upstream end portion in the first direction of the first stacker, after the first stacker is moved in the first direction, thereby placing the first stacker in the second position.

This configuration is advantageous in a case where the space is restricted such that the upstream end portion of the first stacker cannot be ascended at the first position thereof.

In addition, the movable range of the first stacker in the first direction can be freely set within a range between the upstream end portion and a downstream end portion of the second stacker. Further, since only the first stacker is moved, in a case where the first stacker is moved with the aide of a power supplied from a power source disposed inside the recording apparatus, the load acting on the power source can be reduced. Thus, the power source can be downsized.

The recording apparatus may further comprise:

a first roller, adapted to convey the first medium and the second medium in the first direction and the third direction;

a second roller, adapted to convey the first medium in the first direction together with the first roller; and a frame member, supporting the second roller and coupled to the first stacker.

The stacker position changer may be operable to move the frame member in such a direction that the second roller is separated from the first roller, in accordance with the movement of the first stacker from the first position to the second position.

In this case, the second roller which is not necessary for the recording with respect to the second medium can be surely retreated from the first roller in accordance with the movement of the first stacker to the second position.

The recording apparatus may further comprise a third roller, adapted to convey the first medium and the second medium in the first direction and the third direction.

The stacker position changer may be operable to move the first stacker in the third direction, after the second face is caused to be parallel to the first direction and the fourth direction.

The recording apparatus may further comprise a position regulator, operable to regulate a position and a posture of the first stacker placed in the second position.

The position regulator may comprise a pair of opposing members adapted to clamp a rotary shaft of the first roller when the first stacker is moved in the third direction.

In this case, since the position and posture of the first stacker is regulated on the basis of the rotary shaft of the first roller, the conveyance of the set medium can be surely performed.

One of the opposing members may be a movable member, and the position regulator may comprise a biasing member biasing the movable member toward the other one of the opposing members.

One of the opposing members closer to the first position may be adapted to first come in contact with the rotary shaft.

In this case, the so-called overshoot of the movement of the first stacker to the second position can be avoided.

The stacker position changer may be operable to move the first stacker in the first direction by a first distance, and in the third direction by a second distance shorter then the first distance.

In this case, it is possible to maintain a position relationship that the second position is located in the downstream side of the first position in the first direction.

The second medium may be a rigid medium mounted on a tray member. The third roller may be adapted to come in contact with the tray member while avoiding the rigid medium.

In this case, the third roller never comes in contact with the second medium, so that information on the second medium can be prevented from being damaged.

The stacker position changer may comprise a rack and a pinion operable to move the first stacker between the first position and the second position.

In this case, not only the medium conveyance precision for the first and third directions but also that for the fourth direction can be secured.

The recording apparatus may further comprise a motor, operable to drive the first roller. The stacker position changer may be operable to move the first stacker with the aid of a driving force of the motor.

In this case, an additional power source is not necessary. Further, the position of the first stacker can be accurately determined by controlling the motor.

The motor may be operable to drive the first roller in a direction for conveying the first medium and the second medium in the first direction, when the stacker position changer moves the first stacker from the second position to the first position.

In this case, the first stacker is moved to the first position after the second medium is conveyed in the first direction. Thus, the second medium can be prevented from being damaged by the movement of the first stacker to the first position.

The recording apparatus may further comprise a gap adjuster, operable to adjust a distance from the recording head to the first medium and the second medium. The stacker position changer may be operable to transmit the driving force of the motor to the first stacker when the gap adjuster adjusts the distance.

In this case, an additional power source for effecting power transmission switching from the motor to the first stacker.

The stacker position changer comprises: a pair of racks and pinions, arranged in both sides of the recording apparatus in the fourth direction; and a power transmitter, operable to transmit a driving force of one of the pinions to the other one.

In this case, since the operations of the pair of racks and pinions can be synchronized with each other, the posture of the first stacker can be stabilized.

The second stacker may be movable between a third position opening at least a part of a front section of the recording apparatus and a fourth position closing the front section. That is, the second stacker may serve as a front cover of the recording apparatus.

According to one aspect of the invention, there is provided a liquid ejecting apparatus, comprising:

a liquid ejecting section, including a liquid ejecting head operable to eject liquid toward a first medium and a second medium;

a first stacker, having a first face and a second face, and being movable between a first position and a second position; and a stacker position changer, operable to move the first stacker placed in the first position in a first direction, and then to move a second direction orthogonal to the first direction, thereby placing the first stacker in the second position, wherein:

the first face is adapted to receive the first medium conveyed from the liquid ejecting section in the first direction, when the first stacker is placed in the first position;

the second face is adapted to guide the first medium and the second medium conveyed to the recording section in a third direction opposite to the first direction, and to receive the first medium and the second medium conveyed from the liquid ejecting section in the first direction, when the first stacker is placed in the second position; and the stacker position changer is operable to cause the second face to be parallel to the first direction and a fourth direction which is perpendicular to the first direction and the second direction.

According to one aspect of the invention, there is provided a recording apparatus, comprising:

a recording section, including a recording head operable to record information on a first medium and a second medium;

a power source, disposed inside the recording apparatus;

a stacker, having a first face and a second face and being movable between a first position and a second position;

a first roller, adapted to convey the first medium and the second medium in a first direction and a second direction opposite to the first direction;

a second roller, adapted to convey the first medium in the first direction together with the first roller, when the stacker is placed in the first position;

a frame member, supporting the second roller and coupled to the stacker;

a biasing member, biasing the frame member in such a direction that the second roller approaches the first roller; and a stacker position changer, operable to move the stacker between the first position and the second position with the aid of power supplied from the power source, wherein:

the first face is adapted to receive the first medium conveyed from the recoding section in the first direction, when the stacker is placed in the first position;

the second face is adapted to guide the first medium and the second medium conveyed to the recording section in the second direction, and to receive the first medium and the second medium conveyed from the recording section in the first direction, when the stacker is placed in the second position; and the stacker position changer is operable to move the frame member against a biasing force of the biasing member, in such a direction that the second roller is separated from the first roller, in accordance with the movement of the stacker from the first position to the second position.

With this configuration, the retreating movement of the second roller, which is necessary to be executed when the recording with respect to the second medium is performed, can be executed in cooperation with the movement of the stacker.

In addition, the biasing member can guide the second roller so as to approach the first roller when the stacker is moved to the first position.

The stacker position changer may comprise a groove, and the stacker may be provided with a projection adapted to move along the groove while receiving the biasing force of the biasing member.

The stacker position changer may be operable to move the first stacker placed in the first position in a first direction, and then to move a third direction orthogonal to the first direction, thereby placing the first stacker in the second position.

The stacker position changer may be operable to cause the second face to be parallel to the first direction and a fourth direction which is perpendicular to the first direction and the third direction.

In this case, since the projection can be surely engaged with the groove by the biasing force, the position and posture of the stacker can be accurately controlled.

The stacker position changer may comprise a rack and a pinion operable to move the stacker between the first position and the second position.

In this case, not only the medium conveyance precision for the first and second directions but also that for the fourth direction can be secured.

The recording apparatus may further comprise a position regulator, operable to regulate a position and a posture of the stacker placed in the second position while receiving the biasing force of the biasing member.

The recording apparatus may further comprise a third roller, adapted to convey the first medium and the second medium in the first direction and the third direction.

The stacker position changer may be operable to move the stacker in the second direction while receiving the biasing force of the biasing member, after the second face is caused to be parallel to the first direction and the fourth direction.

The biasing member may comprise a first biasing member providing a first biasing force with respect to the frame member, and a second biasing member providing a second biasing force with respect to the stacker.

In this case, an independent function can be assigned to each of the first biasing member and the second biasing member.

The first biasing member and the second biasing member may be configured such that the first biasing force and the second biasing force are not provided simultaneously.

In this case, it is possible to configure such that unnecessary force never acts on the stacker, so that the load acting on the power source can be reduced.

The stacker may be provided with a slider being slidable against the second biasing force. The second biasing member may provide the second biasing force with respect to the stacker by way of the slider.

In this case, since the first biasing force directly acts on the stacker whereas the second biasing force indirectly acts on the stacker by way of the movement of the slider, it is easy to configure such that the first biasing force and the second biasing force are not provided simultaneously.

In a case where it is configured such that, when the stacker is moved from the first position to the second position, the stacker first starts moving and the slider then starts moving, the reaction of the second biasing force can be utilized as a driving force for the stacker. Thus, the load acting on the power source can be reduced.

A moving path of the stacker may include a first section closer to the first position and a second section closer to the second position.

The second biasing force may act on the stacker when the stacker is placed in the first section, and the first biasing force acts on the stacker when the stacker is placed in the second section.

The second biasing member may be configured such that the second biasing force decreases as the first stacker approaches the first position.

In this case, creep deformation can be prevented from occurring on respective components after the stacker is moved to the first position.

According to one aspect of the invention, there is provided a liquid ejecting apparatus, comprising:

a liquid ejecting section, including a liquid ejecting head operable to eject liquid toward a first medium and a second medium;

a power source, disposed inside the liquid ejecting apparatus;

a stacker, having a first face and a second face and being movable between a first position and a second position;

a first roller, adapted to convey the first medium and the second medium in a first direction and a second direction opposite to the first direction;

a second roller, adapted to convey the first medium in the first direction together with the first roller, when the stacker is placed in the first position;

a frame member, supporting the second roller and coupled to the stacker;

a biasing member, biasing the frame member in such a direction that the second roller approaches the first roller; and a stacker position changer, operable to move the stacker between the first position and the second position with the aid of power supplied from the power source, wherein:

the first face is adapted to receive the first medium conveyed from the liquid ejecting section in the first direction, when the stacker is placed in the first position;

the second face is adapted to guide the first medium and the second medium conveyed to the liquid ejecting section in the second direction, and to receive the first medium and the second medium conveyed from the liquid ejecting section in the first direction, when the stacker is placed in the second position; and the stacker position changer is operable to move the frame member against a biasing force of the biasing member, in such a direction that the second roller is separated from the first roller, in accordance with the movement of the stacker from the first position to the second position.

According to one aspect of the invention, there is provided a recording apparatus, comprising:

a recording section, including a recording head operable to record information on a first medium and a second medium;

a first stacker, having a first face and a second face, and being movable between a first position and a second position;

a second stacker, having a third face and being movable between a third position opening at least a part of a front section of the recording apparatus and a fourth position closing the front section;

a power source, disposed inside the recording apparatus;

a stacker position changer, operable to move the first stacker between the first position and the second position with the aid of power supplied from the power source; and a controller, operable to cause the stacker position changer to move the first stacker from the first position to the second position, in a case where the second stacker is in the fourth position when the recording is performed with respect to the first medium, wherein:

the first face is adapted to receive the first medium conveyed from the recoding section in the first direction, when the first stacker is placed in the first position;

the second face is adapted to guide the first medium and the second medium conveyed to the recording section in a third direction opposite to the first direction, and to receive the first medium and the second medium conveyed from the recording section in the first direction, when the first stacker is placed in the second position;

the third face is adapted to receive the first medium conveyed from the recording section together with the first stacker placed in the first position; and the first stacker is adapted to come in contact with the second stacker placed in the fourth position in accordance with the movement from the first position to the second position, thereby causing the second stacker to move the third position.

With this configuration, since the second stacker serving also as a front cover of the recording apparatus can be automatically opened by the movement of the first stacker. Thus, the jam of the first medium can be avoided. In addition, it is not necessary to provide an additional equipment for merely opening the front cover.

The controller may be operable to interrupt the movement of the first stacker from the first position to the second position in a case where a load of the power source exceeds a prescribed value.

Incidentally, an alarm message or sound may be generated to notify a user the above fact.

In this case, damages can be prevented from occurring on respective components during the movement of the first stacker.

The controller may be operable to cause the stacker position changer to move the first stacker with a first speed when the first stacker comes in contact with the second stacker, and with a second speed higher than the first speed after the first stacker comes in contact with the second stacker.

In this case, the second stacker can be moved slowly to the third position, thereby preventing damage from occurring on respective components.

According to one aspect of the invention, there is provided a liquid ejecting apparatus, comprising:

a liquid ejecting section, including a liquid ejecting head operable to eject liquid toward on a first medium and a second medium;

a first stacker, having a first face and a second face, and being movable between a first position and a second position;

a second stacker, having a third face and being movable between a third position opening at least a part of a front section of the liquid ejecting apparatus and a fourth position closing the front section;

a power source, disposed inside the liquid ejecting apparatus;

a stacker position changer, operable to move the first stacker between the first position and the second position with the aid of power supplied from the power source; and a controller, operable to cause the stacker position changer to move the first stacker from the first position to the second position, in a case where the second stacker is in the fourth position when the liquid ejection is performed with respect to the first medium, wherein:

the first face is adapted to receive the first medium conveyed from the liquid ejecting section in the first direction, when the first stacker is placed in the first position;

the second face is adapted to guide the first medium and the second medium conveyed to the liquid ejecting section in a second direction opposite to the first direction, and to receive the first medium and the second medium conveyed from the liquid ejecting section in the first direction, when the first stacker is placed in the second position;

the third face is adapted to receive the first medium conveyed from the liquid ejecting section together with the first stacker placed in the first position; and the first stacker is adapted to come in contact with the second stacker placed in the fourth position in accordance with the movement from the first position to the second position, thereby causing the second stacker to move the third position.

DETAILED DESCRIPTION OF EXEMPLARY EMBODIMENTS

Figure 1:
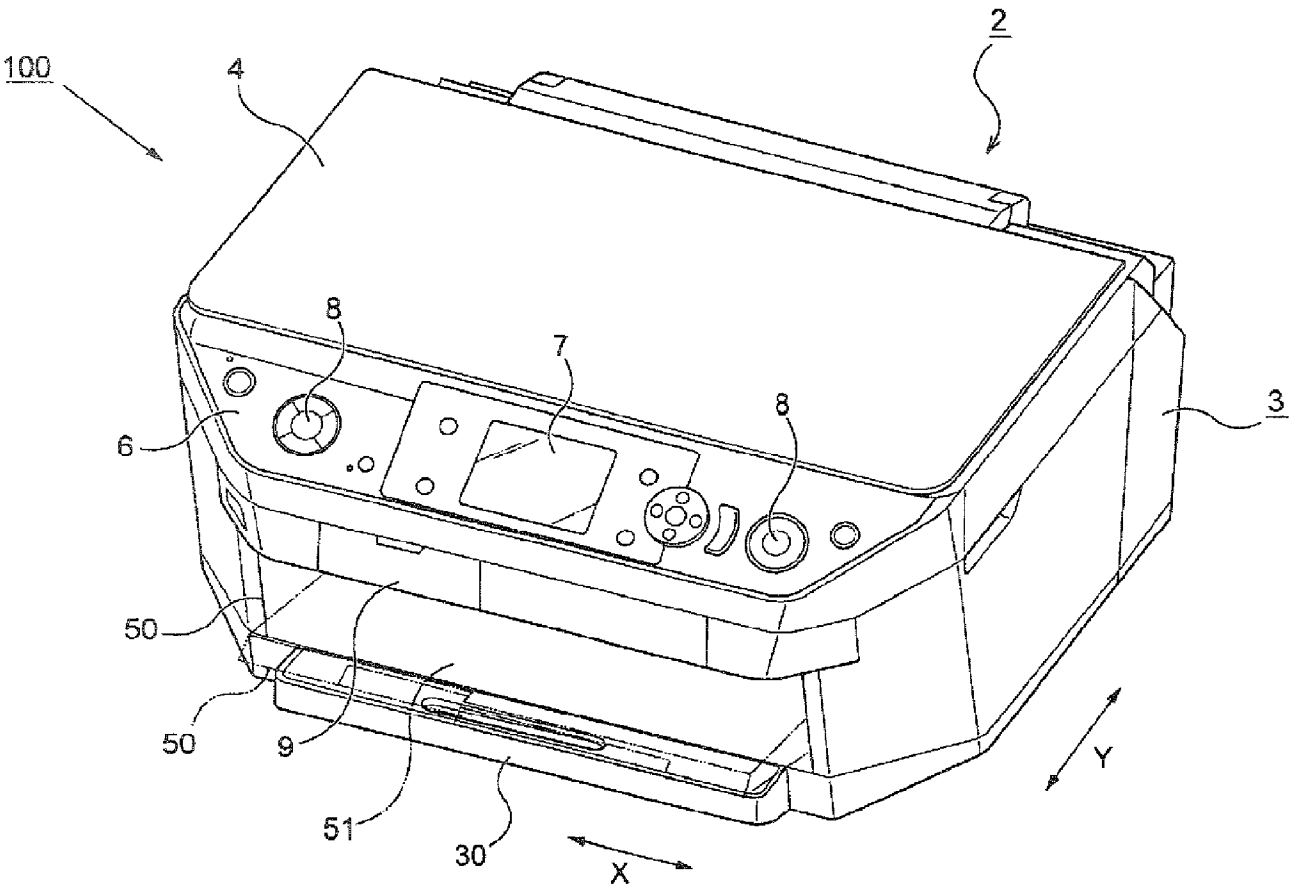
FIG. 1 is a perspective view showing the external appearance of an ink jet printer according to a first embodiment of the invention.

Exemplary embodiments of the invention will be described below in detail with reference to the accompanying drawings.

As a first embodiment of the invention, an ink jet printer 100 serving as a liquid ejecting apparatus and a recording apparatus will be described. The ink jet printer 100 comprises a scanner unit 4 above a printer body 3, so that this printer can be used as a scanner and a copier. The printer body 3 has a liquid crystal display 7 in the middle of a front panel 6 thereof, and has manual operation buttons 8 on the right and left of the front panel. A memory card slot 9 for allowing a memory card, in which image data is recorded, to be inserted thereinto is provided in a lower central portion of the front panel 6, so that the image data in the memory card can be directly printed without connecting with a personal computer (so-called direct printing).

A sheet feeding cassette 30 is provided in a front lower portion of the printer body 3 in such a manner that it can be attached and detached in a front-rear direction. An ejection stacker 50 which serves also as a part of a front cover of the printer body 3 in a non-use state as indicated by a solid line in FIG. 1 is provided in an upper portion of the sheet feeding cassette 30. The ejection stacker 50 is opened forward in an in-use state as indicated by a chain line in FIG. 1, so that a supporting face 51 is directed upward. The liquid crystal display 7, some of the manual operation buttons 8, and the memory card slot 9 are parts which are used when the direct printing is performed. That is, a memory card (not shown) is inserted into the memory card slot 9 and a manual operation button 8 is operated while viewing the liquid crystal display 7, so that even any number of favorite images can be simply printed with high quality at home.

Figure 2:
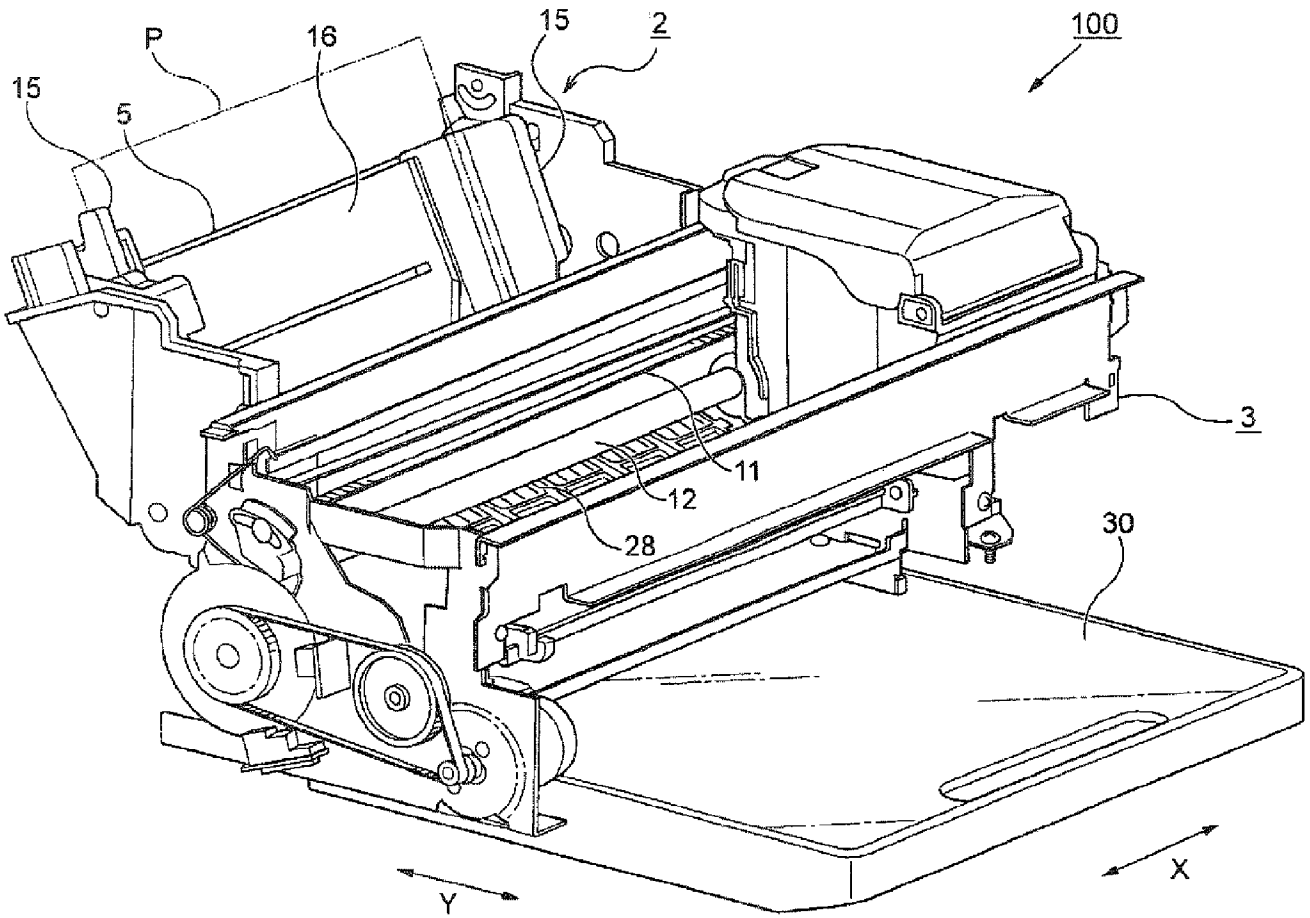
FIG. 2 is a perspective view showing the internal structure of the ink jet printer.

An automatic sheet feeder 2 which can continuously and automatically feed a recording medium P (hereinafter also simply referred to as "sheet P") is provided in a rear upper portion of the printer body 3. As shown in FIG. 2, the automatic sheet feeder 2 comprises: a feeding tray 5 on which a plurality of sheets P can be stacked; a hopper 16 which pushes up the sheets P on the feeding tray 5 towards a feeding roller 14 operable to pick up an uppermost sheet P on the feeding tray 5 by a nipping action with the hopper 16; a retard roller or separating pad (not shown) which separate the next sheet P which is fed in duplicate from the uppermost sheet P so that only the uppermost sheet P may be fed; and a return lever (not shown) which returns the separated next sheet P to the feeding tray 5.

Figure 3:
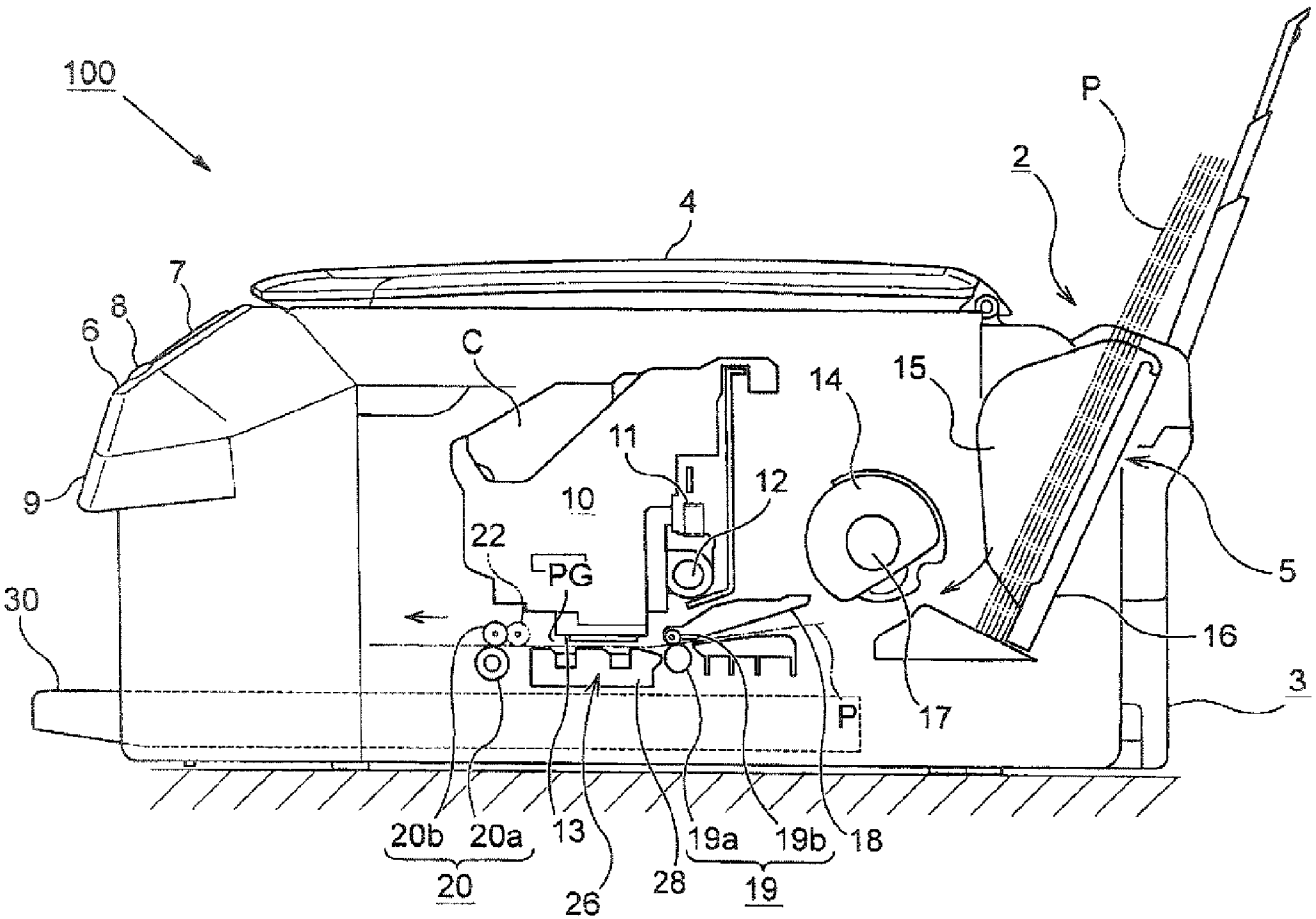
FIG. 3 is a schematic side view showing the internal structure of the ink jet printer.

Next, the outline of the internal structure of the ink jet printer 100 will be described along a conveying path of a sheet P with reference to FIG. 3. The feeding tray 5 is provided on the most upstream side in a conveying direction to stack a plurality of sheets P. The feeding tray 5 is provided with edge guides 15 which abut on lateral edges of the sheets P and guide smooth conveyance of the sheets P in a secondary scanning direction Y as the sheet conveying direction. The sheets P on the feeding tray 5 are pushed up towards the feeding roller 14 as the hopper 16 ascends with prescribed timing with rotation of a rotary shaft 17 of the feeding roller 14. Then, the uppermost one of the sheets P is sequentially picked up in accordance with the rotation of the feeding roller 14, and is fed to the downstream side in the sheet conveying direction.

A detecting lever operable to detect passage of a sheet P is provided downstream of the feeding roller 14. A conveying roller pair 19 constituted by a conveying drive roller 19*a* and a conveying follower roller 19*b* is provided downstream of the detecting lever. The conveying follower roller 19*b* of the rollers is coupled to a downstream end of a roller holder 18, and the roller holder 18 is pivotably biased by a torsion coil spring (not shown), so that the conveying follower roller 19*b* is always brought into pressure contact with the conveying drive roller 19*a*.

The sheet P conveyed by the conveying roller pair 19 is led to a recording position 26 (liquid ejecting position) in which a carriage 10 is provided. The carriage 10 is coupled to a carriage guide shaft 12 in such a manner that it can reciprocate in a primary scanning direction X that is a lateral direction of a sheet P and a disk tray Q, and is reciprocated by an endless belt 11. A recording head 13 (liquid ejecting head) operable to eject ink to a recording medium, to execute recording (liquid ejection) is mounted on the bottom face of the carriage 10. An ink cartridge C (liquid container) is mounted on the carriage 10.

A platen 28 which faces the recording head 13 and specifies a platen gap PG between a head face of the recording head 13, and a recording medium is provided below the recording head 13. Also, by mutually repeating the operation of conveying a recording medium with a prescribed conveyance amount in the secondary scanning direction Y perpendicular to the primary scanning direction X, and the operation of ejecting ink to the recording medium from the recording head 13 while the recording head 13 is caused to reciprocate once in the primary scanning direction X, between the recording head 13 and the platen 28, desired recording is executed over almost the whole recording surface of the recording medium. In addition, the platen gap PG becomes a very important factor when high-precision recording is executed, and is appropriately adjusted according to a change in the thickness of a recording medium.

An ejecting roller pair 20 constituted by an ejecting drive roller 20*a* and a plurality of first ejecting follower rollers 20*b* are provided downstream of the recording head 13. A plurality of auxiliary ejecting follower rollers 22 are provided on the upstream side in the sheet conveying direction in the vicinity of the first ejecting follower rollers 20*b*. The sheet P conveyed by the ejecting roller pair 20 is ejected to the supporting face 51 on the ejection stacker 50 which is located further downstream in the sheet conveying direction.

The first ejecting follower rollers 20*b* and the auxiliary ejecting follower rollers 22 are spur rollers having a plurality of teeth on the outer periphery thereof, and are coupled by roller holders that hold the follower rollers, respectively in such a manner that they can rotate freely. The conveying follower roller 19*b* is arranged such that the position of the axis thereof is located a little downstream of the conveying drive roller 19*a* in the sheet conveying direction, and the first ejecting follower rollers 20*b* are arranged such that the position of the axes thereof is located a little upstream of the ejecting drive roller 20*a* in the sheet conveying direction. By adopting such an arrangement, a curving state called "reverse deflection" in which a sheet P becomes slightly convex downward between the conveying roller pair 19 and the ejecting roller pair 20 is formed. As a result, the sheet P in a position facing the recording head 13 is pushed against the platen 28, and thereby floating of the sheet P is prevented, so that recording can be executed normally.

Figure 4:
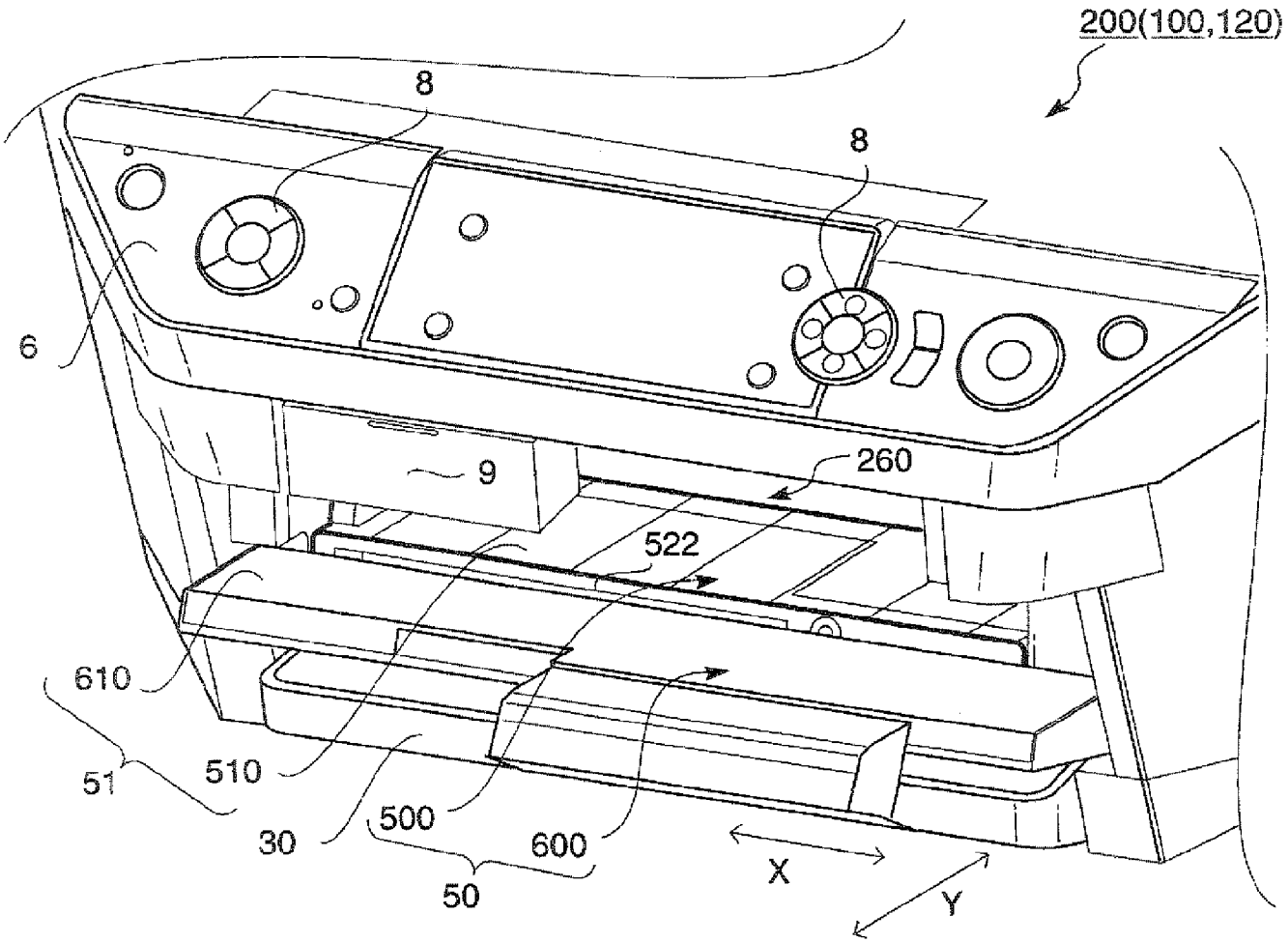
FIG. 4 is a perspective view of a stacker position changer in the ink jet printer, showing a state a sheet recording mode is effected.
Figure 5:
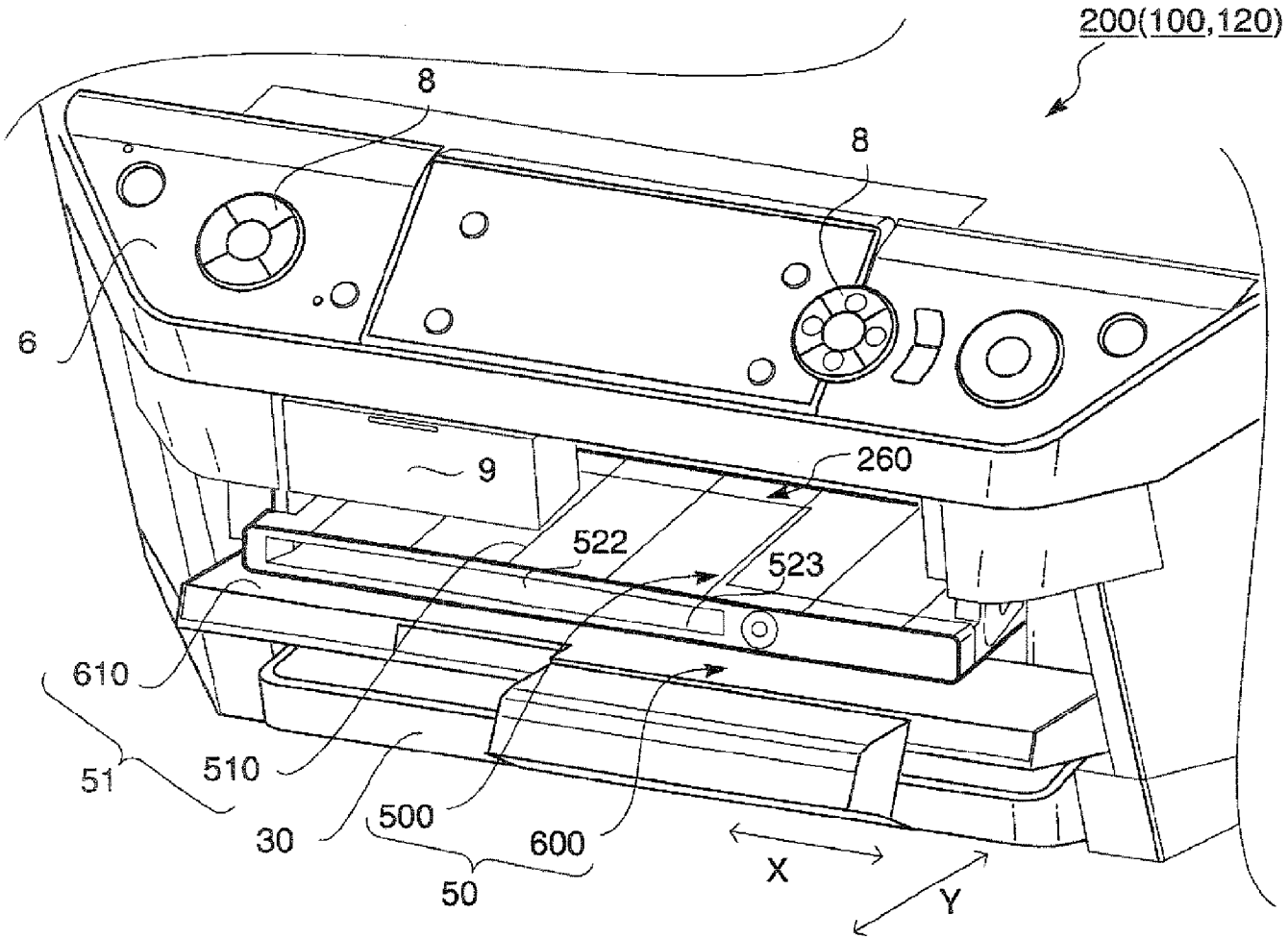
FIG. 5 is a perspective view of the stacker position changer, showing a state that a disk recording mode is effected.
Figure 6:
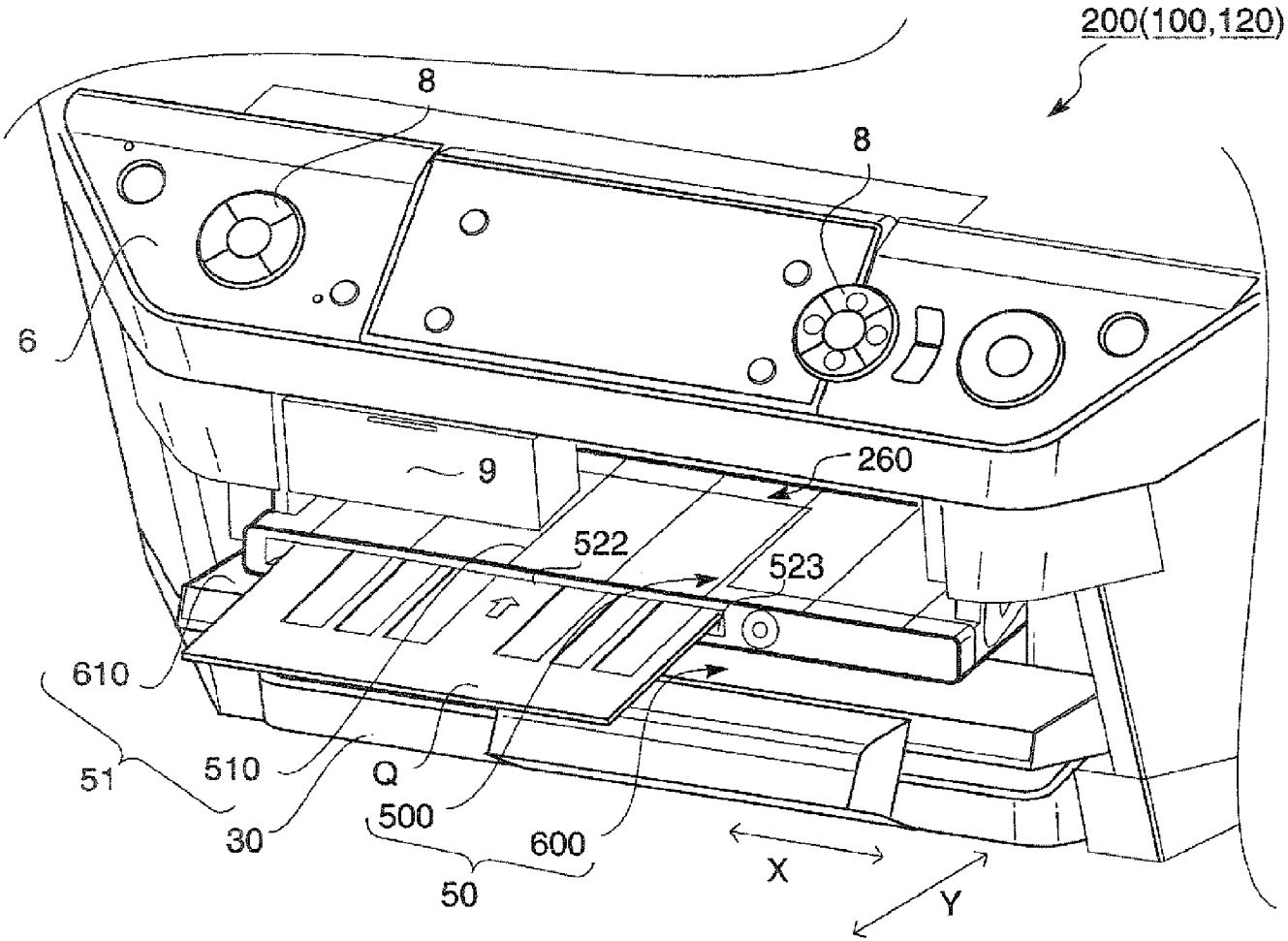
FIG. 6 is a perspective view of the stacker position changer, showing a state that a disk tray is set.

As shown in FIGS. 4 to 6, a stacker position changer 200 is provided in an ejector 120 operable to eject a recording medium from the ink jet printer 100, and the stacker position changer 200 has a sheet recording mode in which recording is executed on a sheet P, and a disk recording mode in which recording is executed on a label of a disk medium. Switching between the recording modes is performed when a user operates the manual operation buttons 8. When switching to the recording mode is made, a first ejection stacker 500 provided in the stacker position changer 200 moves between a first position and a second position by a first motor 901 (refer to FIGS. 7 to 9) as a power source of the ejecting drive roller 20*a*. The movement of the first ejection stacker 500 will be described in detail later, and the first position and the second position will be described first.

Figure 7:
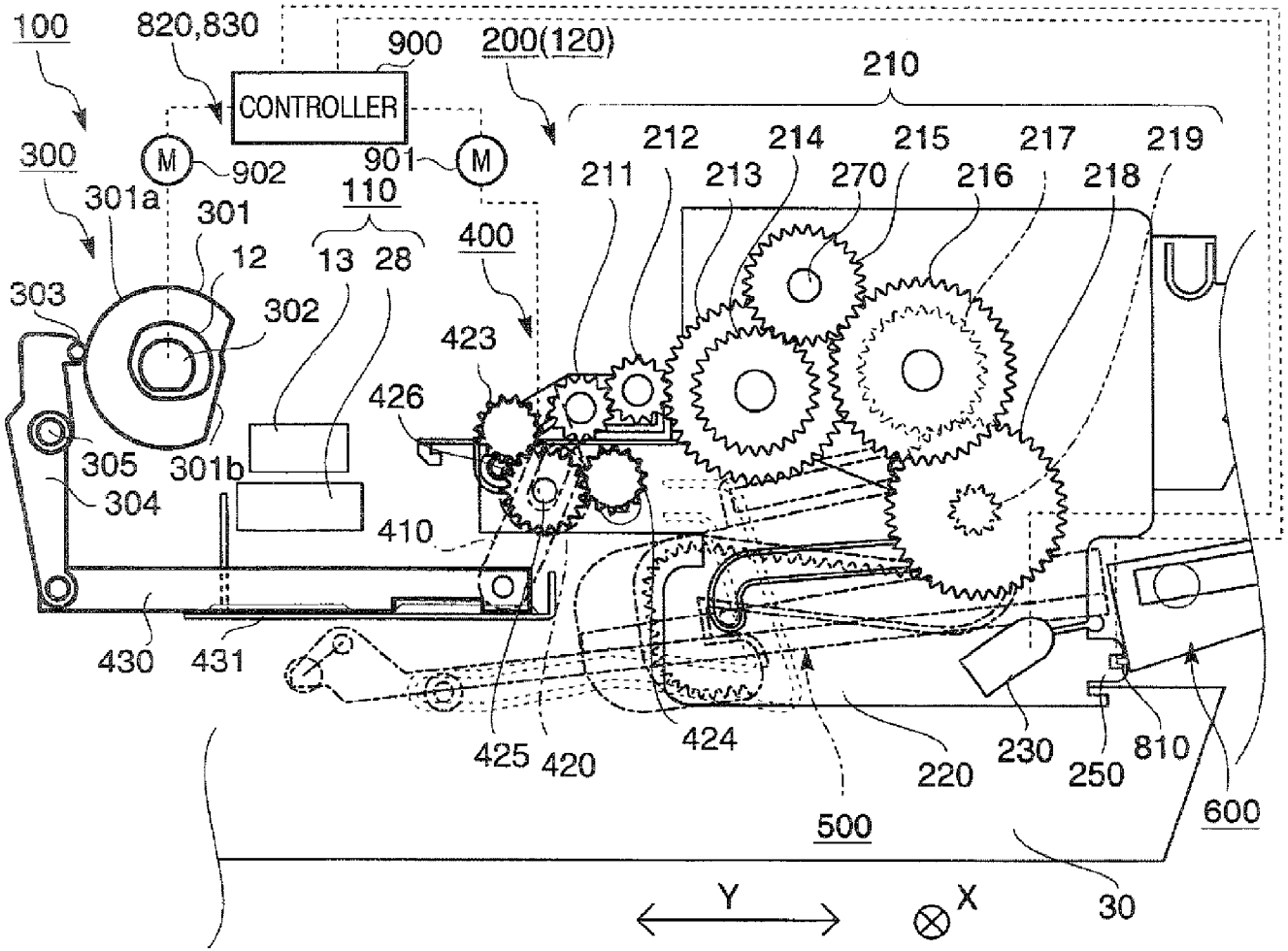
FIGS. 7 to 9 are schematic side views for explaining transmission of power to the stacker position changer.
Figure 8:
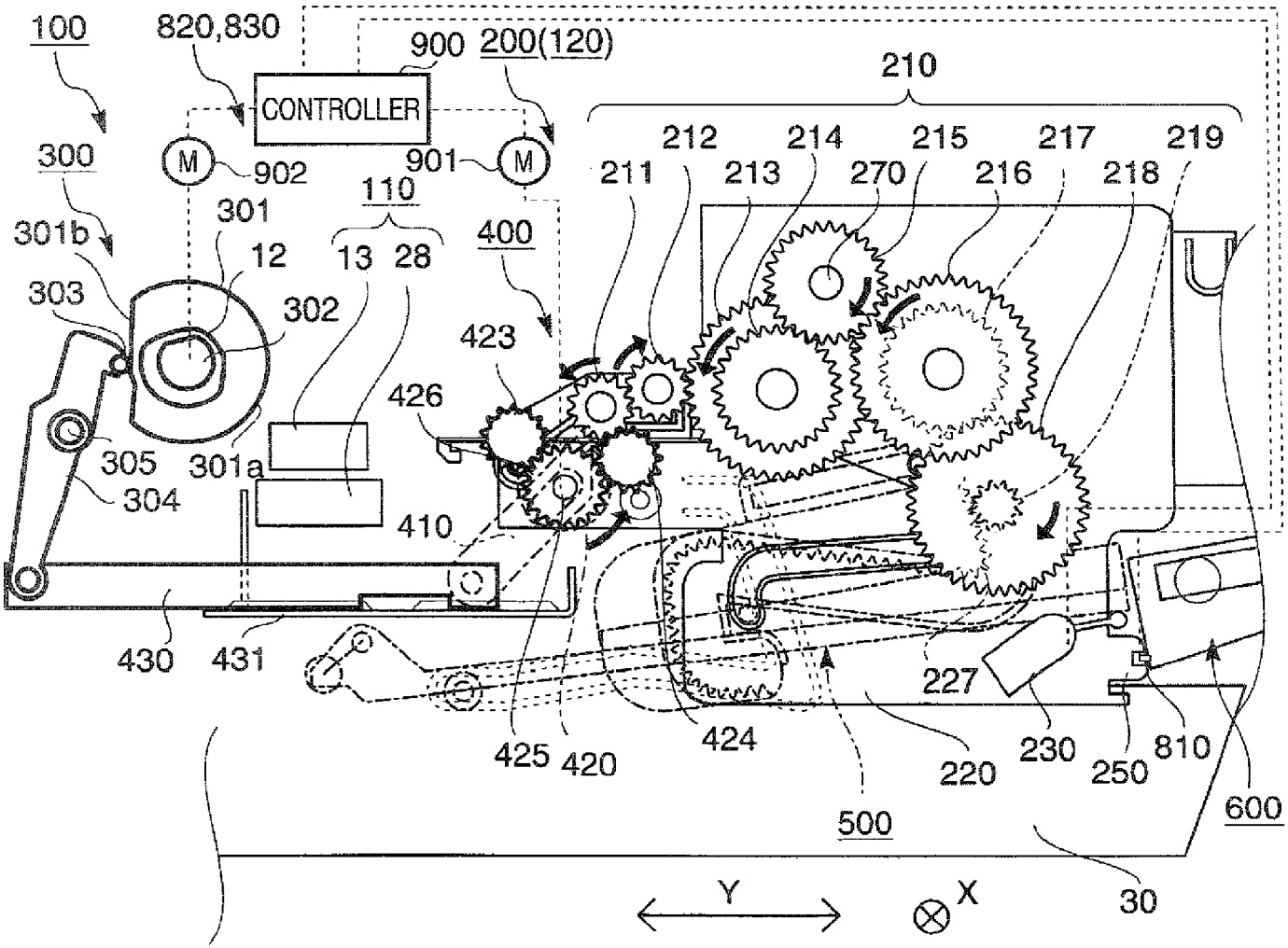
Figure 9:
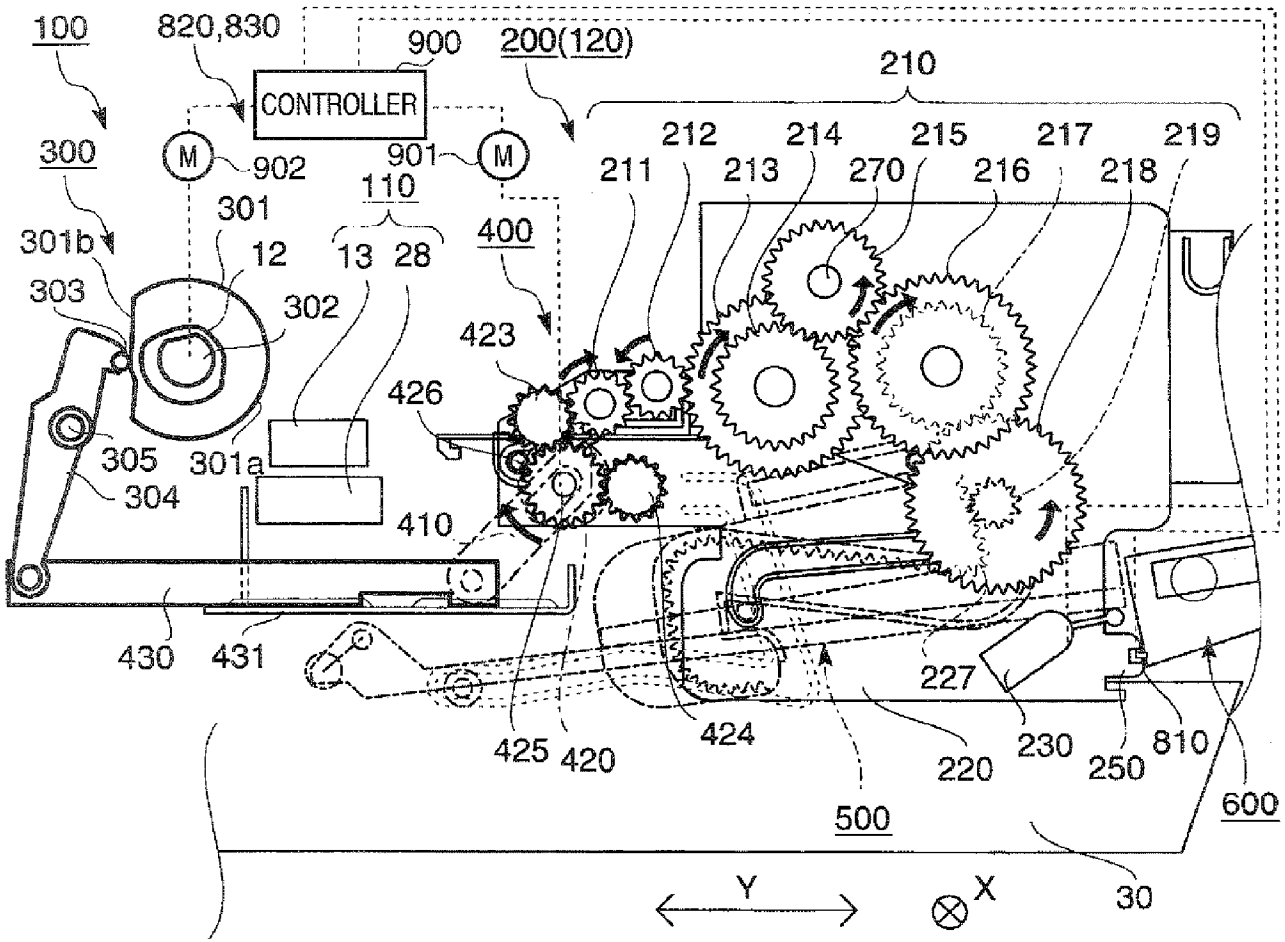

In addition, the switching between the recording modes may be made under the determination of a controller 900 when recording data is sent to the controller 900 (refer to FIGS. 7 to 9). Moreover in FIGS. 4 to 6, the right side in the X direction is a home position side of the carriage 10, and the left side in the X-direction is an away position side of the carriage 10.

As shown in FIG. 4, the ejection stacker 50 includes a first ejection stacker 500 on the upstream side in the sheet conveying direction that is the secondary scanning direction Y, and a second ejection stacker 600 on the downstream in the sheet conveying direction. The second ejection stacker 600 is configured so that an opening 260 provided at the front of the ink jet printer 100 may be opened and closed, and the state shown in FIG. 4 is an opened state.

In the sheet recording mode, when a recorded sheet P is ejected by the ejecting roller 20, the sheet P is placed on the top faces of a first supporting face 510 of the first ejection stacker 500 and a second supporting face 610 of the second ejection stacker 600, which form the supporting face 51. At this time, a downstream end of the first ejection stacker 500 in the sheet conveying direction is located at a position higher than an upstream end of the second ejection stacker 600. Accordingly, there is no possibility that a trouble, what is so called, a sheet jam may occur that a leading end of a sheet P is received in the gap between the first ejection stacker 500 and the second ejection stacker 600.

As shown in FIG. 5, in the disk recording mode, the first ejection stacker 500 moves to a position above the second ejection stacker 600 on the downstream side in the sheet conveying direction. This position is a second position of the first ejection stacker 500. The first ejection stacker 500 has a tray guide opening 522 on the downstream side of the first supporting face 510 in the sheet conveying direction, and a tray guiding face 523 that is a bottom face in the tray guide opening 522, and that guides the disk tray Q (refer to FIG. 6) in the sheet conveying direction (Y). In the second position, the tray guiding face 523 is provided so as to be parallel to the sheet conveying direction (Y) and the primary scanning direction X, and so as to be at the same height as the top positions of the ejecting drive roller 20*a* and the platen 28.

As shown in FIG. 6, when switching to the disk recording mode is made, the first ejection stacker 500 move to the second position. Then, a user attaches a disk medium to a disk tray Q, and inserts this disk tray Q into the tray guide opening 522 of the first ejection stacker 500. When the tray has been set, the disk tray Q is nipped by the ejecting drive roller 20*a* and second ejecting follower rollers 503 (refer to FIGS. 10 to 22) to be described. Thereafter, the tray is sent to the upstream side in the sheet conveying direction by reverse rotation of the ejecting drive roller 20*a*. Then, an upstream end of the disk medium in the sheet conveying direction, which is attached to the disk tray Q, stops in a position facing the recording head 13, i.e., a so called recording start position. At this time, in order to prevent that the conveying follower roller 19*a* abuts on a label face of the disk medium to damage the data stored in the disk medium, the disk tray Q is provided so that its upstream portion in the sheet conveying direction may not be nipped by the conveying roller pair 19.

In addition, two sets of the ejecting drive roller 20*a* and two second ejecting follower rollers 503 are provided so that they may not nip a disk medium directly but may nip portions in the vicinity of both sides of a disk tray Q in the primary scanning direction X. Accordingly, there is no possibility of damaging the data information stored in the disk medium. Also, in order to improve the conveying precision of the disk tray, it is natural that a configuration in which the conveying roller pair 19 as well as the ejecting drive roller 20*a* and the second ejecting follower rollers 503 nips and conveys the disk tray may be adopted.

Thereafter, recording is executed on the label of the disk medium by causing the recording head 13 to carry out scanning in the primary scanning direction X while the ejecting drive roller 20*a* is normally driven to move the disk tray Q to the downstream side in the sheet conveying direction. Then, when the recording has been completed, the ejecting drive roller 20*a* and the second ejecting follower rollers 503 eject the disk tray Q to the downstream side in the sheet conveying direction in cooperation with each other. At this time, since the upstream end of the disk tray Q in the sheet conveying direction departs from the nip between the ejecting drive roller 20*a* and the second ejecting follower rollers 503, the disk tray Q stops in a position further projected from the position where a portion of the disk tray Q has projected from the tray guide opening 522 as again shown in FIG. 6.

In the disk recording mode, the first ejection stacker 500 having the tray guide opening 522 moves to the downstream side in the sheet conveying direction. Thus, a user can set the disk tray Q easily. The user can take out the disk tray Q easily after the recording. Since a portion of the disk tray Q has projected from the tray guide opening 522 at this time, the disk tray Q can be taken out more easily. Also, since the first ejection stacker 500 moves to the downstream side in the sheet conveying direction, it is possible to support the center of gravity of the disk tray Q. Accordingly, the posture of the disk tray Q can be stabilized.

As shown in FIG. 7, the ink jet printer 100 comprises: a platen gap adjuster 300 which can adjust the spacing between the recording head 13 and the platen 28 which are provided in the recording section 110, according to the thickness of a recording medium; the stacker position changer 200 which moves the first ejection stacker 500 in order to guide and receive the disk tray Q when recording is executed on the label of a disk medium; and a power transmission switcher 400 which changes over transmission of the power of the ejecting drive roller 20*a* to the stacker position changer 200.

Among them, the platen gap adjuster 300 comprises: a cam shaft 302 which is rotated by a second motor 902 for adjusting the platen gap PG; the carriage guide shaft 12 provided so as to be eccentric from a rotational center of the cam shaft 302; a gap adjusting cam 301 provided with the cam shaft 302; and a lever member 304 which always biases the gap adjusting cam 301 with a torsion coil spring (not shown).

The stacker position changer 200 comprises: a base 220, a power transmitter 210 which transmits the power transmitted from the power transmission switcher 400 to the first ejection stacker 500; and the first ejection stacker 500 which moves between the first position and the second position.

Furthermore, the power transmission switcher 400 comprises: a sun gear 426 which is provided coaxially with and rotated integrally with the ejecting drive roller 20*a* which are rotated by the first motor 901; a first planetary gear 423 and a second planetary gear 424 which are circumscribed to the sun gear 426; a planetary gear holder 420 which holds the first planetary gear 423 and the second planetary gear 424 and is rotatable about a rotary shaft 425 of the sun gear 426; a first gear 211 which receives the power of the first planetary gear 423 and the second planetary gear 424; and a locking lever 410 which regulates the posture of the planetary gear holder 420.

Here, the first motor 901 is configured so that the conveying drive roller 19*a* and the feeding roller 14 may also be rotated, and is controlled by the controller 900.

The recording head 13 is provided in the carriage 10 which moves in the primary scanning direction X by the carriage guide shaft 12. If there is a change in the thickness of a sheet P or a change from the sheet recording mode to the disk recording mode, the cam shaft 302 is rotated by the second motor 902. At this time, the carriage guide shaft 12 is eccentric from the cam shaft 302. Accordingly, the platen gap adjuster 300 can adjust the platen gap PG according to the rotation of the cam shaft 302.

An abutting portion 303 of the lever member 304 which has been biased in the counterclockwise direction in the drawing by a torsion coil spring (not shown) with the lever shaft 305 as a fulcrum is provided so as to abut on and press the gap adjusting cam 301. At this time, the platen gap adjustment is executed by rotating the cam shaft 302 within a range in which an arc portion 301*a* of the gap adjusting cam 301 abut on the abutting portion 303. Also, when switching between the sheet recording mode and the disk recording mode is made, changeover of the power transmission switcher 400 to be described is performed by rotating the cam shaft 302 so that a chord portion 301*b* of the gap adjusting cam 301 may face the abutting portion 303.

The portion of the lever member 304 opposite to the side where the abutting portion 303 is provided is rotatably connected with an end of a slide bar 430 which reciprocates horizontally by a bar guide 431 provided in the base 220. On the other hand, one end of the locking lever 410 is pivotably connected with the other end of the slide bar 430.

As mentioned above, the sun gear 426 is provided so that it may rotate by the rotation of the ejecting drive roller 20*a*. Although the planetary gear holder 420 holding the first planetary gear 423 and the second planetary gear 424 tends to rotate in the same direction as the direction of rotation of the sun gear 426 by the rotation of the sun gear 426, its posture is regulated by the locking lever 410. Also, both the first planetary gear 423 and the second planetary gear 424 will be in a state of being separated from the first gear 211. Accordingly, the power of the sun gear 426 is not transmitted to the first gear 211.

Here, the planetary gear holder 420 may be configured so that it may rotate in the same direction as the sun gear 426 by the frictional resistance generated between the planetary gear holder 420 and the rotary shaft 425. The planetary gear holder 420 may be configured so that it may rotate in the same direction as the sun gear 426 by the frictional resistance generated between the first planetary gear 423 and the second planetary gear 424, and the planetary gear holder 420.

As shown in FIG. 8, when the cam shaft 302 rotates in the clockwise direction, and the chord portion 301 also faces the abutting portion 303, the lever member 304 rotates in the clockwise direction. Then, the slide bar 430 moves to the left in the drawing. Moreover, since the locking lever 410 moves with movement of the slide bar 430 to the left, the planetary gear holder 420 is released from the regulation of the locking lever 410. Accordingly, a force in the direction of rotation of the sun gear 426 is generated in the planetary gear holder 420. At this time, the ejecting drive roller 20*a* rotates in the counterclockwise direction in the drawing that is the reverse rotation direction in which a sheet P can be moved to the upstream side. The sun gear 426 is provided so that it may rotate in the same direction as the ejecting drive roller 20*a*. Accordingly, the planetary gear holder 420 rotates in the counterclockwise direction about the rotary shaft 425 of the sun gear 426, and the second planetary gear 424 abuts on the first gear 211. That is, the power of the sun gear 426 is transmitted to the first gear 211 via the second planetary gear 424. Since the second planetary gear 424 abuts on the first gear 211 while it rotates in the clockwise direction, the first gear 211 rotates in the counterclockwise direction.

The power transmitter 210 of the stacker position changer 200 comprises: the first gear 211; a second gear 212 which is circumscribed to the first gear 211; a third gear 213 which is circumscribed to the second gear 212; a fourth gear 214 which is provided integrally with the third gear 213; a fifth gear 215 circumscribed to the fourth gear 214; a sixth gear 216 which is circumscribed to the fifth gear 215; a seventh gear 217 which is provided integrally with the sixth gear 216; an eighth gear 218 which is circumscribed to the seventh gear 217; a pinion 219 which is provided integrally with the eighth gear 218; and a rack 227 which receives the power of the pinion 219.

A pair of the fifth gears 215, a pair of the sixth gears 216, a pair of the seventh gears 217, a pair of the eighth gear 218, a pair of the pinions 219, and a pair of the racks 227 are provided on both sides in the width direction, i.e., primary scanning direction with respect to the sheet conveying direction (Y). A pair of right and left fifth gears 215 is provided so that they may be synchronously rotated by the power transmission shaft 270. Accordingly, the sixth gears 216, the seventh gears 217, the eighth gear 218*s*, the pinions 219, and the racks 227 which are provided in pairs, respectively, can be rotated synchronously. Since the previously-mentioned gears makes synchronous rotation on both the right and left sides, the following description will be made about only the gears on one side, and description of the gears on the other side is omitted.

When the first gear 211 rotates in the counterclockwise direction, power is transmitted to the second gear 212 to rotate the second gear 212 in the clockwise direction. Then the power of the second gear 212 is transmitted to the third gear 213 to rotate the third gear 213 in the counterclockwise direction. Since the fourth gear 214 is provided integrally with the third gear 213, the power of the fourth gear 214 which rotates in the counterclockwise direction integrally with the third gear 213 is transmitted to the fifth gear 215 to rotate the fifth gear 215 in the clockwise direction. The power of the fifth gear 215 is transmitted to the sixth gear 216 to rotate the sixth gear 216 in the counterclockwise direction. Since the seventh gear 217 is provided integrally with the sixth gear 216, the seventh gear rotates in the counterclockwise direction integrally with the sixth gear 216. The power of the seventh gear 217 is transmitted to the eighth gear 218 to rotate the eighth gear 218 in the clockwise direction. Since the pinion 219 is provided integrally with the eighth gear 218, the pinion rotates in the clockwise direction integrally with the eighth gear 218.

When the pinion 219 rotates in the clockwise direction, the pinion 219 moves the first ejection stacker 500 from the first position to the second position via the rack 227 provided on the side of the first ejection stacker. When the first ejection stacker 500 has completed its movement to the second position, the cam shaft 302 rotates in the counterclockwise direction in a range where the arc portion 301*a* and the abutting portion 303 abut on each other, thereby rotating the lever member 304 in the counterclockwise direction to the state shown in FIG. 7. At this time, the cam shaft 302 is rotated so that the platen gap may become a PG in a disk recording mode.

On the other hand, when switching from the disk recording mode to the sheet recording mode, the cam shaft 302 rotates in the clockwise direction from the state shown in FIG. 7 to rotate the lever member 304 in the clockwise direction to a position shown in FIG. 9. Then, as mentioned above, the planetary gear holder 420 is released from regulation of the locking lever 410.

At this time, as shown in FIG. 9, the ejecting drive roller 20*a* rotates in the counterclockwise direction in the drawing that is the normal rotation direction in which a sheet P can be moved to the downstream side. Therefore, as mentioned above, the sun gear 426 also rotates in the in the counterclockwise direction that is the same direction as the ejecting drive roller 20*a*. Then, as mentioned above, the sun gear 426 rotates the planetary gear holder 420 in the clockwise direction.

The planetary gear holder 420 rotates in the clockwise direction, and thereby the first planetary gear 423 is circumscribed to the first gear 211. Accordingly, the power of the sun gear 426 is transmitted to the first gear 211 via the first planetary gear 423. At this time, since the sun gear 426 rotates in the clockwise direction, the first planetary gear 423 rotates in the counterclockwise direction, and the first gear 211 rotates in the clockwise direction. With the rotation of the first gear 211, to the downstream side from the upstream in the direction of power transmission, the second gear 212 rotates in the counterclockwise direction, the third gear 213 and the fourth gear 214 rotate in the clockwise direction, the fifth gear 215 rotate in the counterclockwise direction, the sixth gear 216 and the seventh gear 217 rotate in the clockwise direction, and the eighth gear 218 and the pinion 219 rotate in the counterclockwise direction.

When the pinion 219 rotates in the counterclockwise direction, the pinion 219 moves the first ejection stacker 500 from the second position to be described to the first position via the rack 227 provided on the side of the first ejection stacker. When the first ejection stacker 500 has completed its movement to the first position, the cam shaft 302 rotates in the counterclockwise direction in a range where the arc portion 301*a* and the abutting portion 303 abut on each other, thereby rotating the lever member 304 in the counterclockwise direction to the state shown in FIG. 7. At this time, the cam shaft 302 is rotated so that the platen gap may become a PG in the sheet recording mode.

Subsequently, movement of the first ejection stacker 500 from the first position to the second position will be described.

Here, the first position is a position where, in the sheet recording mode, a sheet P which has been subjected to the recording and has been ejected by the ejecting drive roller 20*a* can be received at a position below the ejecting drive roller 20*a*.

On the other hand, the second position is a position where, in the disk recording mode, the disk tray Q holding a disk medium before recording is guided to the ejecting roller pair composed of the ejecting drive roller 20*a* and the second ejecting follower rollers 503, and the disk tray Q holding a disk medium having been subjected to the recording and ejected by the ejecting roller pair composed of the ejecting drive roller 20*a* and the second ejecting follower rollers 503 can be received. Also, the second position is a position where the tray guiding face 523 of the first ejection stacker 500 is located at almost the same height as an upper end of the ejecting drive roller 20*a*.

Figure 10:
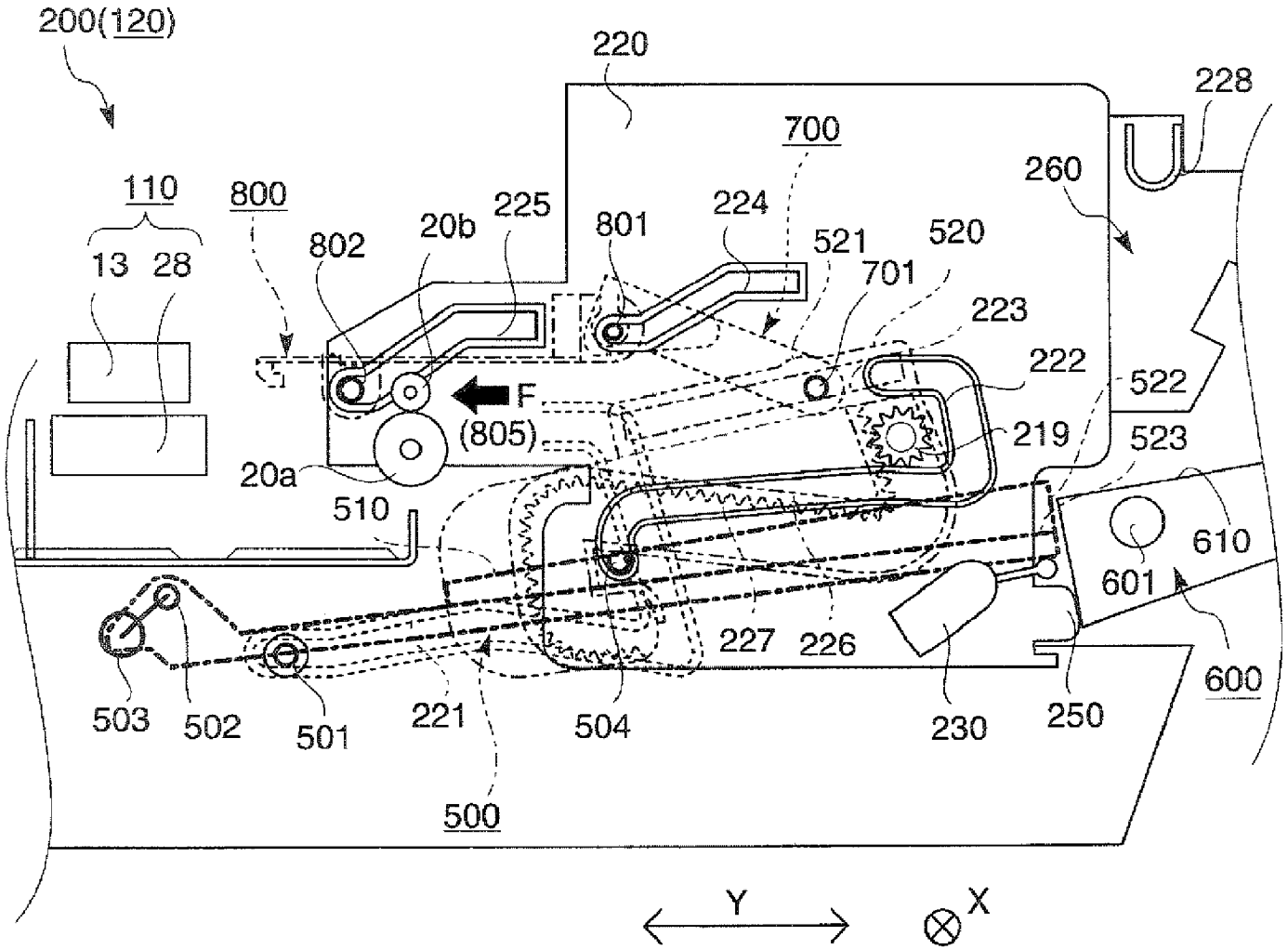
FIG. 10 is a side view showing a state that a first ejection stacker of the stacker position changer is placed in a first position.

FIGS. 10 to 22 are side views showing movement of the first ejection stacker of the stacker position changer according to the present invention. Among the drawings. FIG. 10 shows the first position of the first ejection stacker, and FIGS. 11 to 21 shows movement from the first position to the second position, and FIG. 22 shows the second position.

As shown in FIG. 10, the stacker position changer 200 comprises: the first ejection stacker 500 which moves between the first position and the second position; the second ejection stacker 600 disposed downstream of the first ejection stacker 500 in the sheet conveying direction; the ejecting drive roller 20*a* provided on the side of the base 220; an ejector frame 800 having the first ejecting follower rollers 20*b* which eject a sheet P in the eject direction in cooperation with the ejecting drive roller 20*a*; a connecting arm 700 which connects the ejector frame 800 with the first ejection stacker 500; and the power transmitter 210 which transmits the power of the ejecting drive roller 20*a* to the first ejection stacker 500.

A first groove 221 which guides movement of the first ejection stacker 500 is provided on the side of the base 220 corresponding to the away position side of the carriage 10 in the primary scanning direction. A second groove 222 which guides movement of the first ejection stacker 500 is provided on the side of the base 220 corresponding to the home position side of the carriage 10 in the primary scanning direction. Moreover, a pair of fourth grooves 224 and a pair of fifth grooves 225 which guide movement of the ejector frame 800 are provided on both sides of the base 220 in the primary scanning direction. A posture regulator 228 which regulates the posture of the first ejection stacker 500 during movement is provided above the side of the base 220 corresponding to the home position side of the carriage 10 in the primary scanning direction.

The first ejection stacker 500 comprises: the first supporting face 510 adapted to receive an ejected sheet P when the first ejection stacker 500 is placed in the first position; the tray guide opening 522 which is located inside the first supporting face, and is adapted to guide the disk tray Q to be subjected to the recording to the ejecting roller pair composed of the ejecting drive roller 20*a* and the second ejecting follower rollers 503 and to receive the disk tray Q having been subjected to the recording when the first ejection stacker is placed in the second position; a first projection 501 which is engaged with and guided by the first groove 221 of the base 220; a second projection 504 which is engaged with and guided by the second groove 222 of the base 220; the second ejecting follower rollers 503 which are provided upstream of the first supporting face 510 in the sheet conveying direction, which are pivotable about a pivot shaft 502 while being biased by a spring (not shown), and which move the disk tray Q in the sheet conveying direction (Y) in cooperation with the ejecting drive roller 20*a*; and a contact face 520 and a projection 521 which are adapted to abut on the posture regulator 228 of the base 220.

The first ejection stacker 500 has a pair of sixth grooves 226 which are provided on both sides in the primary scanning direction, and a pair of third grooves 223 which are provided on both sides in the primary scanning direction to engage with the connecting arm 700. Also, racks 227 are provided on one face of each of the pair of sixth grooves 226 so that they may mesh with the aforementioned pair of pinions 219.

The second ejection stacker 600 is pivotable about a pivot shaft 601, and comprises: the second supporting face 610 adapted to receive an ejected sheet P in cooperation with the first ejection stacker 500 placed in the first position. In a state where recording is not executed, the second ejection stacker 600 is provided so that if may pivot about the pivot shaft 601 so as to close the opening 260. In other words, the second ejection stacker 600 serves as a part of the front cover. The second ejection stacker 600 is configured so that the second ejection stacker 600 may be regulated in posture by the cover regulator 250 provided on the side of the base 220 in a state where it is opened.

A front cover detector 810 which detects a state where the second ejection stacker 600 is opened is provided in the cover regulator 250. Here, the front cover detector 810 is configured so that, if the front cover detector detects the state where the second ejection stacker 600 is opened, it may send a signal to the controller 900. The controller 900 is configured so that it may receive the signal from the home position detector 230 to be described. Moreover, the controller 900 is configured so that it can send a signal to the second motor 902 to rotate the cam shaft 302 of the platen gap adjuster 300, and it can send a signal to the first motor 901 to rotate the ejecting drive roller 20*a* and the sun gear 426.

The ejector frame 800 comprises: a pair of fourth projections 801 which are engaged with and guided by the pair of fourth grooves 224 of the base 220, a pair of fifth projections 802 which are engaged with and guided by the pair of fifth grooves 225 of the base 220, and the first ejecting follower rollers 20*b* which are circumscribed to the ejecting drive roller 20*a* on the side of the base while being biased by a spring (not shown). The ejector frame 800 is always biased to the upstream side in the sheet conveying direction by the biasing force F of a torsion coil spring (not shown) as a biasing member 805 provided in the base 220. That is, the torsion coil spring (not shown) biases the ejector frame 800 towards the position of the ejector frame 800 which takes when the first ejecting follower rollers 20*b* are circumscribed to and cooperate with the ejecting drive roller 20*a*.

One end of the connecting arm 700 has a pair of third projections 701 which are engaged with and guided by the pair of third grooves 223 of the first ejection stacker 500, and the other end of the connecting arm 700 is pivotably connected with the fourth projection 801 in the ejector frame 800 on the downstream side in the sheet conveying direction.

The first position is a so-called home position of the first ejection stacker 500, and is detected when a home position detector 230 provided in the base 220 abuts on the first ejection stacker 500. The amount of driving of the first motor 901 when the first ejection stacker 500 moves from the first position to the second position is controlled so that the first ejection stacker 500 may be separated from the home position detector 230 and may then stop with a prescribed number of steps. The amount of driving of the first motor 901 when the first ejection stacker 500 moves from the second position to the first position is controlled so that the first ejection stacker 500 may abut on the home position detector 230 and may then stop.

Also, since the third projections 701, the fourth projections 801, the fifth projections 802, the third grooves 223, the fourth grooves 224, and the fifth grooves 225, which are provided in pairs in the primary scanning direction, have the same shape and makes synchronous rotation on the right and left sides, the following description will be made about only the elements on one side, and description of the elements on the other side is omitted.

Figure 11:
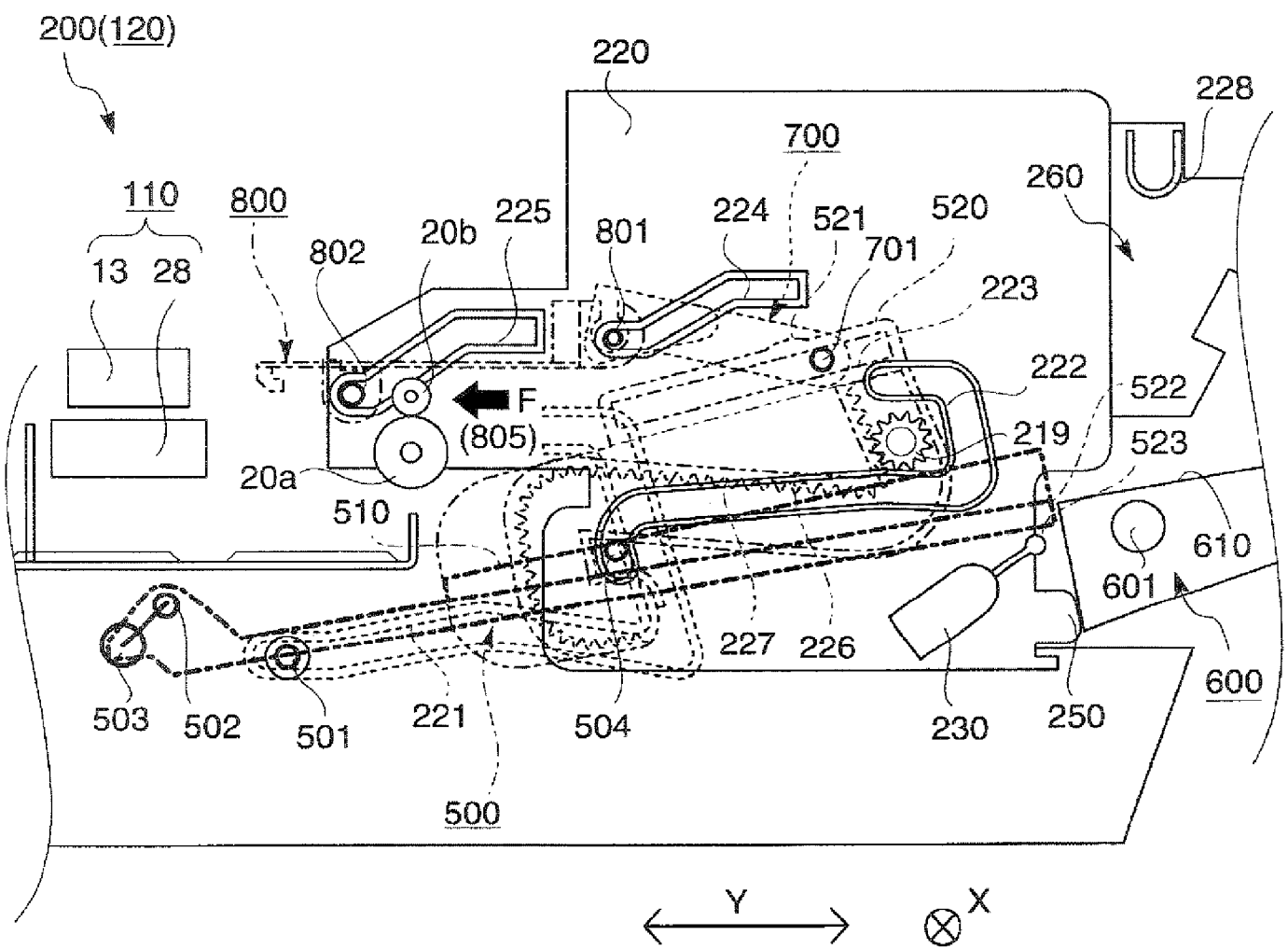
FIGS. 11 to 21 are side views showing movement of the first ejection stacker between the first position and a second position.

As shown in FIG. 11, when the pinion 219 rotates in the clockwise direction from the state shown in FIG. 10, power will be transmitted to the rack 227 of the first ejection stacker 500. At this time, since the position of the pinion 219 is fixed on the side of the base, the pinion 219 tends to advance downward in the sixth groove 226 provided with the rack 227 to move the first ejection stacker 500 upward. That is, the force that tends to move the first ejection stacker 500 upward acts on the stacker. Then, the first ejection stacker 500 is pivoted about the first projection 501 so that its downstream end in the sheet conveying direction may ascend. At this time, the second projection 504 of the first ejection stacker 500 moves slightly upward inside the second groove of the base 220.

Also, since the first ejection stacker will be separated from the home position detector 230 when the downstream end of the first ejection stacker 500 ascends, counting of the number of steps of the first motor 901 is started.

Figure 12:
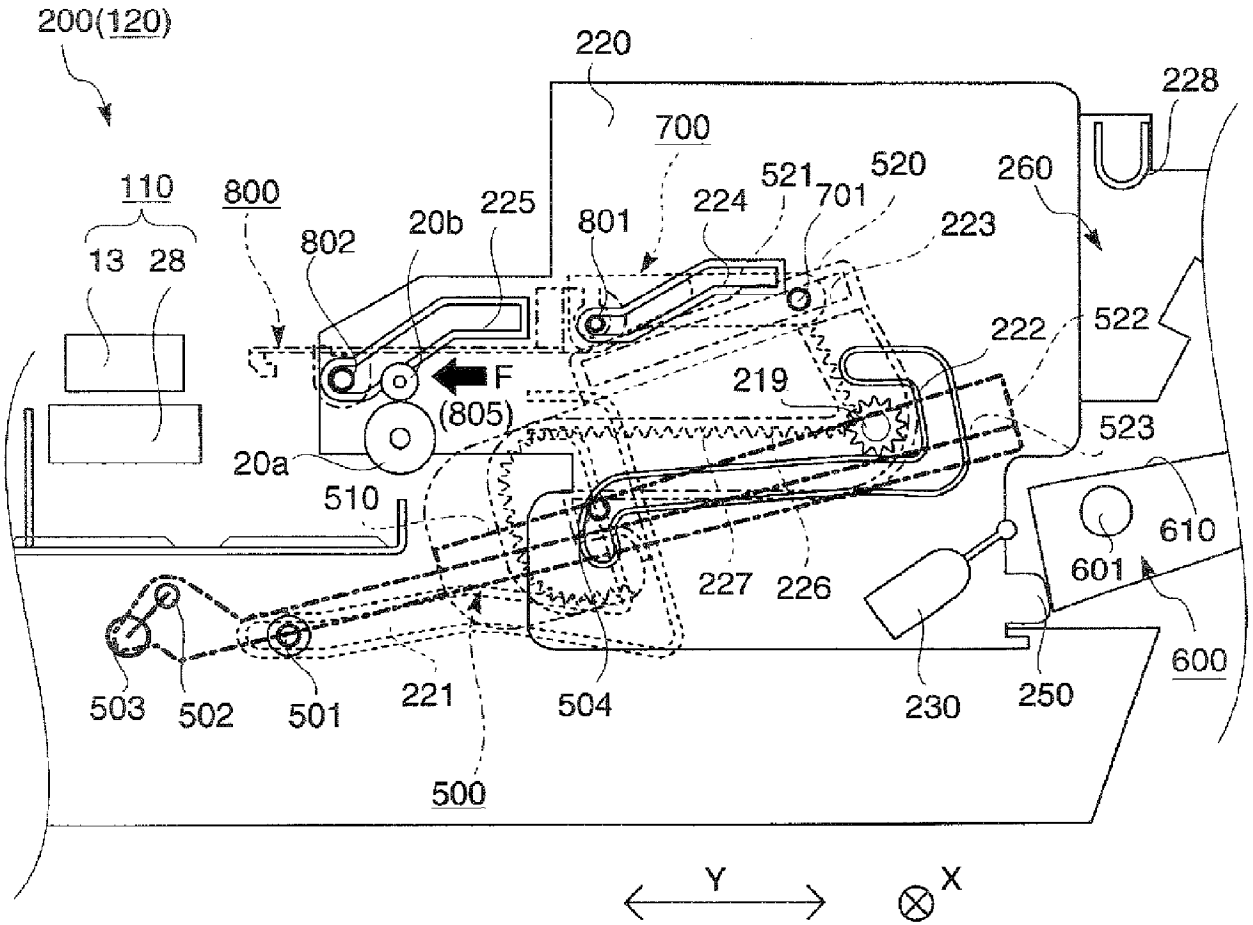

As shown in FIG. 12, when the pinion 219 further rotates in the clockwise direction from the state shown in FIG. 11, the pinion 219 tends to further move the first ejection stacker 500 upward via the rack 227. Accordingly, the first ejection stacker 500 is pivoted about the first projection 501 so that its downstream end in the sheet conveying direction may ascend further. Then, the downstream end of the first ejection stacker 500 in the sheet conveying direction is located at a higher position than the upstream end of the second ejection stacker 600 in the sheet conveying direction.

Figure 13:
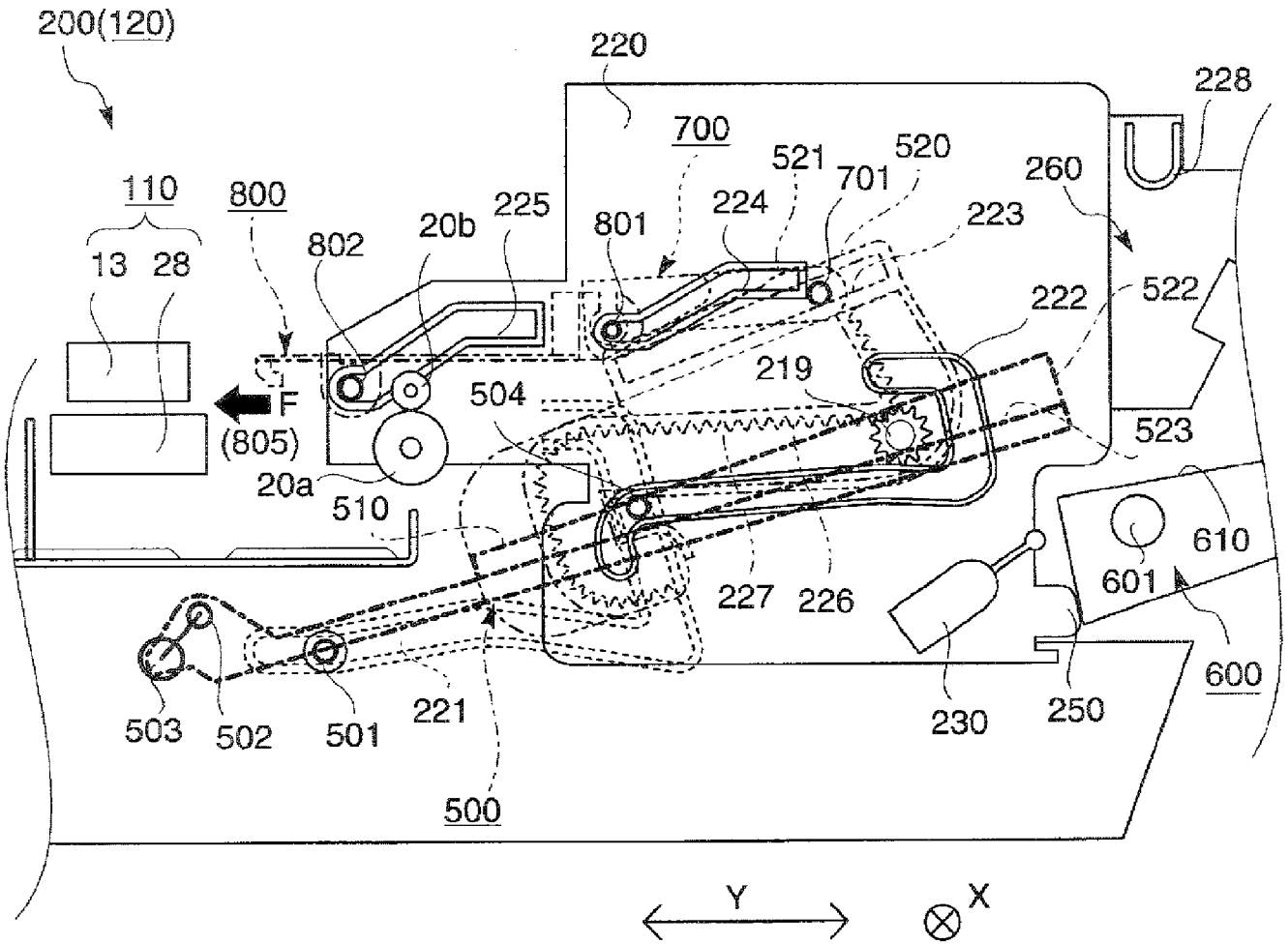

As shown in FIG. 13, when the pinion 219 further rotates in the clockwise direction from the state shown in FIG. 12, the pinion 219 tends to move to the upstream side in the sheet conveying direction along the sixth groove 226. That is, the pinion 219 tends to move the first ejection stacker 500 to the downstream side in the sheet conveying direction via the rack 227. Accordingly, the first ejection stacker 500 moves to the downstream side in the sheet conveying direction while being guided by engagement between the first projection 501 and the first groove 221, and while being guided by engagement between the second projection 504 and the second groove 222 and engagement between the pinion 219 and the rack 227. At this time, since the inclination, i.e., posture of the first ejection stacker 500 is regulated by the engagement between the first projection 501 and the first groove 221, the engagement between the second projection 504 and the second groove 222, and the engagement between the pinion 219 and the rack 227, the first ejection stacker remains in a posture where its downstream end has ascended. Accordingly, the first ejection stacker 500 is able to move to the downstream side in the sheet conveying direction so that the position of the downstream end of the first ejection stacker 500 in the sheet conveying direction may be located above the upstream end of the second ejection stacker 600.

Figure 14:
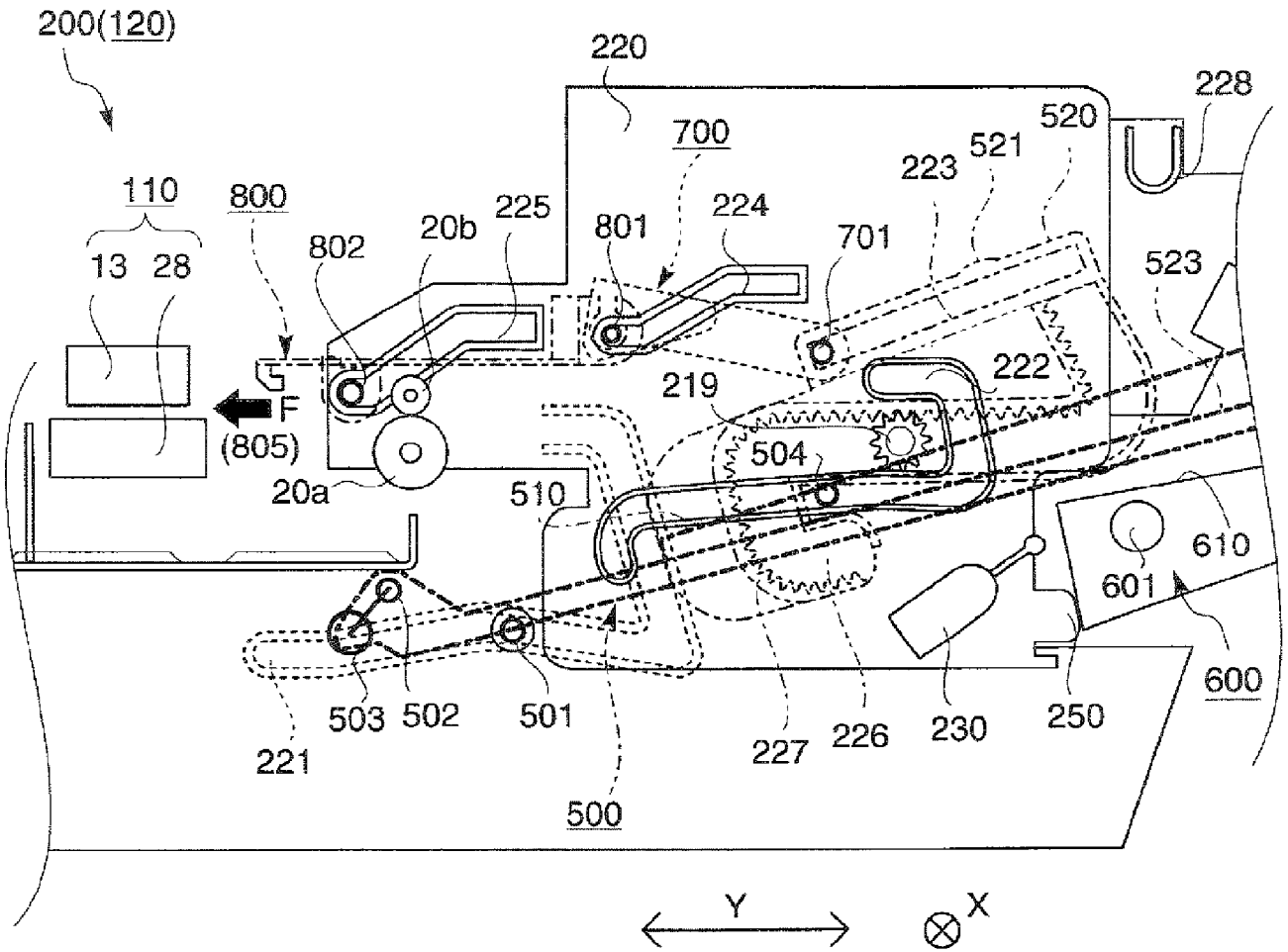

As shown in FIG. 14, when the pinion 219 further rotates in the clockwise direction from the state shown in FIG. 13, the pinion 219 tends to further move the first ejection stacker 500 to the downstream side in the sheet conveying direction via the rack 227. Accordingly, the first ejection stacker 500 further moves to the downstream side in the sheet conveying direction while being guided by the engagement between the first projection 501 and the first groove 221, and while being guided by the engagement between the second projection 504 and the second groove 222 and the engagement between the pinion 219 and the rack 227. At this time, the third projection 701 of the connecting arm 700 moves to the upstream side in the sheet conveying direction along the third groove 223 of the first ejection stacker 500, and then abuts on the upstream end of the third groove 223.

Figure 15:
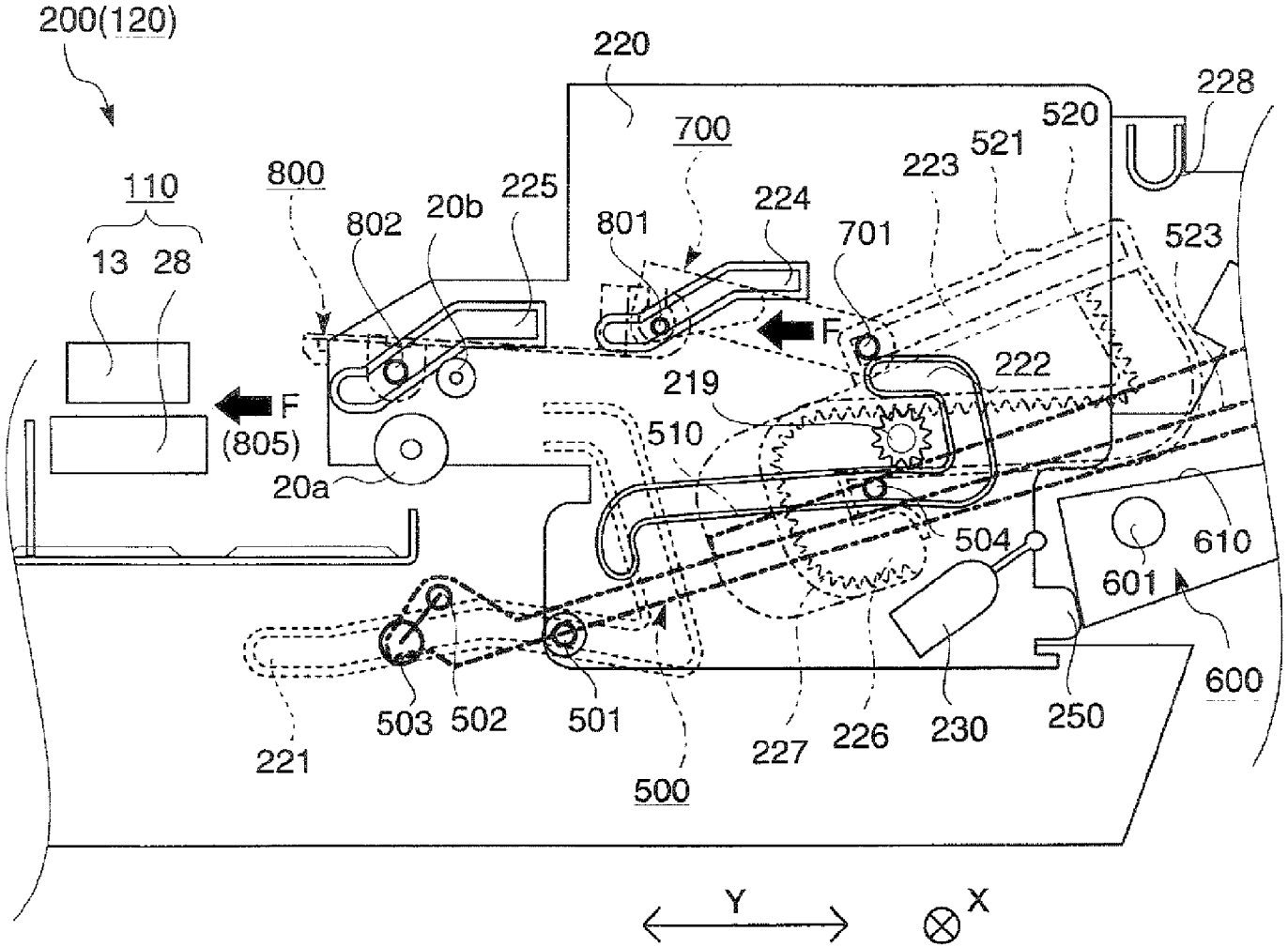

As shown in FIG. 15, when the pinion 219 rotates in the clockwise direction from the state shown in FIG. 14, the first ejection stacker 500 will further move to the downstream side in the sheet conveying direction. At this time, since the third projection 701 of the connecting arm 700 abuts on the upstream end of the third groove 223 of the first ejection stacker 500 in the sheet conveying direction, the first ejection stacker 500 moves the ejector frame 800 to the downstream side in the sheet conveying direction via the connecting arm 700 against the aforementioned biasing force F of the torsion coil spring.

At this time, the ejector frame 800 is guided by the engagement between the fourth projection 801 and the fourth groove 224 and the engagement between the fifth projection 802 and the fifth groove 225, and moves upward to the downstream side in the sheet conveying direction. The first ejecting follower rollers 20*b* which are provided in the ejector frame 800 are separated from the ejecting drive roller 20*a*, with movement of the ejector frame 800.

In addition, with the movement of the ejector frame 800, the auxiliary ejecting follower rollers 22 (refer to FIG. 3) also move in the same direction as the first ejecting follower rollers 20*b*.

Moreover, a force that the third projection 701 of the connecting arm 700 tends to pull the upstream end of the third groove 223 of the first ejection stacker 500 to the upstream side is generated by the biasing force F of the aforementioned torsion coil spring. Accordingly, the force that tends to pivot the first ejection stacker in the counterclockwise direction about a portion of the rack 227 meshing with the pinion 219 is generated in the first ejection stacker 500 as a pivot center. The first projection 501 and the second projection 504 located opposite to the third projection 701 with respect to the pivot center are pressed against the bottom faces of the first groove 221 and the second groove 222, respectively by the force that tends to rotate the first ejection stacker in the counterclockwise direction. Accordingly, the posture of the first ejection stacker 500 can be further stabilized during its movement.

Figure 16:
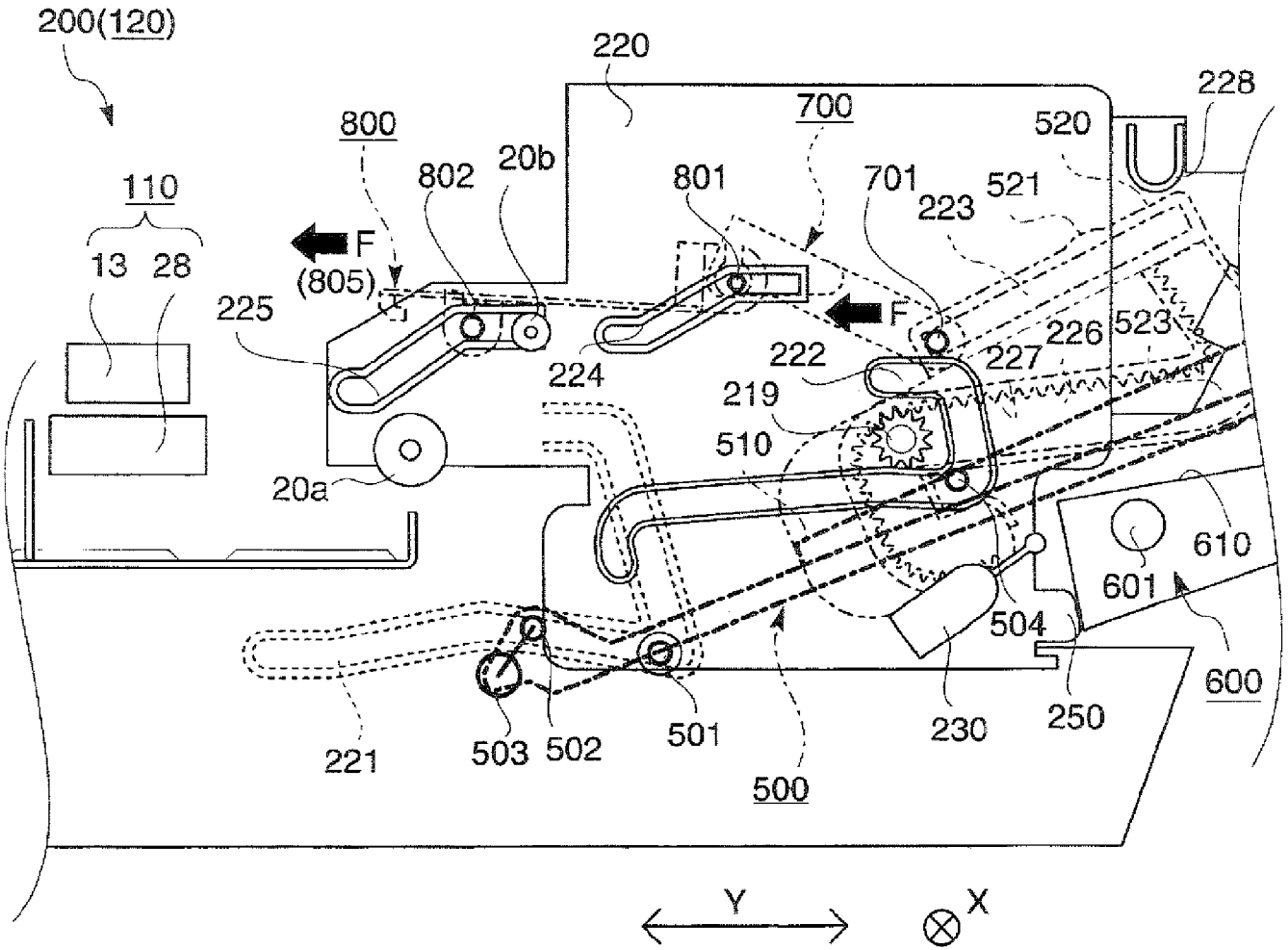

As shown in FIG. 16, when the pinion 219 further rotates in the clockwise direction from the state shown in FIG. 15, the first ejection stacker 500 will further move to the downstream side in the sheet conveying direction. Also, while the first ejection stacker 500 moves to the downstream side in the sheet conveying direction, the first ejection stacker 500 further moves the ejector frame 800 to the downstream side in the sheet conveying direction via the connecting arm 700 against the aforementioned biasing force F of the torsion coil spring.

Figure 17:
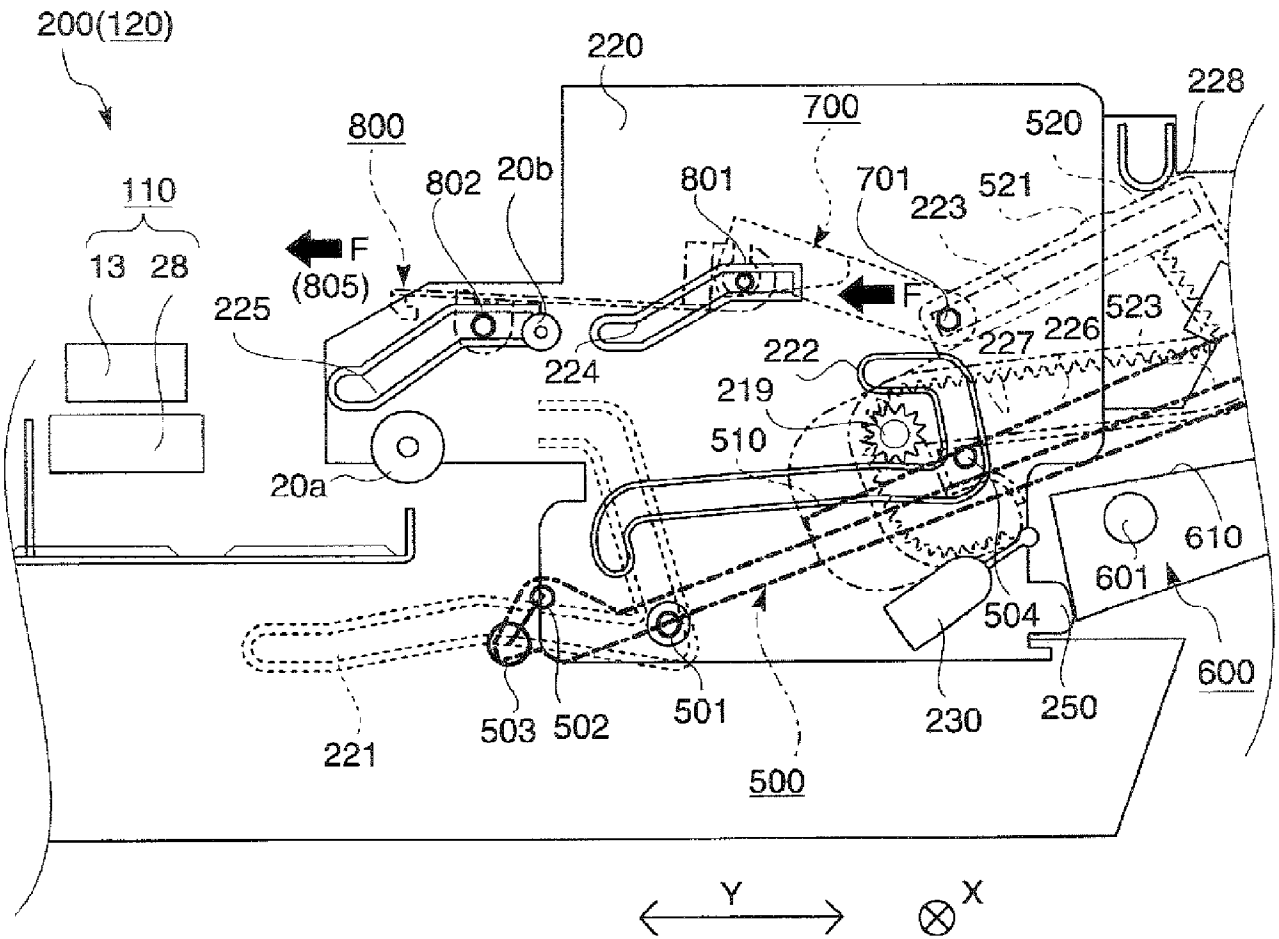

As shown in FIG. 17, when the pinion 219 further rotates in the clockwise direction from the state shown in FIG. 16, the pinion 219 tends to move downward along the sixth groove 226. That is, the pinion 219 tends to move the first ejection stacker 500 upward via the rack 227. At this time, the force that tends to pivot the first ejection stacker 500 in the counterclockwise direction about a portion of the rack 227 meshing with the pinion 219 is generated in the first ejection stacker 500 by the aforementioned biasing force F of the torsion coil spring. Accordingly, when the pinion 219 rotates in the clockwise direction, the first ejection stacker 500 is pivoted about the first projection 501 so that the downstream end of the first ejection stacker 500 may ascend further. Then, the contact face 520 provided above a downstream portion of the first ejection stacker 500 in the sheet conveying direction abuts on the posture regulator 228 of the base 220.

In a state where the contact face 520 abuts on the posture regulator 228, a portion where the third projection 701 and the third groove 223 abut on each other, i.e., a portion on which the aforementioned biasing force F of the torsion coil spring acts is located between the portion of the rack 227 meshing with the pinion 219 and a portion of the contact face 520 abutting on the posture regulator 228. Accordingly, the posture regulator 228 is able to abut on the contact face 520 to prevent the first ejection stacker 500 from pivoting in the counterclockwise direction about the portion of the rack 227 meshing with the pinion 219 by the aforementioned biasing force F of the torsion coil spring.

When the pinion 219 further rotates in the clockwise direction, the downstream portion of the first ejection stacker 500 in the sheet conveying direction is regulated in upward movement by the posture regulator 228. Thus, the first ejection stacker 500 will move so that its upstream portion may be raised upward with its downstream portion in the sheet conveying direction as a fulcrum. At this time, simultaneously when the contact face 520 abuts on the posture regulator 228, pivot motion of the first ejection stacker 500 in the counterclockwise direction about the portion of the rack 227 meshing with the pinion 219 is regulated. Thus, the first projection 501 and the second projection 504 are released from the state where they press the bottom faces of the first groove 221 and the second groove 222, respectively. Accordingly, the pinion 219 rotates in the clockwise direction, and the first projection 501 and the second projection 504 move upward along the first groove 221 and the second groove 222, respectively.

The ejector frame 800 moves to the downstream side in the sheet conveying direction with the movement of the first ejection stacker 500.

Figure 18:
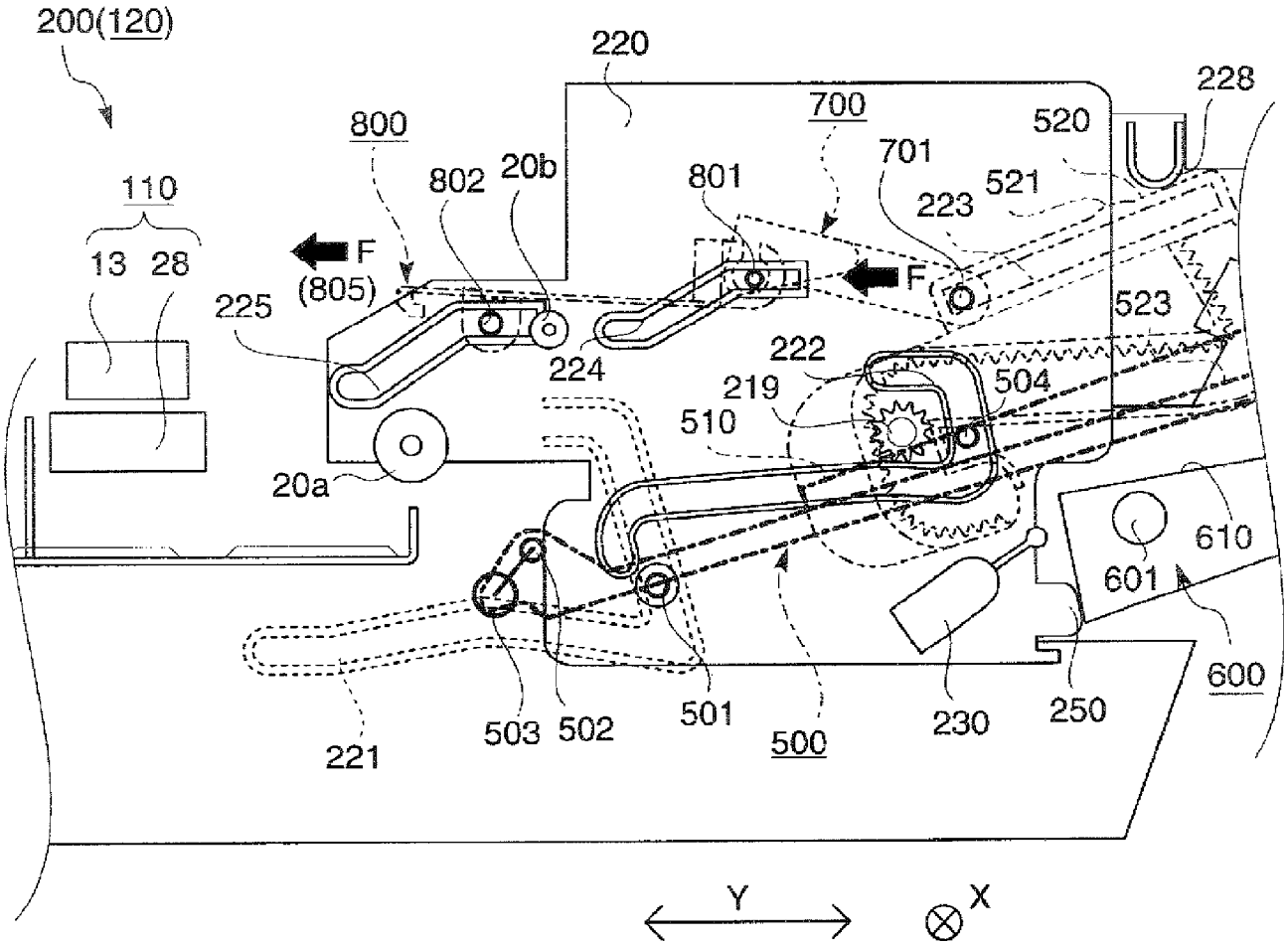

As shown in FIG. 18, when the pinion 219 further rotates in the clockwise direction from the state shown in FIG. 17, the pinion 219 tends to further move the first ejection stacker 500 upward via the rack 227. Accordingly, the first ejection stacker 500 is pivoted about its downstream portion in the sheet conveying direction so that its upstream end in the sheet conveying direction may ascend further. That is, the inclination of the tray guiding face 523 of the first ejection stacker 500 with respect to the sheet conveying direction (Y) moves so that it may become small. At this time, the second projection 604 and the second groove 222 are provided so that the second projection 504 may always be located opposite to the rack 227 with respect to the pinion 219 while the aforementioned biasing force F of the torsion coil spring acts on the first ejection stacker 500 in order to prevent the rack 227 from being separated from the pinion 219 by the aforementioned biasing force F of the torsion coil spring.

The ejector frame 800 moves to the downstream side in the sheet conveying direction with the movement of the first ejection stacker 500.

Figure 19:
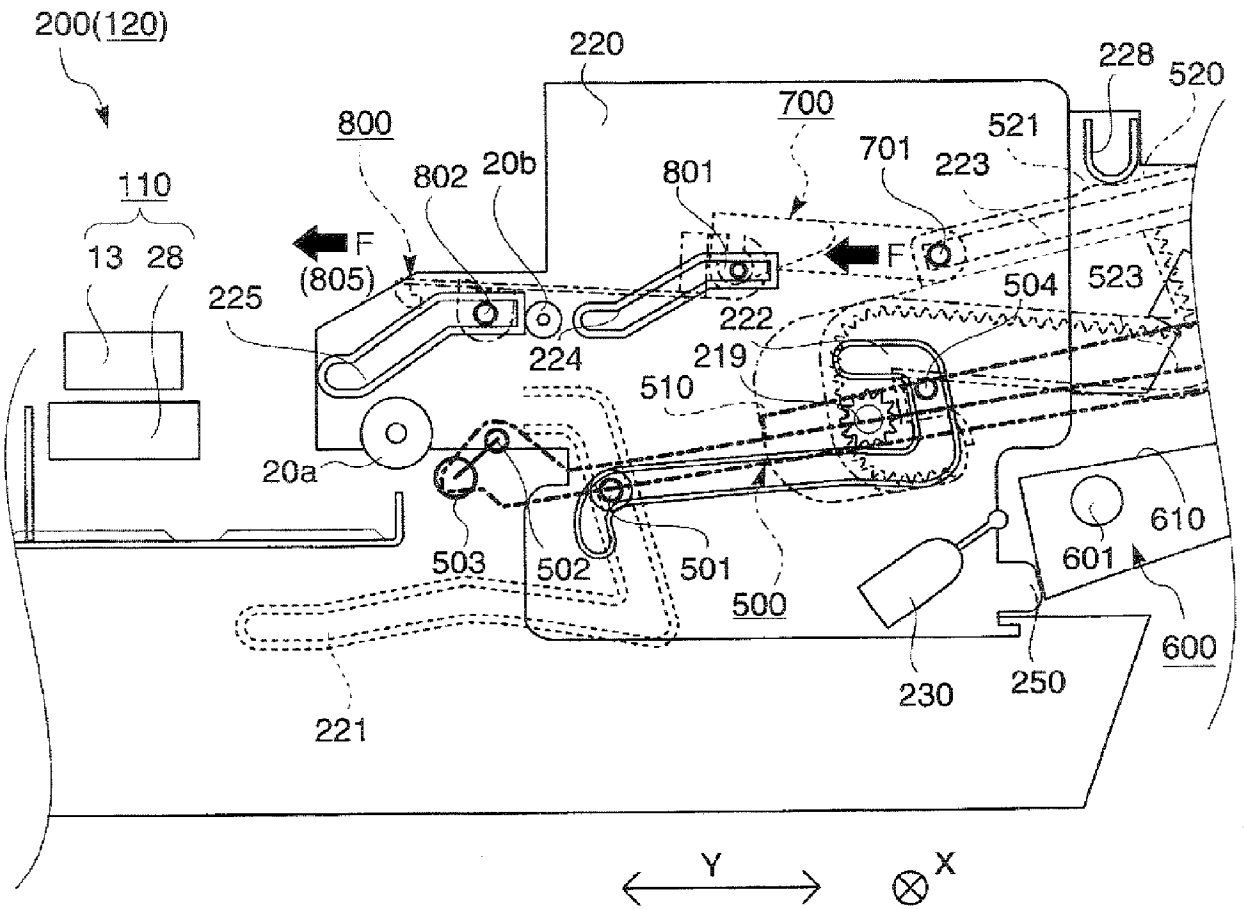

As shown in FIG. 19, when the pinion 219 further rotates in the clockwise direction from the state shown in FIG. 18, the first ejection stacker 500 pivots about its downstream portion in the sheet conveying direction as a fulcrum so that its upstream end in the sheet conveying direction may ascend further. At this time, the posture regulator 228 of the base 220 abuts on the projection 521 provided on the contact face 520 of the first ejection stacker 500. When the first ejection stacker 500 is moved to make the posture of the tray guiding face 623 of the first ejection stacker 500 parallel to the sheet conveying direction (Y), the projection 521 is provided so that the posture regulator 228 and the first ejection stacker 500 can always contact each other.

The ejector frame 800 moves to the downstream side in the sheet conveying direction with the movement of the first ejection stacker 500.

Figure 20:
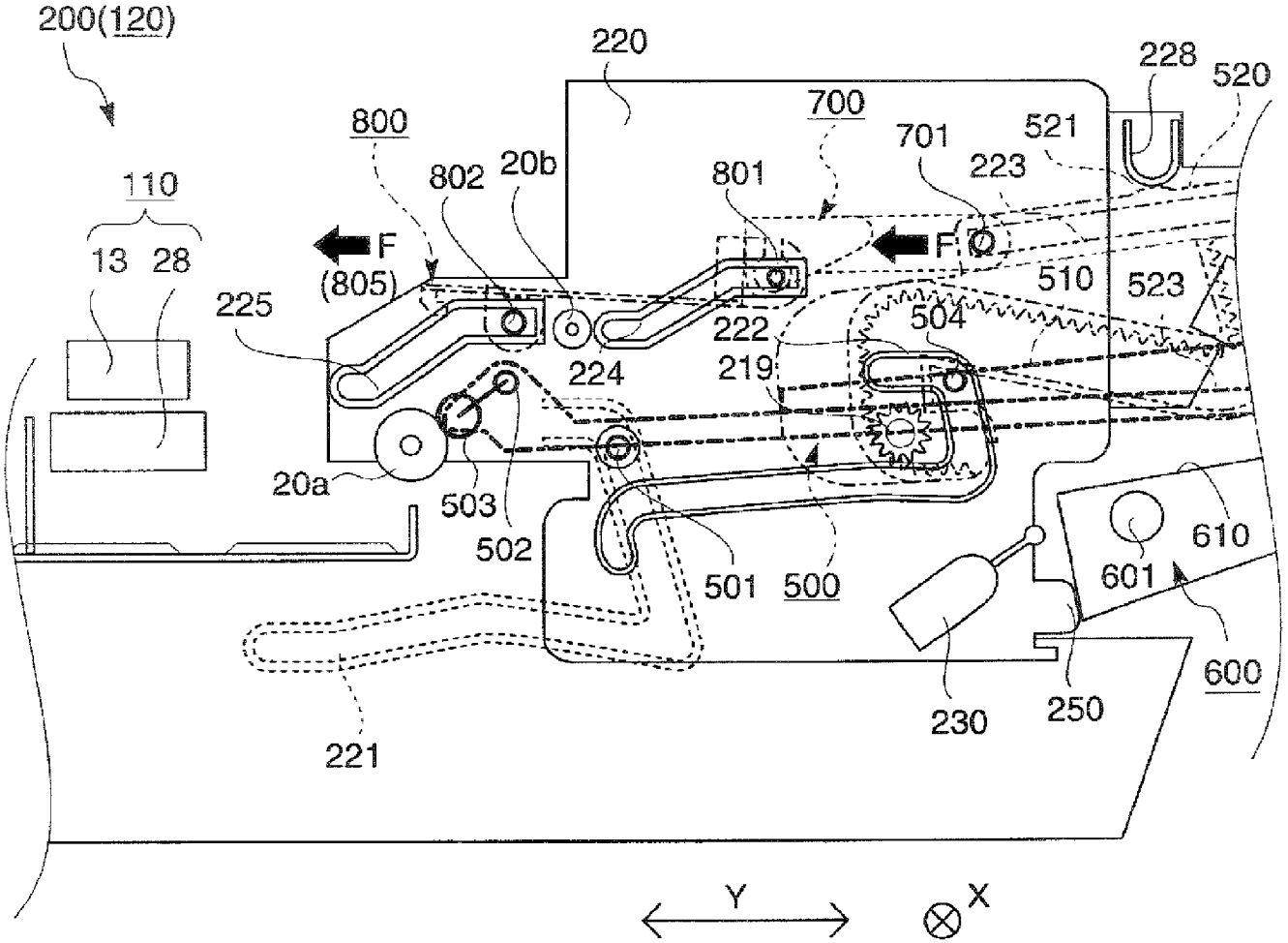

As shown in FIG. 20, when the pinion 219 further rotates in the clockwise direction from the state shown in FIG. 19, the first ejection stacker 500 pivots about its downstream portion in the sheet conveying direction so that its upstream end in the sheet conveying direction may ascend further. At this time, the second ejecting follower rollers 503 provided upstream of the first ejection stacker 500 in the sheet conveying direction move to a position in the vicinity of the downstream side of the ejecting drive roller 20*a* in the sheet conveying direction.

The ejector frame 800 moves to the downstream side in the sheet conveying direction with the movement of the first ejection stacker 500.

Figure 21:
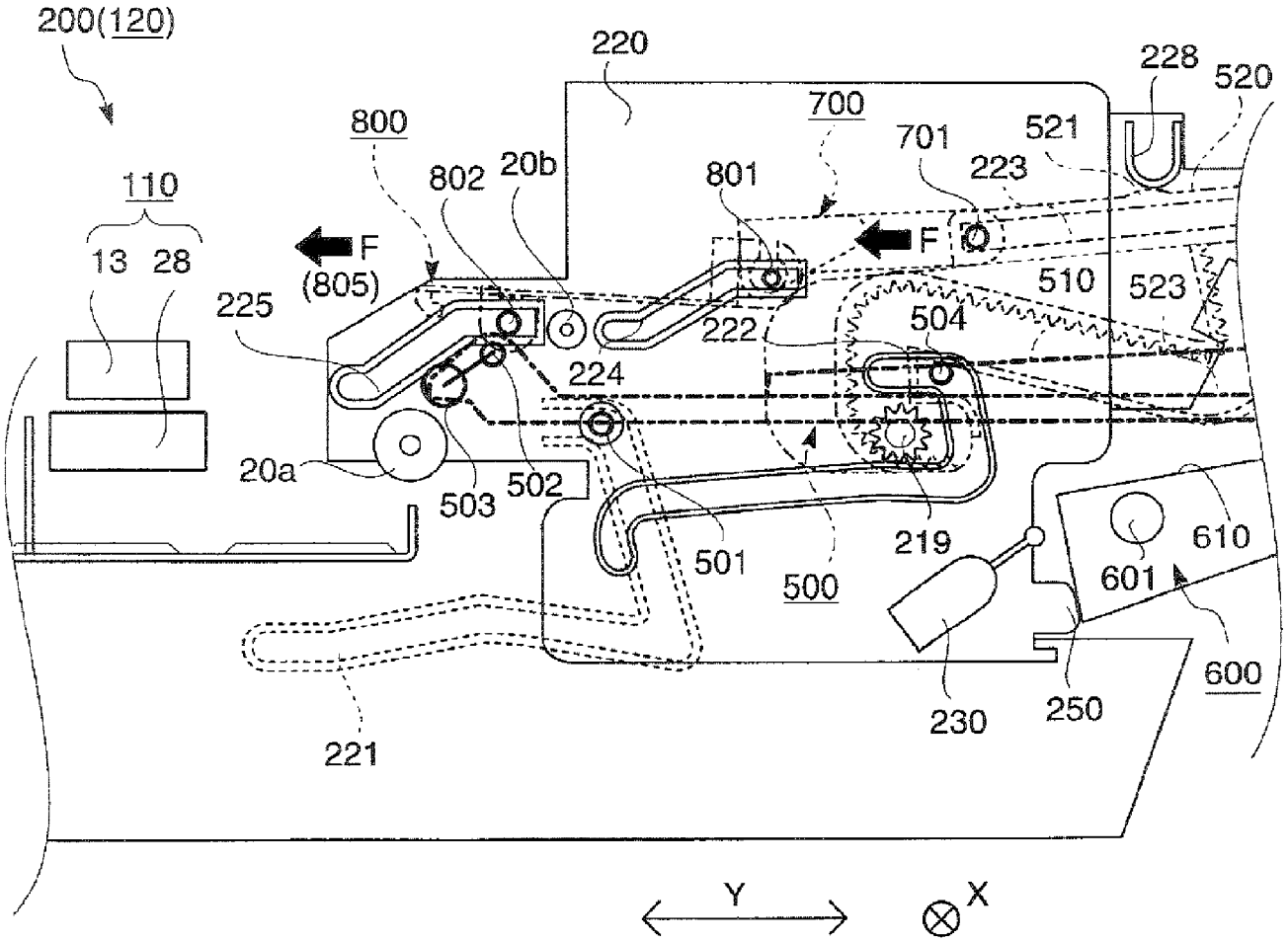
Figure 22:
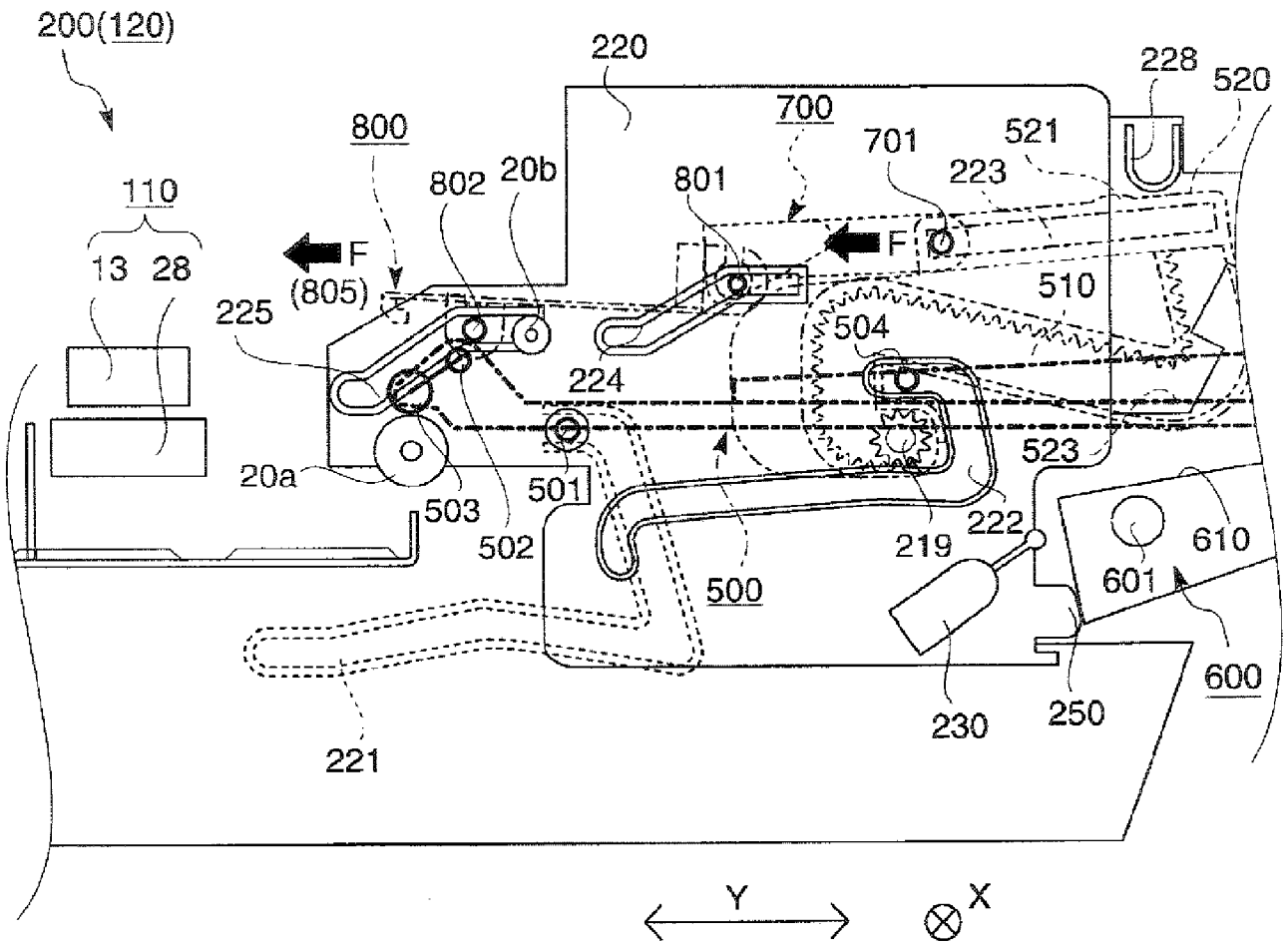
FIG. 22 is a side view showing a state that the first ejection stacker is placed in the second position.

As shown in FIG. 21, when the pinion 219 further rotates in the clockwise direction from the state shown in FIG. 20, the first ejection stacker 500 pivots about its downstream portion in the sheet conveying direction so that its upstream end in the sheet conveying direction may ascend further. At this time, the second ejecting follower rollers 503 provided upstream of the first ejection stacker 500 in the sheet conveying direction move to a position which is higher than the ejecting drive roller 20*a*, and a position where the bottoms of the second ejecting follower rollers 503 is located at almost the same height as the top of the ejecting drive roller 20*a*. At this time, the inclination, i.e., posture, of the first ejection stacker 500 is a posture in which the tray guiding face 523 of the first ejection stacker 500 becomes parallel to the sheet conveying direction (Y).

Here, the term "parallel" means that the tray guiding face is substantially parallel to the primary scanning direction X and the sheet conveying direction (Y) to such a degree that the disk tray Q can be guided to the recording section 110, and the disk tray Q having been subjected to the recording can be received. With the movement of the first ejection stacker 500, the ejector frame 800 receives the aforementioned biasing force F of the torsion coil spring, and then moves to the upstream side in the sheet conveying direction.

As shown in FIG. 22, when the pinion 219 further rotates in the clockwise direction from the state shown in FIG. 21, the pinion 219 tends to move to the downstream side in the sheet conveying direction along the sixth groove 226. That is, the pinion 219 tends to move the first ejection stacker 500 to the upstream side in the sheet conveying direction in cooperation with the aforementioned biasing force F of the torsion coil spring via the rack 227. Accordingly, the first ejection stacker 500 moves to the upstream side in the sheet conveying direction while being guided by engagement between the first projection 501 and the first groove 221, and while being guided by engagement between the second projection 504 and the second groove 222. That is, the posture of the first ejection stacker 500 is regulated by the engagement between the first projection 501 and the first groove 221 and the engagement between the second projection 504 and the second groove 222. Accordingly, the first ejection stacker moves in parallel to the upstream side in the sheet conveying direction with the posture in which the tray guiding face 523 becomes parallel to the sheet conveying direction (Y).

With the movement of the first ejection stacker 500, the ejector frame 800 receives the aforementioned biasing force F of the torsion coil spring, and then moves to the upstream side in the sheet conveying direction.

Here, since the first ejection stacker 500 has already taken a desired posture, the projection 521 of the first ejection stacker 500 is separated from the posture regulator 228 of the base 220. That is, when the first ejection stacker 500 moves in parallel, the posture regulator 228 does not act on the first ejection stacker 500 at all. Accordingly, there is no possibility that the posture of the first ejection stacker 500 may become unstable due to occurrence of frictional resistance between the first ejection stacker and the posture regulator 228.

Although the force that tends to pivot the first ejection stacker 500 in the counterclockwise direction about the portion of the rack 227 meshing with the pinion 219 by the aforementioned biasing force F of the torsion coil spring is generated in the first ejection stacker 500, the first projection 501 of the first ejection stacker 500 is pressed against the bottom of the first groove 221 of the base 220. Thus, the first ejection stacker 500 can maintain its posture with high precision.

The first ejection stacker 500 stops with stopping of the pinion 219 in a position where the bottoms of the second ejecting follower rollers 503 of the first ejection stacker 500 abut on the top of the ejecting drive roller 20*a*. The stop position of the first ejection stacker 500 shown in FIG. 22 is the second position where the first ejection stacker 500 takes during the disk recording mode. At this time, the second ejecting follower rollers 503 are biased so that it may be pivoted towards the ejecting drive roller 20*a* by the biasing force of a spring (not shown). Accordingly, in the disk recording mode, the second ejecting follower rollers 503 can nip the disk tray Q in cooperation with the ejecting drive roller 20*a*, and move the disk tray Q to the upstream side and downstream in the sheet conveying direction.

In addition, as for the timing with which the pinion 219 stops, the pinion is stopped after the first ejection stacker 500 has been separated from the home position detector 230 as mentioned above, and then the first motor 901 is driven by a prescribed number of steps in a direction in which the ejecting drive roller 20*a* rotates reversely. Accordingly, the second position of the first ejection stacker 500 can be determined with high precision.

As described above, the stacker position changer 200 can move the first ejection stacker 500 without abutting on the second ejection stacker 600 so that the downstream portion of the first ejection stacker 500 may first be pulled upward and to the downstream side, and then the upstream portion of the first ejection stacker 500 may be pulled upward. That is, when the first ejection stacker moves from the first position to the second position, the stacker position changer 200 can move the first ejection stacker 500, even if spaces above the first supporting face 510 of the first ejection stacker 500 and above the second supporting face 610 of the second ejection stacker 600 are restricted by the bar guide 431, for example.

When switching from the disk recording mode to the sheet recording mode is made, the state shown in FIG. 7 where power transmission is cut off by the power transmission switcher 400 as mentioned above is changed to a state shown in FIG. 9 where power transmission is effected. At this time, the ejecting drive roller 20*a* is driven normally, that is, the sun gear 426 rotates in the clockwise direction. The power of the sun gear 426 is transmitted to the pinion 219 by the power transmitter 210. Accordingly, the pinion 219 rotates in the counterclockwise direction.

When the pinion 219 rotates in the counterclockwise direction from the state shown in FIG. 22, the pinion 219 tends to move to the upstream side in the sheet conveying direction along the sixth groove 226. That is, the pinion 219 tends to move the first ejection stacker 500 to the downstream side in the sheet conveying direction against the aforementioned biasing force F of the torsion coil spring via the rack 227. Accordingly, the first ejection stacker 500 moves to the downstream side in the sheet conveying direction while being guided by engagement between the first projection 501 and the first groove 221, and while being guided by engagement between the second projection 504 and the second groove 222 and engagement between the pinion 219 and the rack 227. Accordingly, the first ejection stacker 500 moves in parallel to the downstream side in the sheet conveying direction with the posture in which the tray guiding face 523 becomes parallel to the sheet conveying direction (Y).

The ejector frame 800 moves to the downstream side in the sheet conveying direction with the movement of the first ejection stacker 500.

As shown in FIG. 21, when the pinion 219 rotates in the counterclockwise direction from the state shown in FIG. 22, the first ejection stacker 500 will move to the downstream side in the sheet conveying direction against the aforementioned biasing force F of the torsion coil spring. At this time, the second ejecting follower rollers 503 of the first ejection stacker 600 are separated from the ejecting drive roller 20*a*. The projection 521 of the first ejection stacker 500 abuts on the separated posture regulator 228 of the base 220. Then, the first projection 501 of the first ejection stacker 500 is separated from the bottom face of the first groove 221 by the shape of the first groove 221. Accordingly, the force that tends to pivot the first ejection stacker 500 in the counterclockwise direction about the portion of the rack 227 meshing with the pinion 219 is generated in the first ejection stacker 500 by the aforementioned biasing force F of the torsion coil spring. At this time, the posture of the first ejection stacker 500 is regulated by the posture regulator 228 abutting an the abutting portion 521.

As shown in FIG. 20, when the pinion 219 further rotates in the counterclockwise direction from the state shown in FIG. 21, the first ejection stacker 500 pivots about its downstream portion in the sheet conveying direction so that its upstream end in the sheet conveying direction may descend. At this time, the second ejecting follower rollers 503 provided upstream of the first ejection stacker 500 in the sheet conveying direction move to a position in the vicinity of the downstream side of the ejecting drive roller 20*a* in the sheet conveying direction on the side of the base.

The ejector frame 800 moves to the upstream side in the sheet conveying direction with the movement of the first ejection stacker 500.

As shown in FIG. 19, when the pinion 219 further rotates in the counterclockwise direction from the state shown in FIG. 20, the first ejection stacker 500 pivots about its downstream portion in the sheet conveying direction so that its upstream end in the sheet conveying direction may descend further. At this time, the position of the second ejecting follower rollers 503 of the first ejection stacker 500 becomes lower than the position of the ejecting drive roller 20*a*.

The ejector frame 800 moves to the upstream side in the sheet conveying direction with the movement of the first ejection stacker 500.

As shown in FIG. 18, when the pinion 219 further rotates in the counterclockwise direction from the state shown in FIG. 19, the first ejection stacker 500 pivots about its downstream portion in the sheet conveying direction so that its upstream end in the sheet conveying direction may descend further. At this time, the posture regulator 228 of the base 220 is separated from the projection 521 of the first ejection stacker 500, and abuts on the contact face 520, thereby regulating the posture of the first ejection stacker 500.

The ejector frame 800 moves to the upstream side in the sheet conveying direction with the movement of the first ejection stacker 500.

As shown in FIG. 17, when the pinion 219 further rotates in the counterclockwise direction from the state shown in FIG. 18, the first ejection stacker 500 pivots about its downstream portion in the sheet conveying direction so that its upstream end in the sheet conveying direction may descend further. The ejector frame 800 moves to the upstream side in the sheet conveying direction with the movement of the first ejection stacker 500.

As shown in FIG. 16, when the pinion 219 further rotates in the counterclockwise direction from the state shown in FIG. 17, the first ejection stacker 500 pivots about its downstream portion in the sheet conveying direction so that its upstream end in the sheet conveying direction may descend further. At this time, the first projection 501 of the first ejection stacker 500 on the upstream side in the sheet conveying direction abuts on the bottom face of the first groove 221 of the base 220. Then, with the rotation of the pinion 219, the first ejection stacker 500 pivots in the clockwise direction about an abutting portion between the first projection 501 and the first groove 221 against the force that tends to rotate the first ejection stacker 500 in the counterclockwise direction by the aforementioned biasing force F of the torsion coil spring, and moves so that the downstream portion of the first ejection stacker 500 may descend.

Accordingly, the contact face 520 of the first ejection stacker 500 is separated from the posture regulator 28 of the base 220. At this time, the posture of the first ejection stacker 500 is regulated when the first projection 501 abuts on the bottom face of the first groove 221 of the base 220 by the aforementioned force that tends to pivot the first ejection stacker 500 in the counterclockwise direction.

The ejector frame 800 moves to the upstream side in the sheet conveying direction with the movement of the first ejection stacker 500.

As shown in FIG. 15, when the pinion 219 further rotates in the counterclockwise direction from the state shown in FIG. 16, the pinion 219 tends to move to the downstream side in the sheet conveying direction along the sixth groove 226. That is, the pinion 219 tends to move the first ejection stacker 500 to the upstream side in the sheet conveying direction in cooperation with the aforementioned biasing force F of the torsion coil spring via the rack 227. Accordingly, the first ejection stacker 500 moves to the upstream side in the sheet conveying direction while being guided by engagement between the first projection 501 and the first groove 221, and while being guided by engagement between the second projection 504 and the second groove 222 and engagement between the pinion 219 and the rack 227. At this time, the posture of the first ejection stacker 500 is regulated by the engagement between the first projection 501 and the first groove 221, the engagement between the second projection 504 and the second groove 222, and the engagement between the pinion 219 and the rack 227. That is, the first ejection stacker 500 moves in parallel to the upstream side with the posture in which its upstream portion in the sheet conveying direction descends and its downstream portion ascends.

With the movement of the first ejection stacker 500, the ejector frame 800 is guided by the engagement between the fourth projection 801 and the fourth groove 224 and the engagement between the fifth projection 802 and the fifth groove 225, and moves downward to the upstream side in the sheet conveying direction.

As shown in FIG. 14, when the pinion 219 further rotates in the counterclockwise direction from the state shown in FIG. 15, the first ejection stacker 500 moves in parallel to the upstream side in the sheet conveying direction with the posture in which its upstream portion in the sheet conveying direction descends and its downstream portion ascends, while being guided by engagement between the first projection 501 and the first groove 221, and while being guided by engagement between the second projection 504 and the second groove 222 and by engagement between the pinion 219 and the rack 227.

With the movement of the first ejection stacker 500, the ejector frame 800 moves, and the bottoms of the first ejecting follower rollers 20*b* of the ejector frame 800 abut on the top of the ejecting drive roller 20*a*. At this time, the fourth projection 801 and the fifth projection 802 of the ejector frame 800 abut on the upstream ends of the fourth groove 224 and the fifth groove 225 of the base 220 in the sheet conveying direction, respectively, and thereby the ejector frame 800 stops.

Also, since the fourth projection 32 and the fifth projection 802 of the ejector frame 800 abut on the upstream ends of the fourth groove 224 and the fifth groove 225 of the base 220 in the sheet conveying direction, respectively, the aforementioned biasing force F of the torsion coil spring does not reach the first ejection stacker 500.

As shown in FIG. 13, when the pinion 219 rotates in the counterclockwise direction from the state shown in FIG. 14, the first ejection stacker 500 will move in parallel to the upstream side in the sheet conveying direction. At this time, the ejector frame 800 is held in a stopped state by the aforementioned biasing force F of the torsion coil spring. Accordingly, the third projection 701 of the connecting arm 700 is separated from the upstream end of the third groove 223 of the first ejection stacker 500 in the sheet conveying direction, and then moves to the downstream side.

Here, the first ejection stacker 500 is provided to move in parallel to the upstream side in the sheet conveying direction so that the position of the downstream end of the first ejection stacker 500 in the sheet conveying direction may be located upstream of the upstream end of the second ejection stacker 600.

As shown in FIG. 12, when the pinion 219 further rotates in the counterclockwise direction from the state shown in FIG. 13, the pinion 219 tends to move upward along the sixth groove 226. That is, the pinion 219 tends to move the first ejection stacker 500 downward via the rack 227. Accordingly, the first ejection stacker 500 pivots in the clockwise direction about the first projection 501 so that its downstream end in the sheet conveying direction may descend so as to reduce a height difference between the upstream and downstream ends thereof.

As shown in FIG. 11, when the pinion 219 further rotates in the counterclockwise direction from the state shown in FIG. 12, the first ejection stacker 500 pivots in the clockwise direction about the first projection 501 so that its downstream end in the sheet conveying direction may descend so as to reduce a height difference between the upstream and downstream ends thereof.

As shown in FIG. 10, when the pinion 219 further rotates in the counterclockwise direction from the state shown in FIG. 11, the first ejection stacker 500 pivots in the clockwise direction about the first projection 501 so that its downstream end in the sheet conveying direction may descend so as to further reduce a height difference between the upstream and downstream ends thereof. At this time, the first ejection stacker 500 abuts on the home position detector 230. Then, the home position detector 230 detects the first ejection stacker 500 to stop driving of the first motor 901 to stop the rotation of the pinion 219. Accordingly, the first ejection stacker 500 can be positioned in the first position with precision.

As described above, the stacker position changer 200 can move the first ejection stacker 500 without abutting on the second ejection stacker 600 so that the upstream portion of the first ejection stacker 500 may first be pushed downward and to the upstream side, and then the downstream portion of the first ejection stacker 500 may be pushed downward. That is, when the first ejection stacker moves from the second position to the first position, the stacker position changer 200 can move the first ejection stacker 500, even if spaces above the first supporting face 510 of the first ejection stacker 500 and above the second supporting face 610 of the second ejection stacker 600 are restricted by the bar guide 431, for example.

Also, when the first ejection stacker 500 moves from the second position to the first position, the ejecting drive roller 20*a* is normally driven. The term "normal driving" means the rotation in the clockwise direction in FIGS. 10 to 22. Accordingly, even in a state where the disk tray Q is nipped by the ejecting drive roller 20*a* and the second ejecting follower rollers 503, i.e., even in a case where the disk tray Q has not been normally ejected after recording, the ejecting drive roller 20*a* and the second ejecting follower rollers 503 can move the disk tray Q to the downstream side in the sheet conveying direction in cooperation with each other. Then, the disk tray Q will be in a state where it is not nipped by the ejecting drive roller 20*a* and the second ejecting follower rollers 503. As a result, since the first ejection stacker 500 moves to the first position in a state where the disk tray Q is nipped by the ejecting drive roller 20*a* and the second ejecting follower rollers 503, there is no possibility that the disk tray Q may be damaged. Moreover, there is no possibility that the disk tray Q is accidentally caught between the ejecting drive roller 20*a* and the second ejecting follower rollers 503 when the first ejection stacker 500 moves from the second position to the first position. This is advantageous when a user has left the disk tray Q in the tray guide opening 522 of the first ejection stacker 500.

Moreover, since only the first ejection stacker 500 instead of the whole ejection stacker 50 is moved, the weight of a member to be moved is light as compared with a case where the whole ejection stacker 50 is moved. Thus, a power source can be downsized accordingly.

Figure 23:
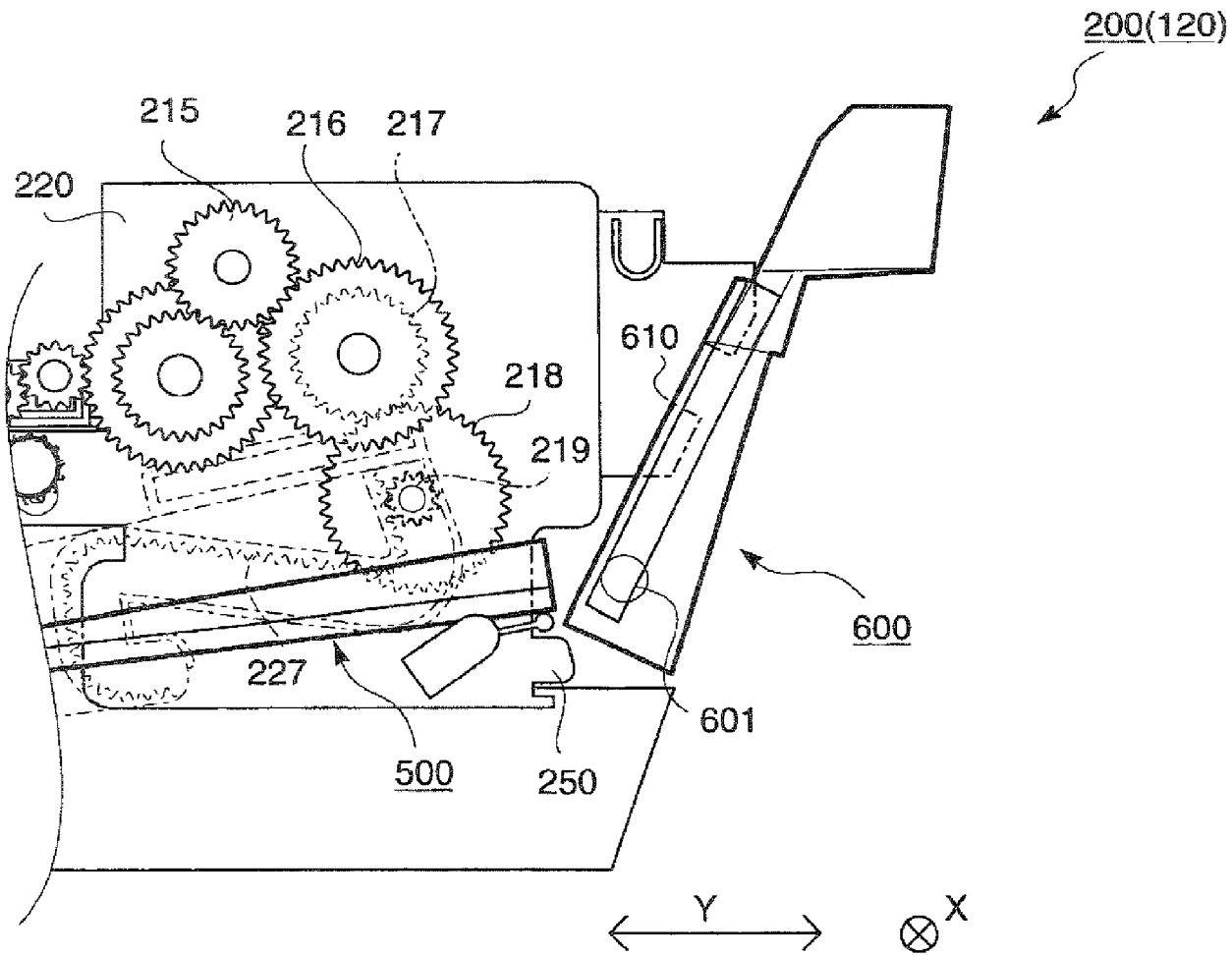
FIGS. 23 to 25 are side views showing movement of a second ejection stacker between a closed position and an opened position.

As shown in FIG. 23, when a power source is deactivated, the first ejection stacker 500 is located in the first position, and the second ejection stacker 600 is in a state closing the opening 260. The second ejection stacker 600 is configured so that the closing state can be maintained by a locking lever (not shown) accompanied by a spring force. When the power source is activated and the disk recording mode is selected, the first ejection stacker 500 moves from the first position to the second position as mentioned above.

Figure 24:
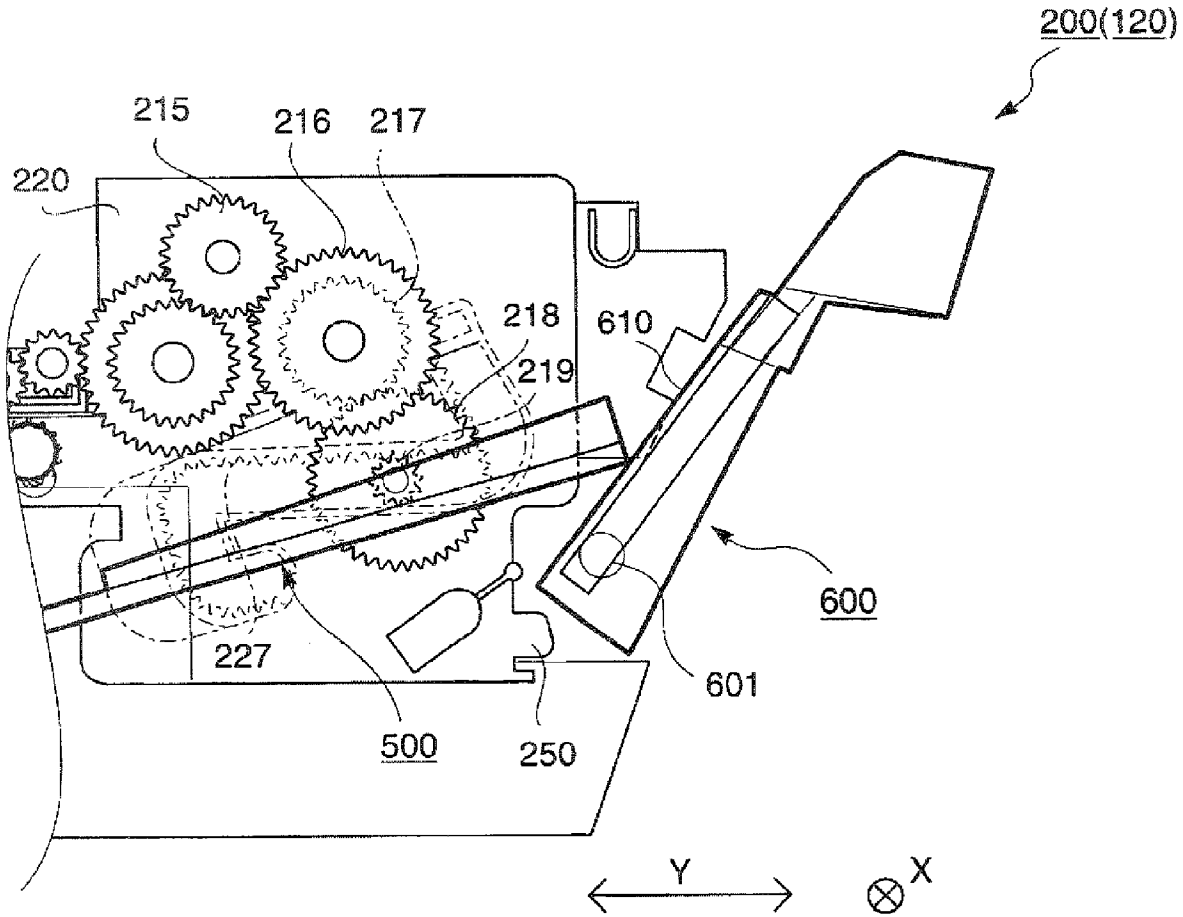

As shown in FIG. 24, when the first ejection stacker 500 moves to the first position to the second position, the first ejection stacker 500 moves to the downstream side in the sheet conveying direction after it has moved upward. At this time, the downstream end of the first ejection stacker 500 in the sheet conveying direction abuts on and presses the second supporting face 610 of the second ejection stacker 600 on the tip end side than the pivot shaft 601. Accordingly, the second ejection stacker 600 pivots in the clockwise direction in the drawing about the pivot shaft 601.

Figure 25:
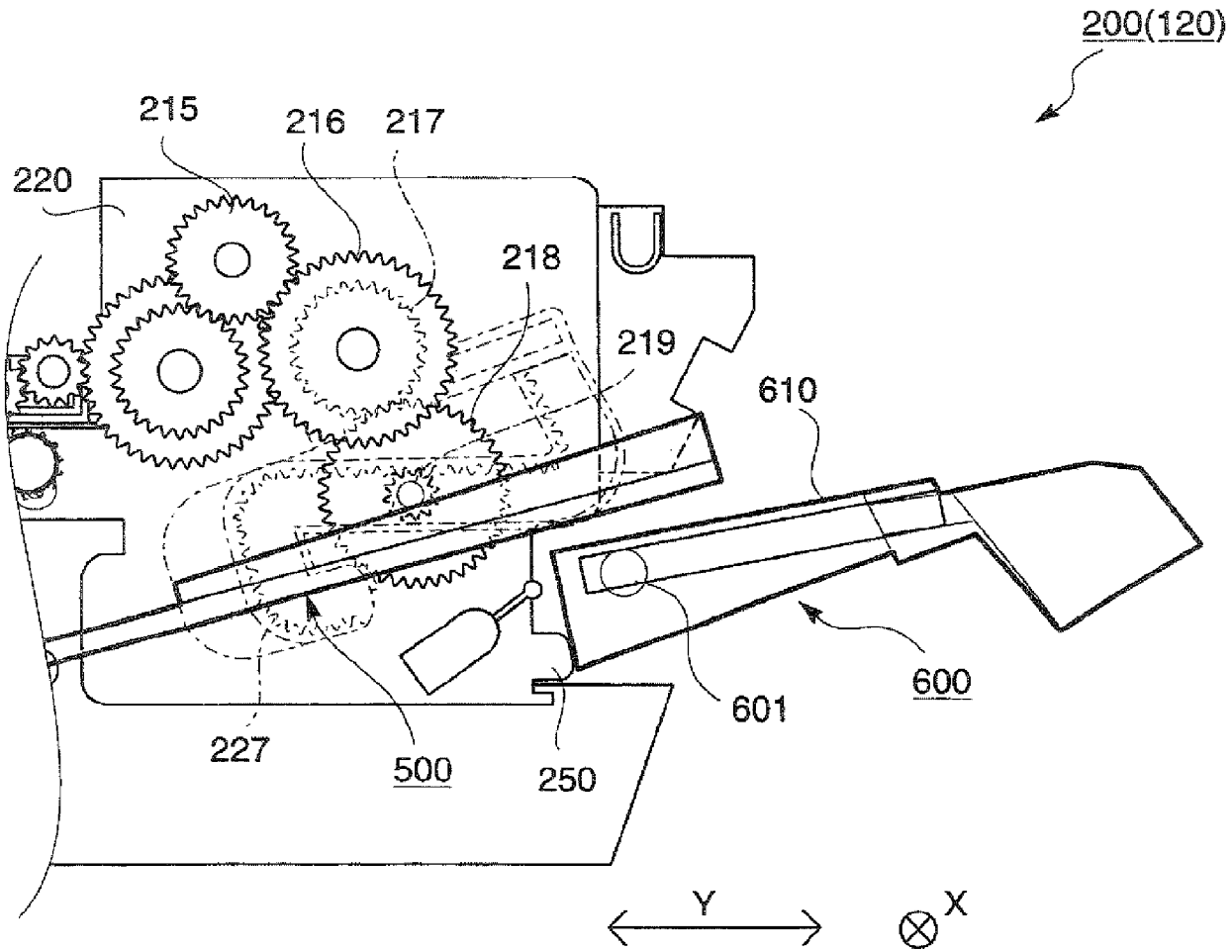

As shown in FIG. 25, when the second ejection stacker 600 is pushed by the first ejection stacker 500 and pivots in the clockwise direction to some degree, the second ejection stacker 600 continues to slowly pivot by a self-weight and a damper (not shown) which resists the self-weight. Then, the second ejection stacker 600 abuts on and is stopped by the cover regulator 250 of the base 220. That is, when the disk recording mode is selected, the second ejection stacker 600 will be in a state where it is opened automatically.

At this time, the second ejection stacker 600 abuts on the front cover detector 810, and the front cover detector 810 detects the state where the second ejection stacker 600 is opened to send a signal to the controller 900.

Here, the front cover detector 810 may be arranged so that it may abut on a portion distant from the pivot shaft 601, and the second ejection stacker 600 is configured so that it may detect a closed state instead of detecting the opened state of the front cover detector 810.

Accordingly, when the disk recording mode is selected, a user does not need to manually open the second ejection stacker 600 in the closed state in order to set the disk tray Q in the tray guide opening 522 of the first ejection stacker 500. Of course, a user can manually open and close the second ejection stacker 600 as required.

Figure 26:
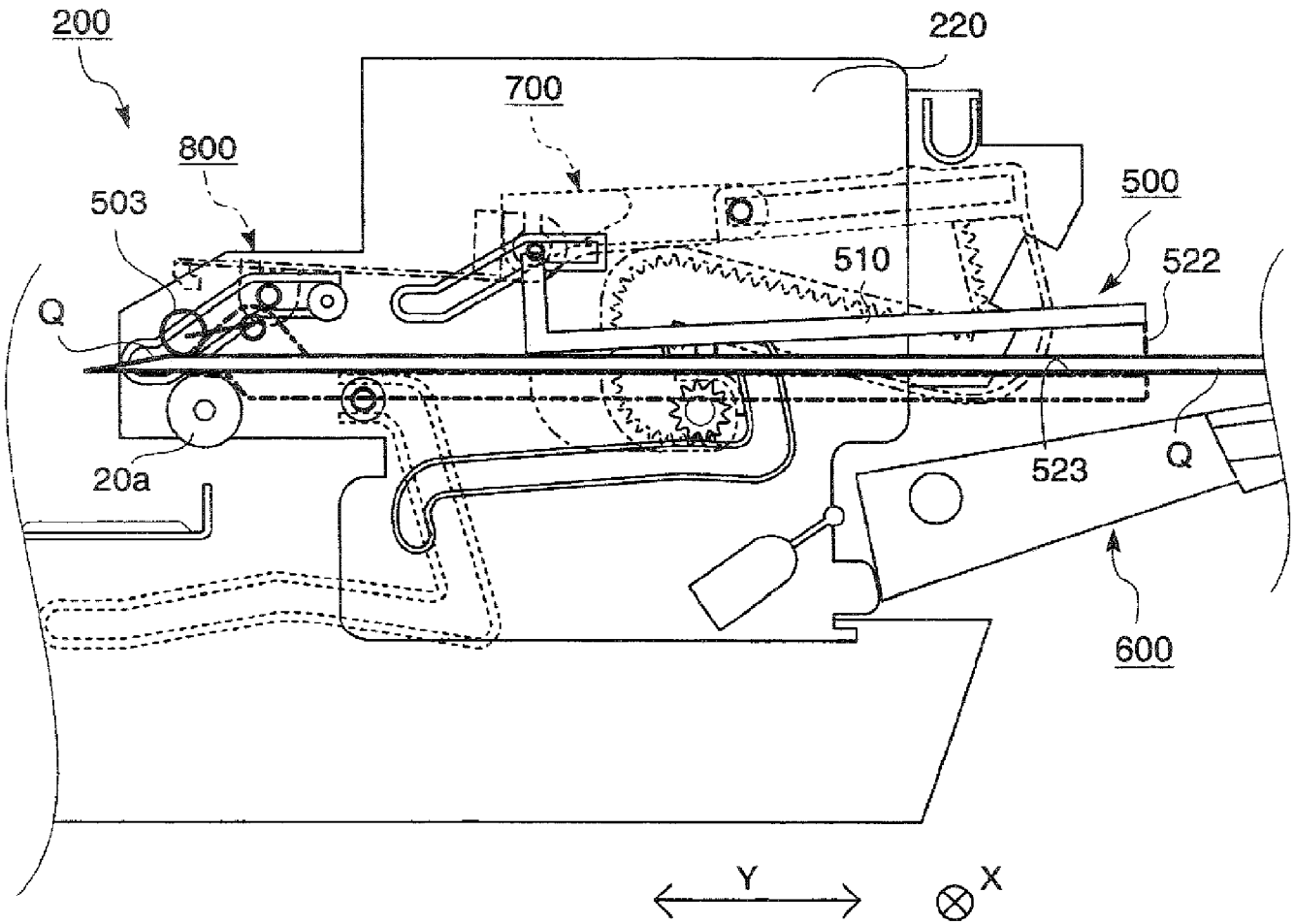
FIG. 26 is a side view showing the second position of the first ejection stacker according to the present invention.

As shown in FIG. 26, when the first ejection stacker 500 is in the second position, the disk tray Q is inserted along the tray guiding face 523 from the tray guide opening 522. Then, when the disk tray Q is set in the location shown in FIG. 6, the upstream end of the disk tray Q in the sheet conveying direction will be in a state where it is nipped by the ejecting drive roller 20*a* and the second ejecting follower rollers 503.

Thereafter, the disk tray Q is sent to the upstream side in the sheet conveying direction by reverse rotation of the ejecting drive roller 20*a*. Then, the upstream end of the disk medium in the sheet conveying direction, which is mounted on the disk tray Q, stops in a position facing the recording head 13, i.e., a recording start position. Thereafter, recording is executed on the label of the disk medium by causing the recording head 13 to carry out scanning in the primary scanning direction X while the ejecting drive roller 20*a* is normally driven to move the disk tray Q to the downstream side in the sheet conveying direction. Then, when the recording has been completed, the ejecting drive roller 20*a* and the second ejecting follower rollers 503 eject the disk tray Q to the downstream side in the sheet conveying direction in cooperation with each other. At this time, since the upstream end of the disk tray Q in the sheet conveying direction departs from the nip between the ejecting drive roller 20*a* and the second ejecting follower rollers 503, the disk tray Q stops in a position further projected from the position where a portion of the disk tray Q has projected from the tray guide opening 522 as shown in FIG. 6.

Of course, instead of the disk tray, a sheet medium is manually inserted into the tray guide opening 522 of the first ejection stacker 500 as required.

In this embodiment, the rack 227 is provided in one face (top face in FIGS. 10 to 22) of the sixth groove 226, and the first ejection stacker 500 is moved by the normal driving and reverse rotation of the first motor 901. However, racks may be provided in the top face and bottom face of the sixth groove 226, and the first motor 901 may always be driven normally to move the first ejection stacker 500 to the first position and the second position. That is, a configuration may be adopted in which the pinion 219 is engaged with one rack on the side of the bottom face so that the first ejection stacker 500 may be moved from the first position to the second position, and the pinion 219 is engaged with the other rack on the side of the top face so that the first ejection stacker 500 may be moved from the second position to the first position. In this case, the disk tray Q can always be prevent from being accidentally caught between the ejecting drive roller 20*a* and the second ejecting follower rollers 503 when the first ejection stacker 500 moves from the second position to the first position.

In this embodiment, the relationship between the first position and the second position is such that the first position is upstream in the sheet conveying direction and upside in the vertical direction, and the second position is downstream in the sheet conveying direction and upside in the vertical direction. However, the invention is not limited to such positional relationship.

In this embodiment, the rack and the pinion are formed in the same shape and operated in synchronism with each other. However, the rack and pinion may be have different shapes in right and left positions. In this case, the posture of the first ejection stacker can always be regulated.

As shown in FIGS. 7 to 9, the stacker position changer 200 further comprises: a front cover opener 820 which opens the second ejection stacker 600 in a closed state, and an opening interrupter 830 which interrupts the operation of opening the second ejection stacker 600. The front cover opener 820 and the opening interrupter 830 comprises: the controller 900; the first motor 901; the power transmitter 210; the first ejection stacker 500; the second ejection stacker 600; the front cover detector 810; and the home position detector 230, and the front cover opener 820 is so configured as to execute a first cover opening sequence and a second cover opening sequence which will be described.

Figure 27:
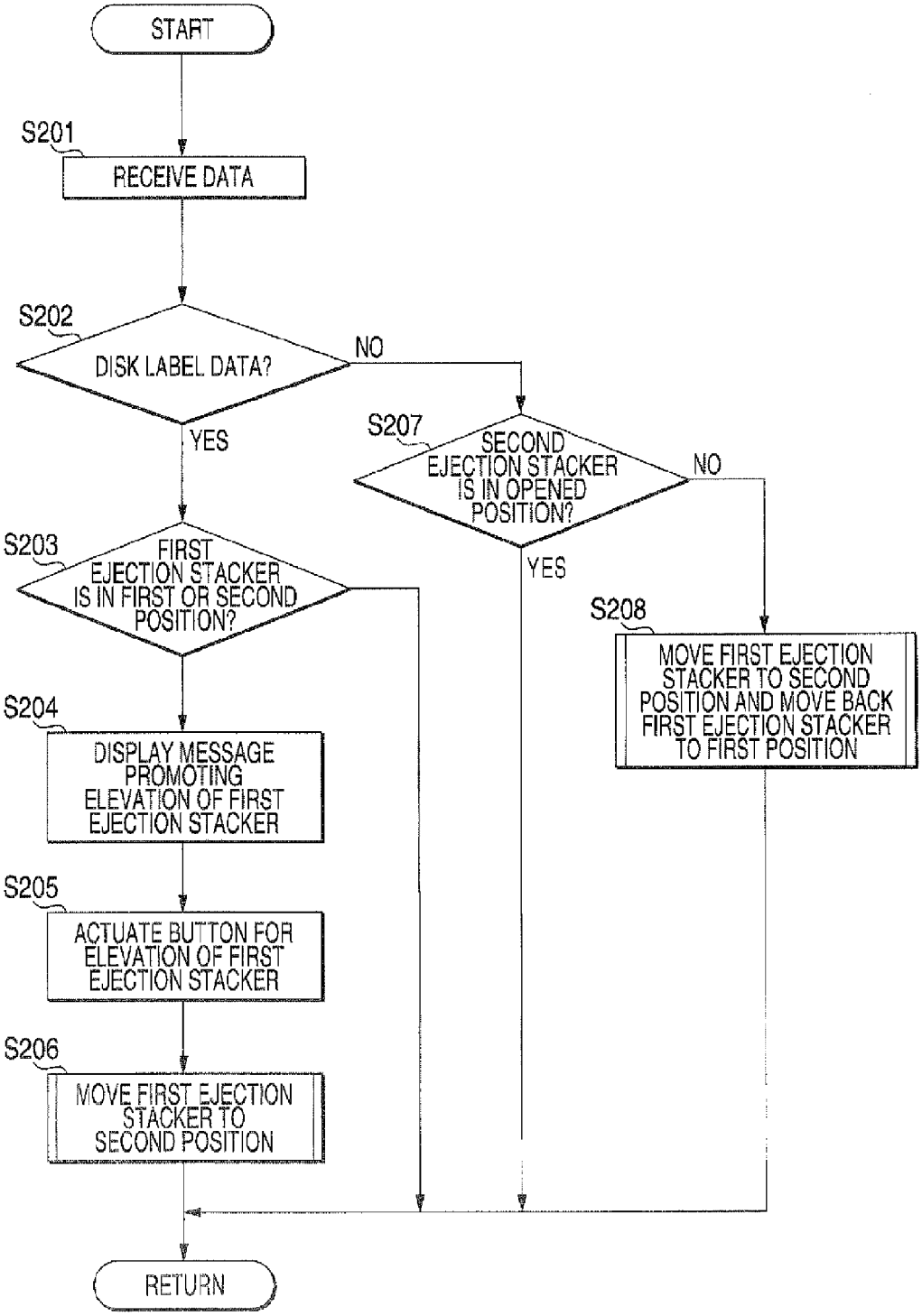
FIG. 27 is a flowchart showing a first cover opening sequence executed by a controller in the ink jet printer.

FIG. 27 shows the first cover opening sequence executed by the controller 900.

In step S201, the controller 900 receives data. Specifically, the controller 900 receives recording data, such as image data, which is sent from a personal computer etc. Then, the process proceeds to the next step. In step S202, the controller 900 determines whether or not the received data are disk label data. Specifically, the controller 900 determines whether the received data is the data to be recorded on a sheet in the sheet recording mode and the data to be recorded on the label face of a disk medium in the disk recording mode. If the received data is the disk label data to be recorded on the label face of a disk medium, the process proceeds to step S203. On the other hand, if the received data is the data to be recorded on a sheet medium, the process proceeds to step S207.

In step S203, the controller 900 determines whether the position of the first ejection stacker 500 is the first position that is the home position to be taken in the sheet recording mode, and the second position to be taken in the disk recording mode. Specifically, the controller 900 determines the position of the first ejection stacker 500 depending on whether or not the first ejection stacker 500 abuts on the home position detector 230. If the controller 900 determines that the position of the first ejection stacker 500 is the first position, the process proceeds to step S204. On the other hand, if the controller 900 determines that the position of the first ejection stacker 500 is the second position, it determines that the second ejection stacker 600 also serving as the front cover is opened, and then completes the first cover opening sequence.

In step S204, the controller 900 displays, on the liquid crystal display 7, a message promoting the actuation of one of the buttons 8 on the front panel 6 for moving the first ejection stacker 500 to the second position. Then, the process proceeds to the next step.

Of course, instead of the liquid crystal display 7, the above message may be displayed on a monitor of a personal computer from which a user has sent recording data to the ink jet printer 100. At this time, the above button may be provided on the monitor of the personal computer. In this case, since the user does not need to move to the front of the ink jet printer 100, the usability is good.

In step S205, the user pushes the button according to the message displayed in step S204. Then, the process proceeds to the next step.

In step S206, the controller 900 causes the first motor 901 to be driven reversely whereby the first ejection stacker 500 is moved from the first position to the second position, as mentioned above. At this time, if the second ejection stacker 600 is in a closed state, as mentioned above, the first ejection stacker 500 comes in press contact with the second ejection stacker 600 to open the second ejection stacker 600 while it moves from the first position to the second position. On the other hand, if the second ejection stacker 600 is already in an opened state, the first ejection stacker 500 will move to the second position without abutting on the second ejection stacker 600. Then, the first cover opening sequence is finished.

In addition, more detailed motion control of the step S206 will be described later as the second cover opening sequence.

In step S207, the contoller 900 determines whether or not the second ejection stacker 600 is closed or opened using the front cover detector 810. If the controller 900 determines that the second ejection stacker 600 is opened, the first cover opening sequence is finished. On the other hand, if the controller 900 determines that the second ejection stacker 600 is closed, the process proceeds to step S208.

In step S208, the controller 900 causes the first motor 901 to be driven reversely whereby the first ejection stacker 500 is moved from the first position to the second position, as mentioned above. At this time, since the second ejection stacker 600 is in a closed state, as mentioned above, the first ejection stacker 500 comes in press contact with the second ejection stacker 600 to open it.

At this time, it is not necessary to move the first ejection stacker 500 completely to the second position. The data received by the controller 900 is not the disk label data but the data to be recorded on a sheet in the sheet recording mode. Accordingly, the first ejection stacker 500 needs to return to the first position at an early stage. Thus, as shown in FIG. 25, the controller 900 causes the first ejection stacker 500 to move to the first position after the second ejection stacker 600 is pressed. That is, in step S208, the controller 900 causes the first motor 901 to be driven reversely whereby the first ejection stacker 500 is moved from the first position shown in FIG. 10 to the position shown in FIG. 14, and causes the first motor 901 to be driven normally whereby the first ejection stacker 500 is moved from the position shown in FIG. 14 to the first position shown in FIG. 10. At this time, the aforementioned biasing force of the torsion coil spring (not shown) that acts on the ejector frame 800 does not act on the first ejection stacker 500. Then, the first cover opening sequence is finished.

Figure 28:
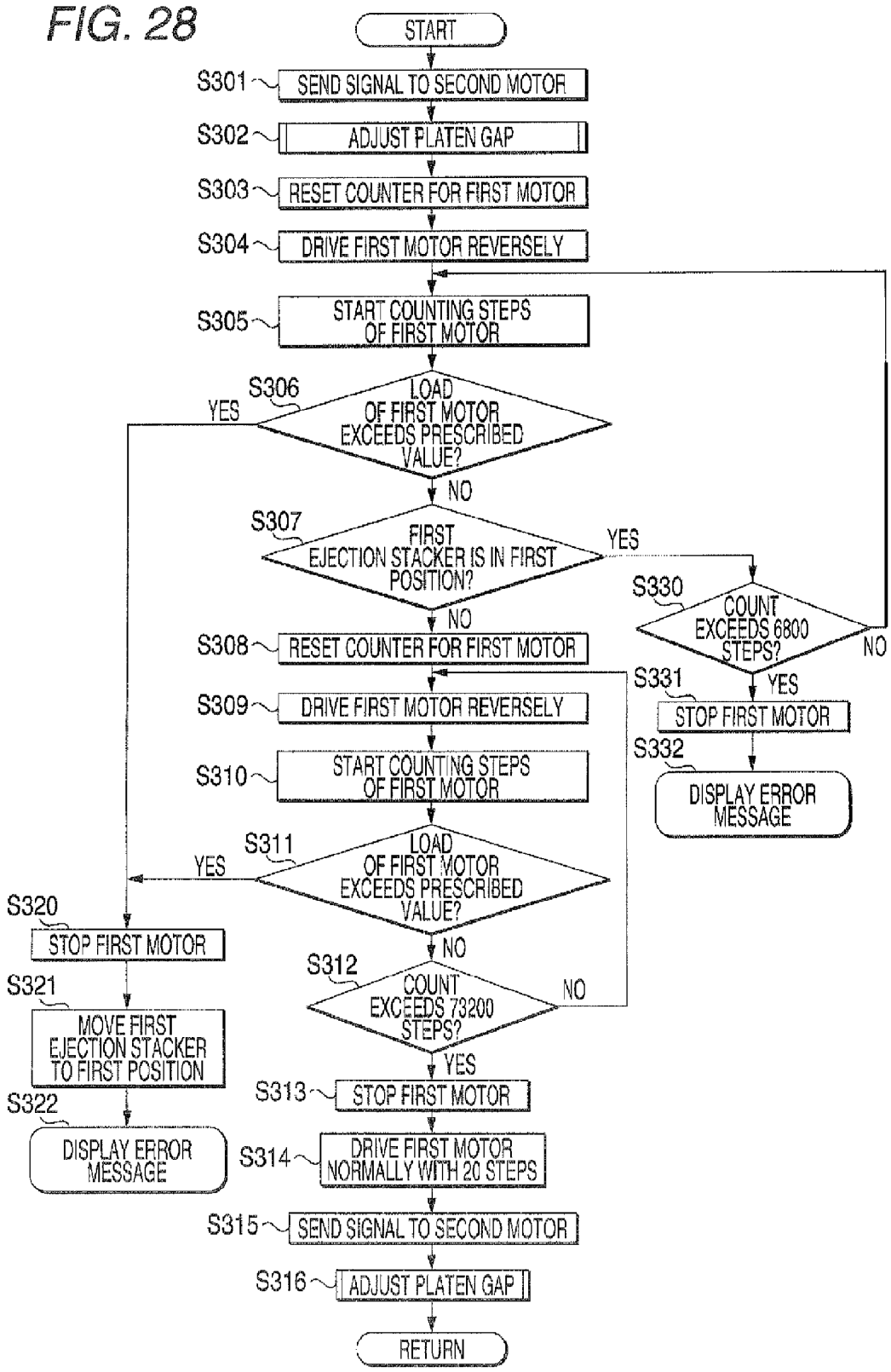
FIG. 28 is a flowchart showing a second cover opening sequence executed by the controller.

Subsequently, the second cover opening sequence executed at the step S206 and the step S208 will be described with reference to FIG. 28. In steps S206 and S208, the controller executes the second cover opening sequence starting from step S301. As described the above, in step S206, the first ejection stacker 500 moves from the first position to the second position, while in step S208, the first ejection stacker 500 returns to the first position after it has moved from the first position to the second position to open the second ejection stacker 600.

However, the operation executed in step S208 may be made the same as the operation executed in step S206. In this case, the usability is good when a sheet medium is inserted into the tray guide opening 522 of the first ejection stacker 500.

First, the operation executed in step S206 will be described. In step S301, the controller 900 sends a signal driving the second motor 902 to the second motor 902 in order to rotate the cam shaft 302 of the aforementioned platen gap adjuster 300 in order to set the platen gap PG for effecting the disk recording mode. Then, the process proceeds to the next step.

In step S302, the platen gap adjuster 300 is activated whereby the locking lever 410 of the power transmission switcher 400 releases regulation of the posture of the planetary gear holder 420, as mentioned above. That is, while the first motor 901 drives, transmission of power to the first gear 211 will be connected. Then, the process proceeds to the next step.

In step S303, the controller 900 resets the value of a counter counting the number of steps of the first motor 901 to zero. Then, the process proceeds to the next step.

In step S304, the controller 900 causes the first motor 901 to be driven reversely, thereby reversely driving the conveying drive roller 19*a* and the ejecting drive roller 20*a*. At this time, since the driving speed of the first motor 901 is a low speed, the conveying drive roller 19*a* and the ejecting drive roller 20*a* are driven at a low speed. Then, the process proceeds to the next step.

In step S305, the controller 900 starts counting of the number of steps that the first motor 901 has driven with start of driving of the first motor 901. Then, the process proceeds to the next step.

In step S306, the controller 900 determines whether or not the load of the first motor 901 exceeds a prescribed value. As a method of the determination, for example, the controller can determine whether or not the current value of the first motor 901 exceeds a prescribed value. Then, if the controller 900 determines that the load of the first motor 901 exceeds the prescribed value, the process proceeds to step S320. On the other hand, if the controller 900 determines that the value does not exceed the prescribed value, the process proceeds to step S307.

In step S307, the controller 900 determines whether or not the first ejection stacker 500 is located in the first position using the home position detector 230. If the controller 900 determines that the first ejection stacker 500 is located in the first position by the home position detector 230, the process proceeds to step S330. If the controller 900 determines that the first ejection stacker 500 is not located in the first position, the process proceeds to step S308.

In step S308, the controller 900 resets the value of the counter counting the number of steps of the first motor 901 to zero. Then, the process proceeds to the next step.

In step S309, the controller 900 causes the first motor 901 to be driven reversely at a low speed, thereby reversely driving the conveying drive roller 19*a* and the ejecting drive roller 20*a* at a low speed. That is, the first ejection stacker 500 moves at a low speed towards the second position from the first position side. Then, the process proceeds to the next step.

In step S310, the controller 900 starts counting of the number of steps that the first motor 901 has driven with start of driving of the first motor 901 from when the home position detector 230 has stopped detecting the first ejection stacker 500. At this time, the controller 900 can correctly determine where the first ejection stacker 500 is presently located by this counting. Then, the process proceeds to the next step.

In step S311, the controller 900 determines whether or not the load of the first motor 901 exceeds a prescribed value. Then, if the controller 900 determines that the load of the first motor 901 exceeds the prescribed value, the process proceeds to step S320. On the other hand, if the controller 900 determines that the value does not exceed the prescribed value, the process proceeds to step S312.

In step S302, the controller 900 determines whether or not the number of steps of the first motor 901 that is counted exceeds "73200 steps." Here, the "73200 steps" is the number of steps that the traveling distance of the first ejection stacker 500 becomes 107 mm, and the number of steps by which the first ejection stacker can move to the second position shown in FIG. 22. That is, the controller 900 determines whether or not the first ejection stacker 500 has reached the second position shown in FIG. 22 after the second ejection stacker 600 abuts on and presses the first ejection stacker 500 as shown in FIGS. 24 and 25. Then, if the controller 900 determines that the first ejection stacker 500 has reached the second position as shown in FIG. 22, the process proceeds to step S313. On the other hand, if the controller 900 determines that the first ejection stacker 500 has not reached the second position as shown in FIG. 22, the process returns to step S309.

In step S313, the controller 900 stops driving of the first motor 901. Accordingly, the first ejection stacker 500 stops in the second position shown in FIG. 22. Then, the process proceeds to the next step.

In step S314, the controller 900 causes the first motor 901 to be driven normally at high speed by "20 steps", thereby separating the second planetary gear 424 from the first gear 211. Then, the process proceeds to the next step.

In step S315, the controller 900 sends a signal to the second motor 902 in order to rotate the cam shaft 302 of the aforementioned platen gap adjuster 300 to set the platen gap PG for executing the recording on a disk medium. Then, the process proceeds to the next step.

In step S316, the platen gap adjuster 316 is activated whereby the locking lever 410 of the power transmission switcher 400 regulates the posture of the planetary gear holder 420, as mentioned above. That is, transmission of power from the sun gear 426 to be driven by the power of the first motor 901 to the first gear 211 is cut off. Thereafter, the cam shaft 302 is rotated to adjust the platen gap PG to the prescribed dimension. Then, the second cover opening sequence is finished.

In step S320, the controller 900 stops driving of the first motor 901. Accordingly, movement of the first ejection stacker 500 from the first position to the second position is interrupted. That is, the first ejection stacker 500 stops irrespective of where it is located. Then, the process proceeds to the next step.

In step S321, the controller 900 causes the first motor 901 to be driven normally whereby the first ejection stacker 500 is be forcedly moved back to the first position irrespective of where the first ejection stacker 500 is located. Then, the process proceeds to the next step.

In step S322, the controller 900 displays, on the liquid crystal display 7, a message instructing a user to remove a sheet P or obstacles considered to exist on the first ejection stacker 500, on the downstream side of the first ejection stacker 500, or in the movable range of the second ejection stacker 600. Then, if the user pushes an elevation button 8 after the user has removed the paper or obstacles in accordance with a message displayed on the liquid crystal display 7, the controller 900 causes the first ejection stacker 500 to be moved towards the second position. At this time, the process returns to the second cover opening sequence from step S306 or step S311.

In step S330, the controller 900 determines whether or not the number of steps of the first motor 901 that is counted exceeds "6800 steps." Here, the "6800 steps" is the number of steps that the traveling distance of the first ejection stacker 500 becomes 10.1 mm, and the number of steps by which the first ejection stacker is separated from the home position detector 230 if the driving force of the first motor 901 during its reverse rotation is normally sent to the first ejection stacker 500. That is, there is a possibility that, if the home position detector 230 has detected the first ejection stacker 500 irrespective of reverse rotation of the first motor 901 by "6800 steps," the driving force of the first motor 901 during its reverse rotation may not be normally sent to the first ejection stacker 500. Accordingly, if the controller 900 determines that the number of steps of the first motor 901 that is counted exceeds "6800 steps," the controller 900 determines that this is abnormal, and the process proceeds to step S320. On the other hand, if the controller 900 determines that the number of steps of the first motor 901 that is counted does not exceed "6800 steps," the process returns to step S320.

In step S331, the controller 900 stops driving of the first motor 901. That is, since the controller 900 has determined that the driving force of the first motor 901 is not transmitted to the first ejection stacker 500, it stops useless driving of the first motor 901. Then, the process proceeds to the next step.

In step S332, the controller 900 displays, on the liquid crystal display 7, a message instructing a user to remove a sheet P or obstacles considered to exist on the first ejection stacker 500, on the downstream side of the first ejection stacker 500, or in the movable range of the second ejection stacker 600. Then, if the user pushes the elevation button 8 after the user has removed the paper or obstacles in accordance with a message displayed on the liquid crystal display 7, the controller 900 causes the first ejection stacker 500 to be moved towards the second position. At this time, if the controller 900 determines that the power transmission by the power transmission switcher 400 is not in a connected state, that is, if the controller 900 determines that the operation of releasing regulation of the posture of the planetary gear holder 420 by the locking lever 410 has failed, the process returns to the second cover opening sequence from step S301 when the user pushes the elevation button 8.

Subsequently, the operation executed in step S208 will be described. Since step S301 to step S311 are the same as the above ones, the description thereof is omitted. In step S312, the controller 900 determines whether or not the number of steps of the first motor 901 that is counted exceeds a "prescribed steps" instead of the "73200 steps" in step S312. Here, the "prescribed step," is the number of steps that the first ejection stackers 500 can abut on and press the second ejection stacker 600 as shown in FIG. 25. That is, the controller 900 determines whether or not the first ejection stacker 500 has reached the position shown in FIGS. 14 and 25. Then, if the controller 900 determines that the first ejection stacker 500 has reached the position shown in FIGS. 14 and 25, the process proceeds to step S313. On the other hand, if the controller 900 determines that the first ejection stacker 500 has not reached the position shown in FIGS. 14 and 25, the process returns to step S309.

In step S313, the controller 900 stops driving of the first motor 901. Accordingly, movement of the first ejection stacker 500 from the first position to the second position is interrupted. That is, the first ejection stacker 500 stops in the position shown in FIGS. 14 and 25 instead of the second position in the operation executed in step S206. Then, the process proceeds to the next step.

In step S314, the controller 900 causes the first motor 901 to be driven normally until the first ejection stacker 500 moves to the first position instead of "20 steps" in the operation executed in step S206, whereby the conveying drive roller 19*a* and the ejecting drive roller 20*a* are driven normally. At this time, since the driving speed of the first motor 901 is a high speed, the conveying drive roller 19*a* and the ejecting drive roller 20*a* are driven at a high speed. That is, the first ejection stacker 500 moves at a high speed towards the first position from the second position side. Then, the first ejection stacker 500 abuts on the home position detector 230. At this time, the controller 900 determines the position of the first ejection stacker 500 using the home position detector 230 to move the first ejection stacker 500 to the first position and stop it. Then, the process proceeds to the next step.

In step S315, the controller 900 sends a signal to the second motor 902 in order to rotate the cam shaft 302 of the aforementioned platen gap adjuster 300 to obtain the platen gap PG for the sheet recording mode. Then, the process proceeds to the next step.

In step S316, the platen gap adjuster 316 is activated whereby the locking lever 410 of the power transmission switcher 400 regulates the posture of the planetary gear holder 420, as mentioned above. That is, transmission of power from the sun gear 426 to be driven by the power of the first motor 901 to the first gear 211 is cut off. Thereafter, the cam shaft 302 is rotated to adjust the platen gap PG so as to be the one for the sheet recording mode. Then, the second cover opening sequence is finished.

Since step S320 to step S332 in the operation executed in step S208 are the same as those in the operation executed in step S206, the repetitive explanations will be omitted.

Next, a second embodiment will be described. The stacker position changer 1200 according to this embodiment is different from the stacker position changer 200 of the first embodiment in that the stacker position changer 1200 comprises a slider 550. Moreover, they are different in that the number of a biasing member which act on the first ejection stacker is one in the stacker position changer 200 of the first embodiment, but two (two types of) biasing member are provided in the stacker position changer 1200.

The same members as or substantially the same members as those of the first embodiment are denoted by the same reference numerals as those of the first embodiment, and the repetitive explanations will be omitted. Also, in the second embodiment, the second projection 504 and the second groove 222 of the first embodiment are eliminated.

Figure 29:
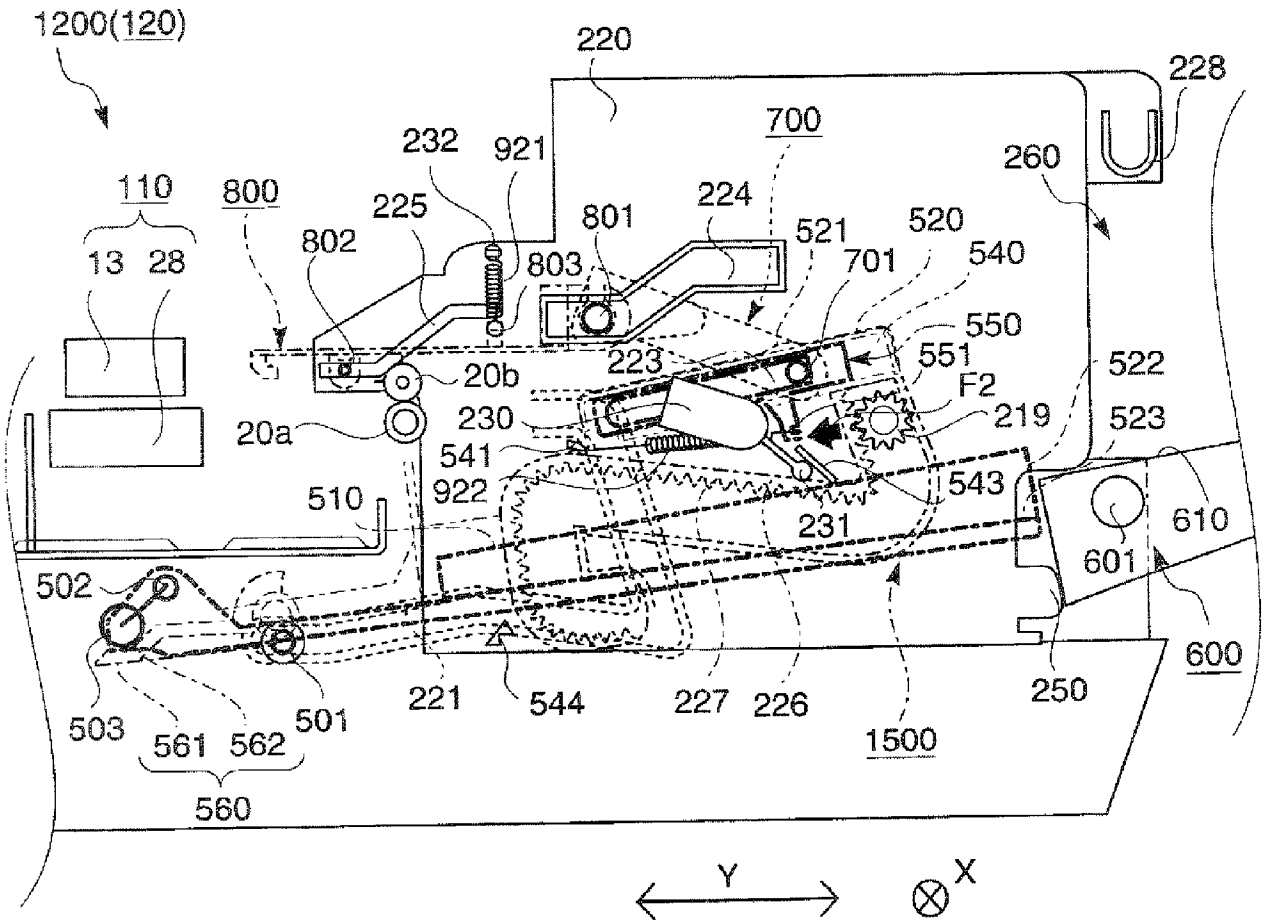
FIG. 29 is a side view showing a state that a first ejection stacker in an ink jet printer according to a second embodiment of the invention is placed in a first position.
Figure 37:
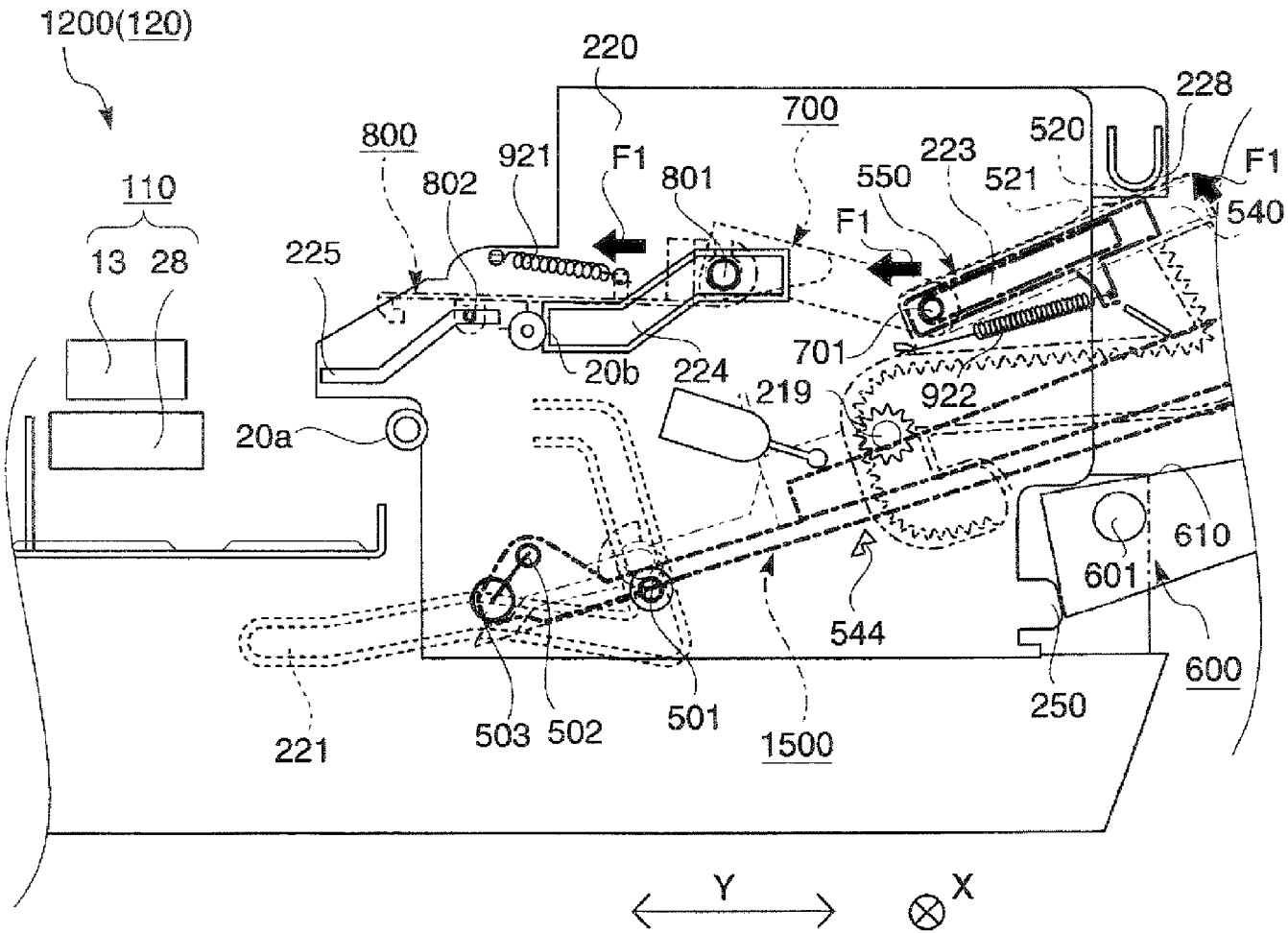
Figure 38:
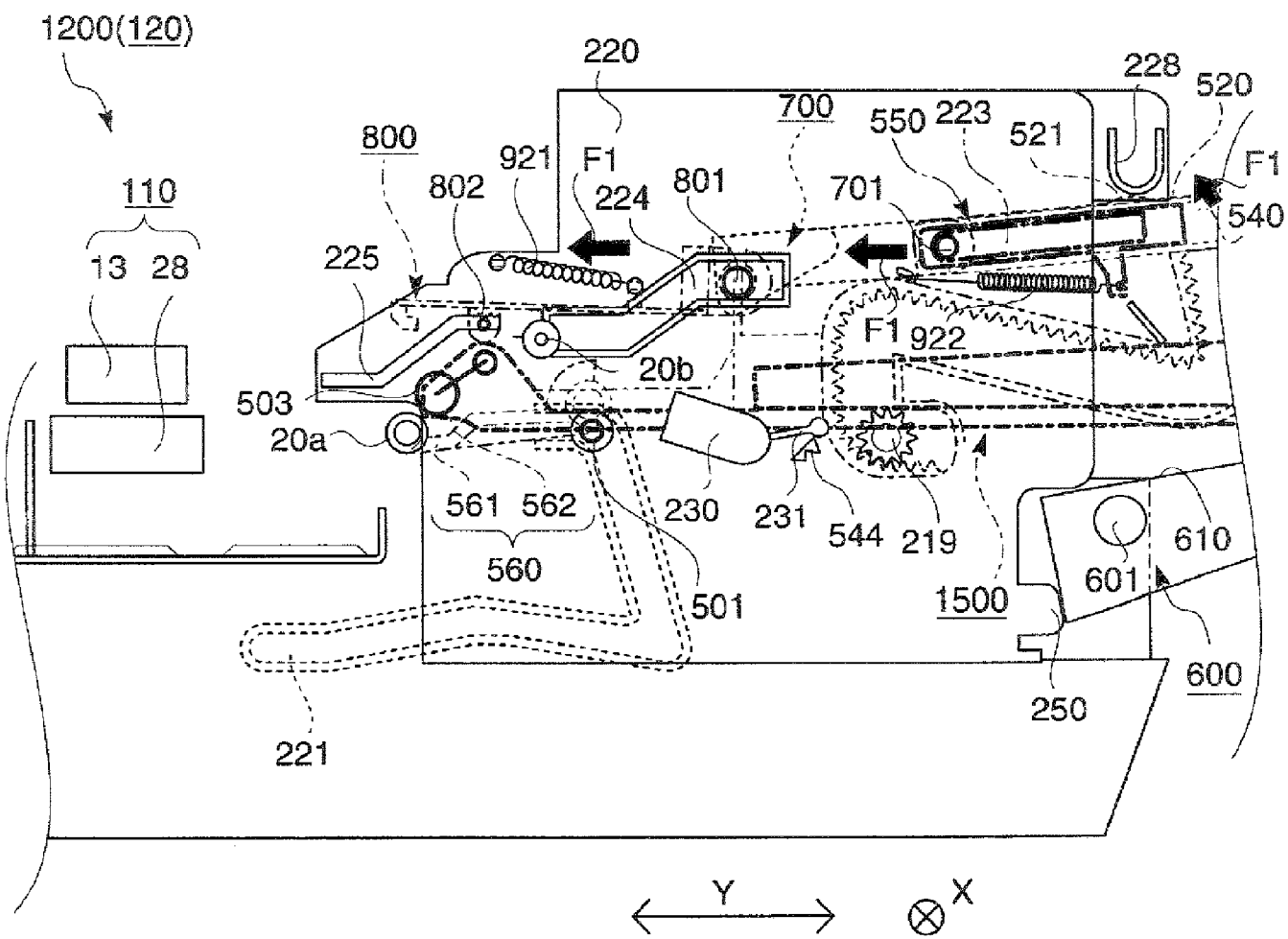
Figure 39:
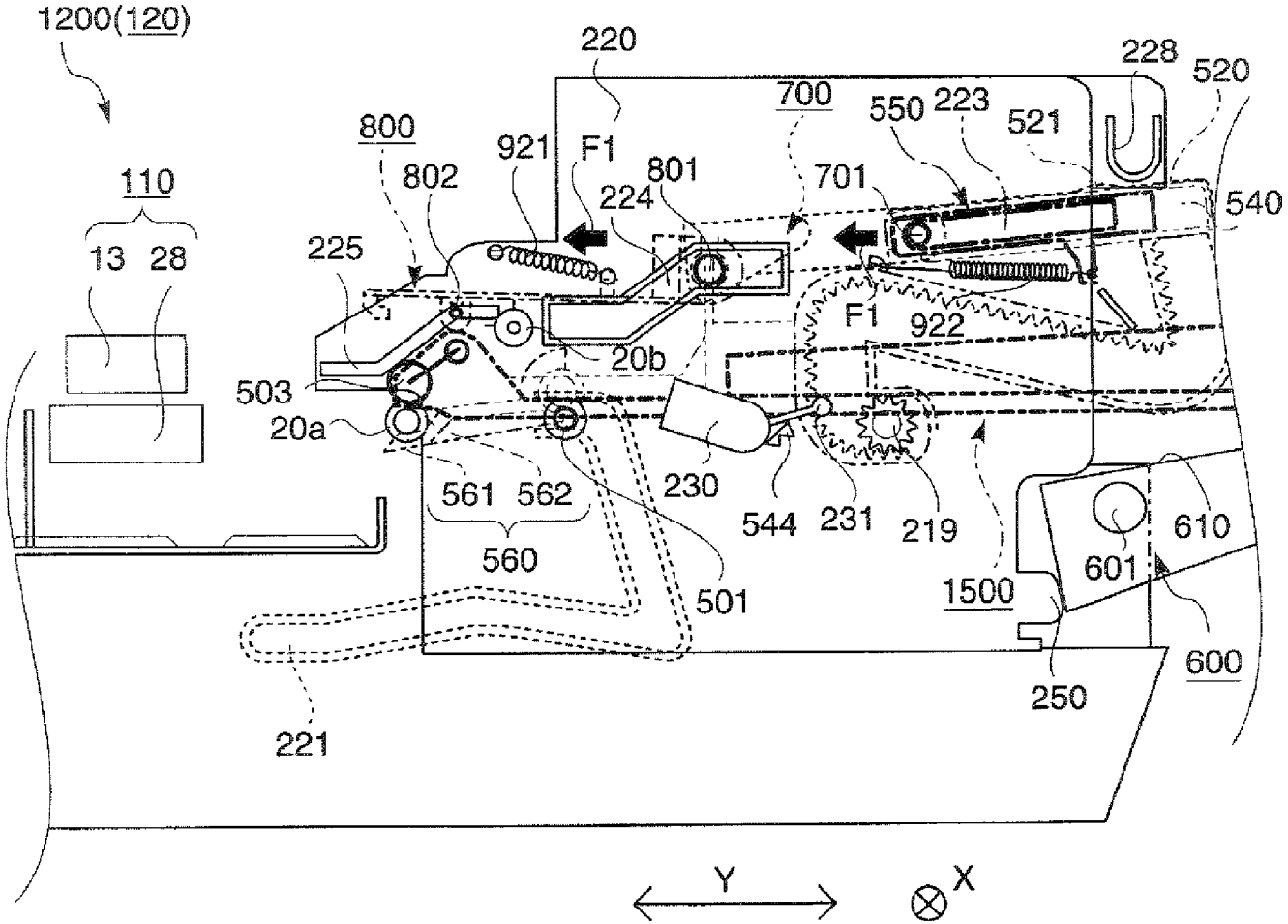
FIG. 39 is a side view showing a state that the first ejection stacker of FIG. 29 is placed in the second position.
Figure 40:
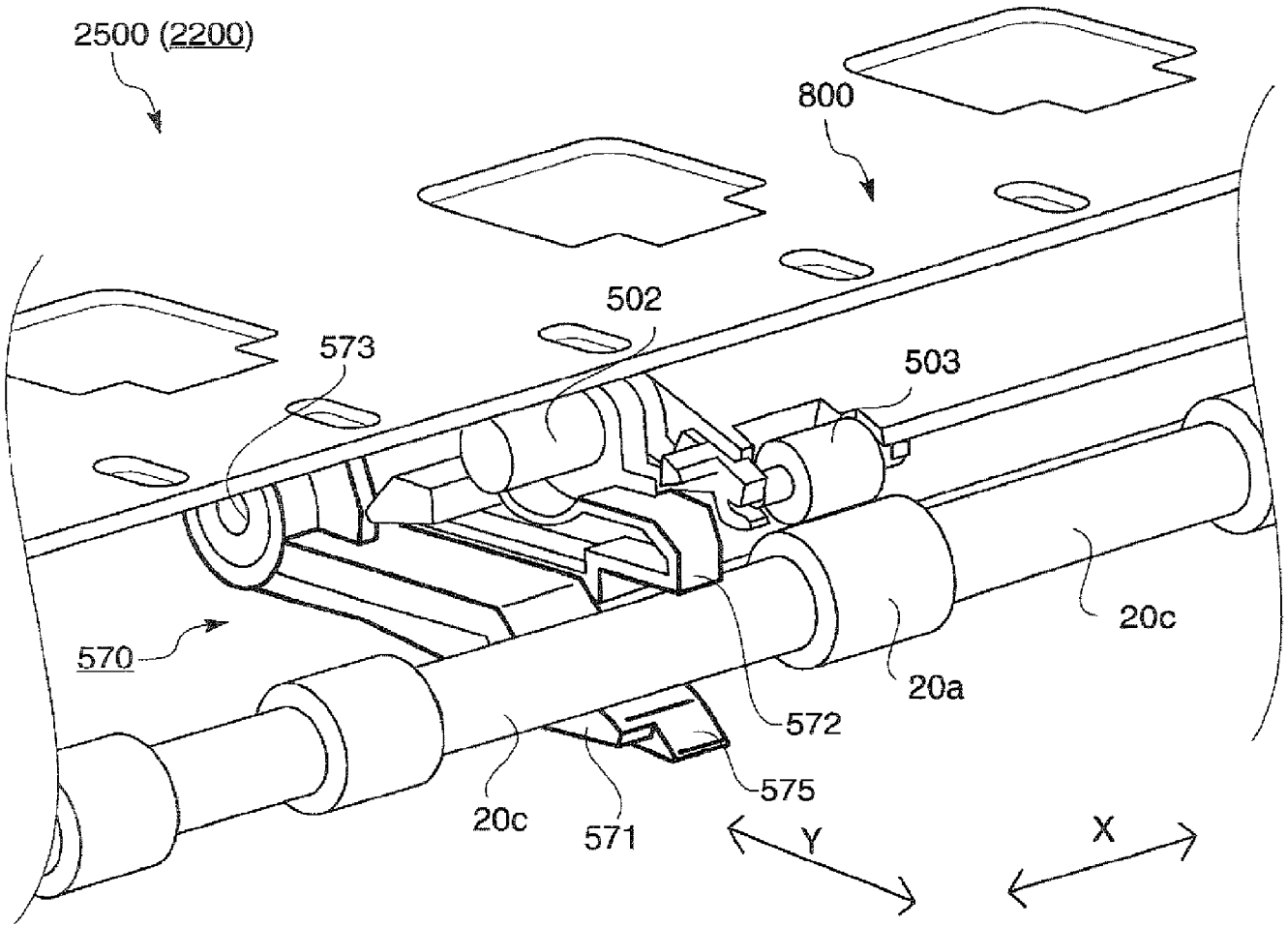
FIG. 40 is an enlarged perspective view of a position regulator of a first ejection stacker in an ink jet printer according to a third embodiment of the invention.

FIGS. 29 to 39 are side views showing movement of a first ejection stacker 1600 of the stacker position changer 1200. Among the drawings, FIG. 29 shows the first position of the first ejection stacker 1500, and FIGS. 28 to 36 shows movement between the first position to the second position, and FIG. 39 shows the second position.

As shown in FIG. 29, the first ejection stacker 1500 comprises: a pair of slider guiding grooves 540 on both sides in the primary scanning direction, a pair of sliders 550 which are guided by the pair of slider guiding grooves 540, and are sled inside the slider guiding grooves; and a pair of second springs 922 which bias the sliders 550 to the first ejection stacker 1500 to the upstream side in the sheet conveying direction. One end of each of the second springs 922 engages each of slider-side spring engaging portions 551 provided in the sliders 550, and the other end thereof engages a stacker-side spring engaging portion 541 provided in the first ejection stacker 1500. Moreover, the pair of third grooves 223 which engage the connecting arm 700 are provided in the pair of sliders 550, respectively.

Moreover, the first ejection stacker 1500 comprises the pair of sixth grooves 226 provided on both sides in the primary scanning direction. The racks 227 are provided on one face of each of the pair of sixth grooves 226 so that they may mesh with the aforementioned pair of pinions 219.

The first ejection stacker 1500 comprises: the position detector 230 provided in the base 220; a first contact portion 543 which comes in contact with the position detector 230 when the first ejection stacker 1500 is in the first position (home position); and a second contact portion 544 which comes in contact with the position detector 230 when the first ejection stacker 1500 is in the second position. The position detector 230 is provided so that it may be switched to an ON state (top position), an OFF state (neutral position), and an ON state (bottom position) depending on the position of a projection 231. Accordingly, in the first position, the first contact portion 543 abuts on the position detector 230 to depress the projection 231 downward, turning on the position detector 230.

The ejector frame 800 comprises: the pair of fourth projections 801 which are engaged with and guided by the pair of fourth grooves 224 of the base 220; the pair of fifth projections 802 which are engaged with and guided by the pair of fifth grooves 225 of the base 220; and the first ejecting follower rollers 20*b* which are circumscribed to the ejecting drive roller 20*a* while being biased by a spring (not shown). The ejector frame 800 is biased to a position that the ejector frame 800 takes, by a first spring 921, when the first ejection stacker 1500 is in the first position. One end of the first spring 921 engages a frame-side spring engaging portion 803 provided in the ejector frame 800, and the other end of the first spring engages a base-side spring engaging portion 232 provided in the base 220.

In the first position, the second springs 922 bias the sliders 550 to the upstream side in the sheet conveying direction in the first ejection stacker 1500. At this time, since the third projections 701 of the connecting arm 700 abut on the downstream portions of the third grooves 223 of the sliders 550, the biasing force F2 of the second springs 922 acts on the connecting arm 700. That is, the biasing force F2 of the second springs 922 acts on the ejector frame 800 via the connecting arm 700. Accordingly, the ejector frame 800 is positioned with precision by abutment between the upstream portions of the fourth grooves 224 and the fourth projections 801, and abutment between the upstream portions of the fifth grooves 225 and the fifth projections 802.

On the other hand, the biasing force F1 of the first spring 921 hardly acts on the ejector frame 800.

The amount of driving of the first motor 901 when the first ejection stacker 1500 moves from the first position to the second position is controlled by the controller 900 so that the first ejection stacker may stop due to an increase in the load of a motor caused by abutment when the first ejection stacker has reached the second position, and the first contact portion 543 provided in the first ejection stacker 1500 may be separated from the home position detector 230 and may then stop with a prescribed number of steps.

On the other hand, the amount of driving of the first motor 901 when the first ejection stacker 1500 moves from the second position to the first position is controlled so that the first ejection stacker may stop due to an increase in the load of a motor caused by abutment when the first ejection stacker has reached the first position, and the first contact portion 544 provided in the first ejection stacker 1500 may be separated from the home position detector 230 and may then stop with a prescribed number of steps.

Since the second springs 922, the sliders 550, the third projections 701, the fourth projections 801, the fifth projections 802, the slider guiding grooves 540, the third grooves 223, the fourth grooves 224, and the fifth grooves 225, which are provided in pairs in the primary scanning direction, have the same shape on the right and left sides and are operated synchronously with each other, the following description will be made about only the elements on one side, and description of the elements on the other side is omitted.

Figure 30:
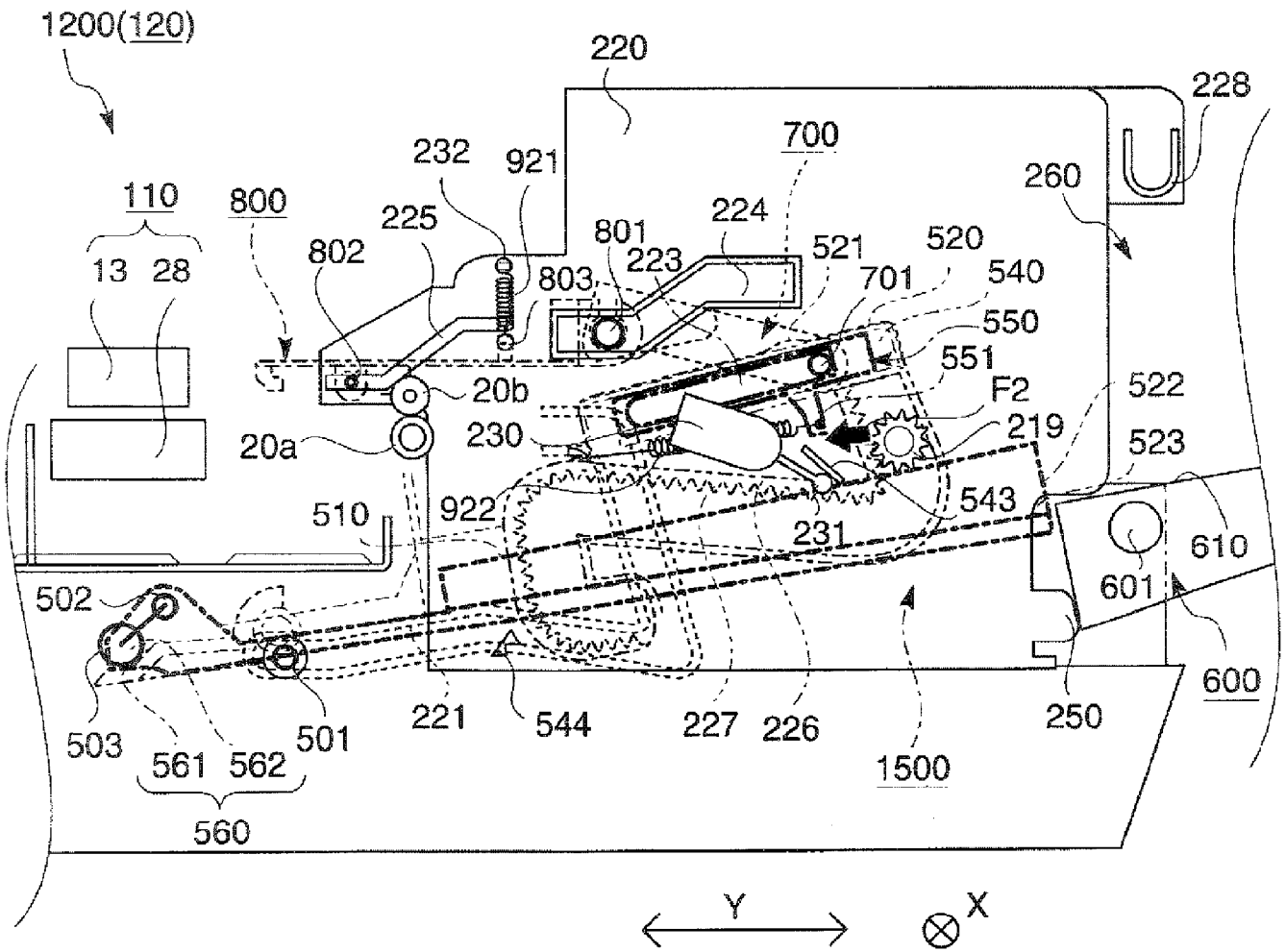
FIGS. 30 to 38 are side views showing movement of the first ejection stacker of FIG. 29 between the first position and a second position.

As shown in FIG. 30, when the pinion 219 rotates in the clockwise direction from the state shown in FIG. 29, power will be transmitted to the rack 227 of the first ejection stacker 1500.

At this time, the slider 550 is regulated by the third projection 701 of the connecting arm 700, and gradually moves to the downstream side in the sheet conveying direction inside the slider guiding groove against the biasing force F2 of the second spring 922.

Figure 31:
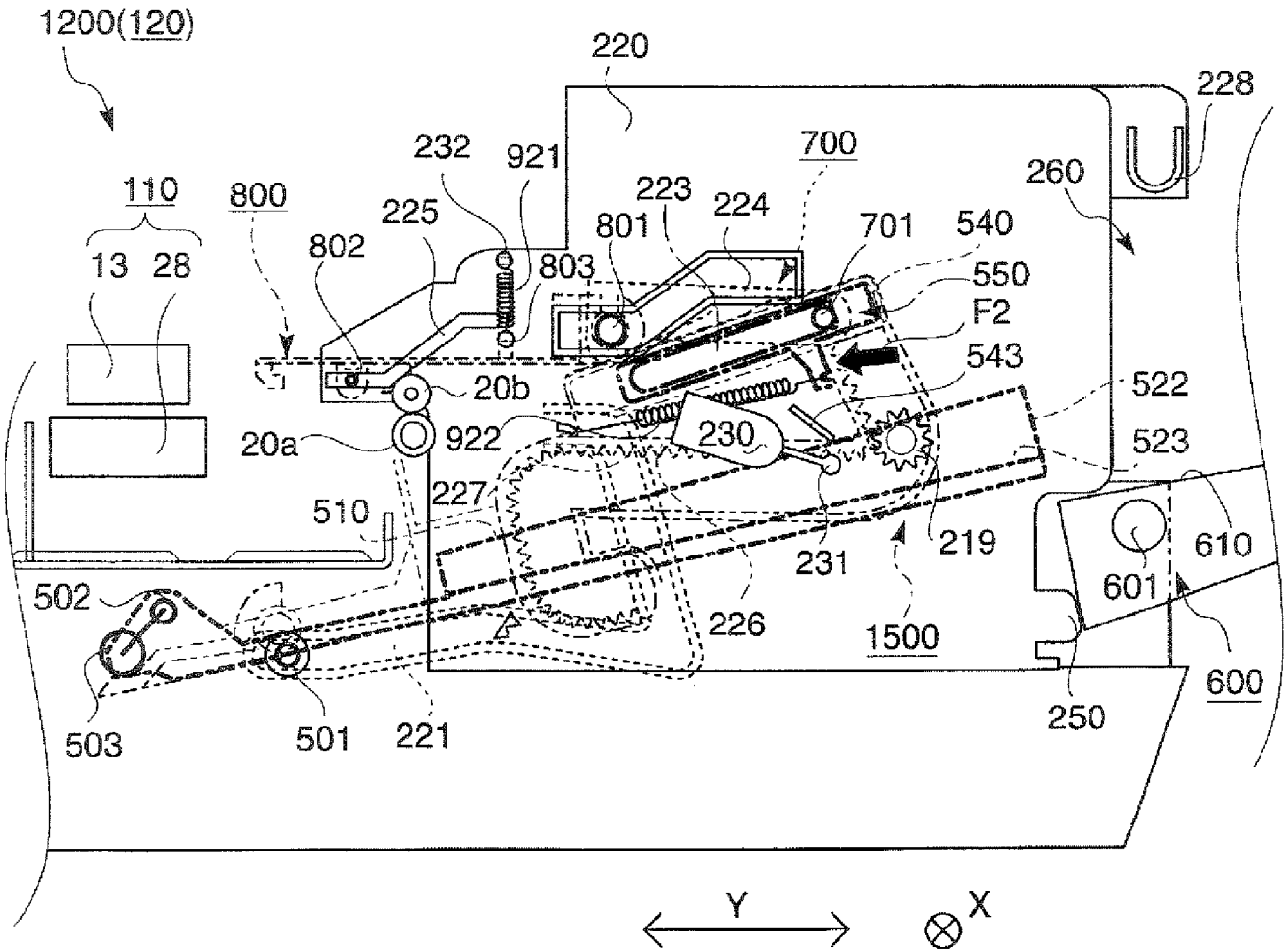

As shown in FIG. 31, when the pinion 219 further rotates in the clockwise direction from the state shown in FIG. 30, the pinion 219 tends to further move the first ejection stacker 1500 upward via the rack 227. Accordingly, the first ejection stacker 1500 is pivoted about the first projection 501 so that its downstream end in the sheet conveying direction may ascend further. Then, the downstream end of the first ejection stacker 500 in the sheet conveying direction is located at a higher position than the upstream end of the second ejection stacker 600 in the sheet conveying direction.

At this time, the slider 550 is regulated by the third projection 701 of the connecting arm 700, and further moves to the downstream side in the sheet conveying direction inside the slider guiding groove against the biasing force F2 of the second spring 922. Then, the slider 550 stops in a position where it does not abut on the downstream end of the slider guiding groove 540. At this time, since the second spring 922 will be in a state where it has been extended to the maximum, the biasing force F2 of the second spring 922 becomes a maximum value. That is, the ejector frame 800 is in a state where it receives the action of the second spring 922 most strongly via the connecting arm 700.

Also, when the downstream end of the first ejection stacker 1500 ascends, the first contact portion 543 will be separated from the home position detector 230, turning off the position detector. As a result, counting of the number of steps of the first motor 901 is started.

Figure 32:
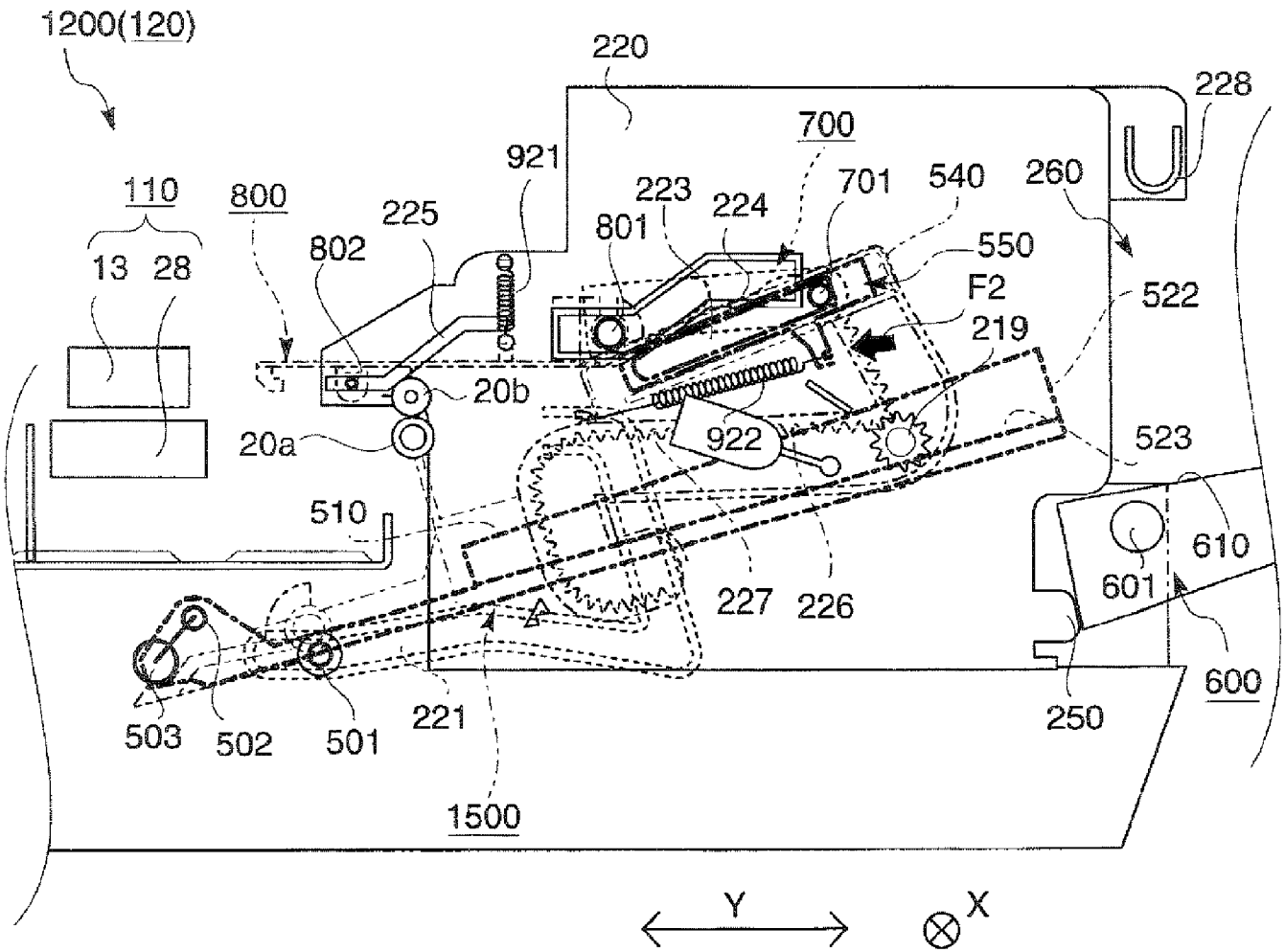

As shown in FIG. 32, when the pinion 219 further rotates in the clockwise direction from the state shown in FIG. 31, the pinion 219 tends to move to the upstream side in the sheet conveying direction along the sixth groove 226. That is, the pinion 219 tends to move the first ejection stacker 1500 to the downstream side in the sheet conveying direction via the rack 227.

At this time, the slider 550 moves to the upstream side in the sheet conveying direction inside the slider guiding groove with the biasing force F2 of the second spring 922. That is, the biasing force F2 of the second spring 922 assists in moving the first ejection stacker 1500 to the downstream side in the sheet conveying direction. Accordingly, the load of the first motor 901 can be reduced.

Figure 33:
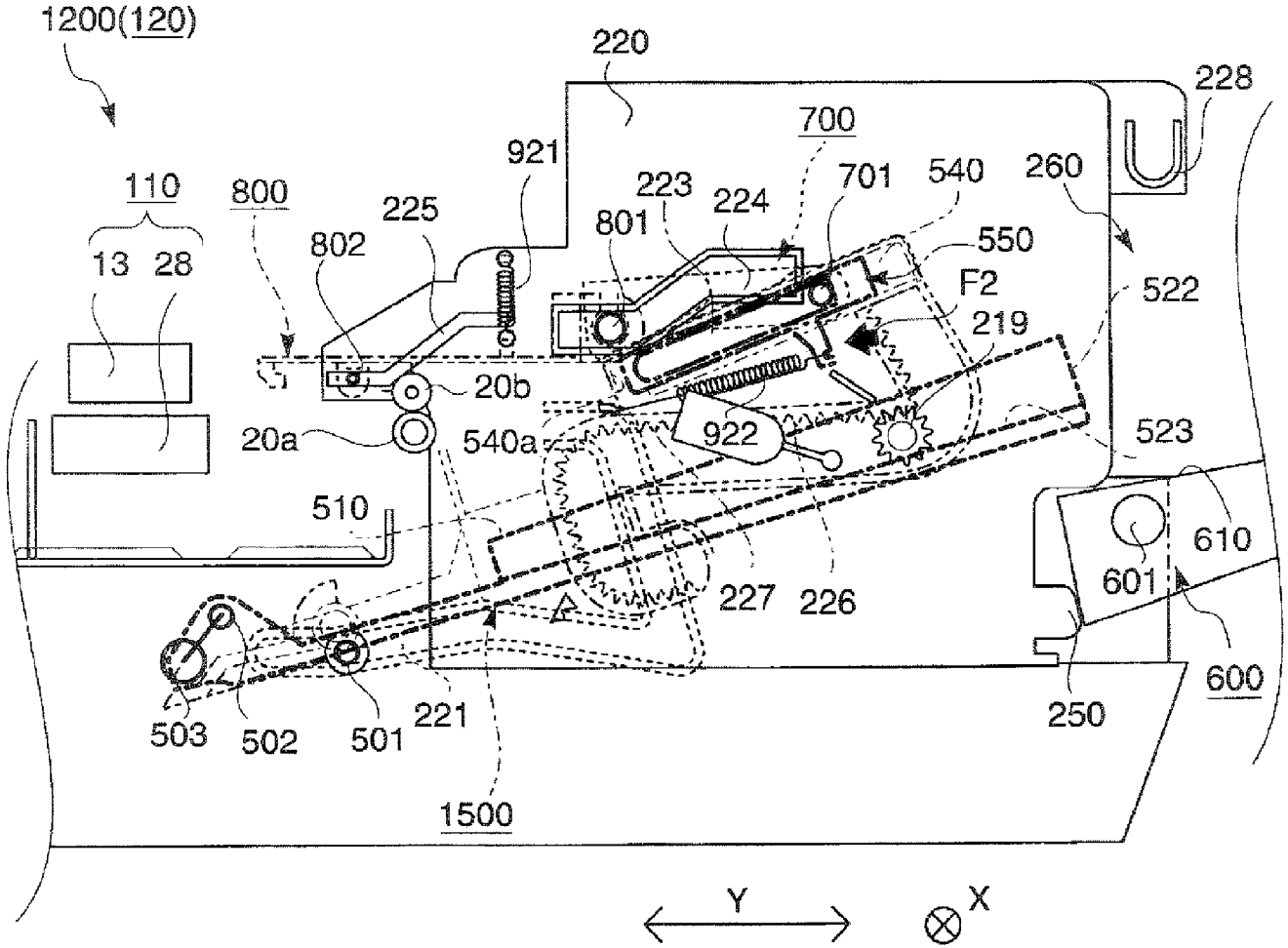

As shown in FIG. 33, when the pinion 219 further rotates in the clockwise direction from the state shown in FIG. 32, the pinion 219 tends to further move the first ejection stacker 1500 to the downstream side in the sheet conveying direction via the rack 227. Accordingly, the first ejection stacker 1500 moves to the downstream side in the sheet conveying direction while being guided by engagement between the first projection 501 and the first groove 221, and while being guided by engagement between the pinion 219 and the rack 227.

At this time, the slider 550 further moves to the upstream side in the sheet conveying direction inside the slider guiding groove with the biasing force F2 of the second spring 922. Then, since the second spring 922 contracts gradually, the biasing force F2 of the second spring 922 also decreases gradually. That is, the action of the second spring 922 that the ejector frame 800 receives via the connecting arm 700 decreases gradually.

Figure 34:
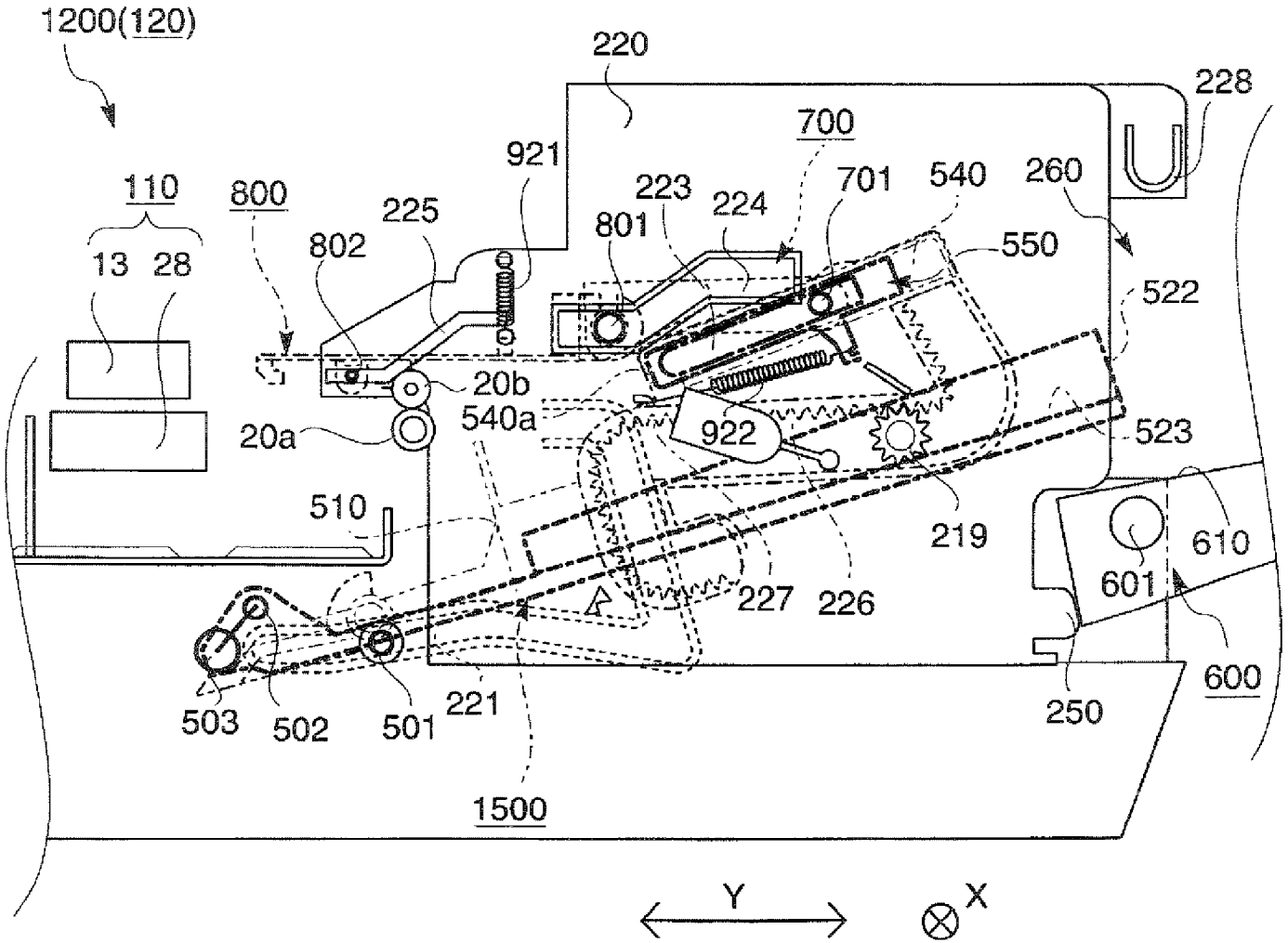

As shown in FIG. 34, when the pinion 219 further rotates in the clockwise direction from the state shown in FIG. 33, the pinion 219 tends to further move the first ejection stacker 1500 to the downstream side in the sheet conveying direction via the rack 227. Accordingly, the first ejection stacker 1500 moves to the downstream side in the sheet conveying direction while being guided by engagement between the first projection 501 and the first groove 221, and while being guided by engagement between the pinion 219 and the rack 227.

At this time, the slider 550 further moves to the upstream side in the sheet conveying direction inside the slider guiding groove with the biasing force F2 of the second spring 922, and abuts on an upstream end 540*a* of the slider guiding groove 540. Thereafter, with movement of the first ejection stacker 1500 to the downstream side in the sheet conveying direction, the third projection 701 of the connecting arm 700 is separated from the downstream end of the third groove 223 of the slider 550, and gradually moves the third groove 223 to the upstream side. Accordingly, the ejector frame 800 will be in a state where it is not influenced at all by the second spring 922.

Figure 35:
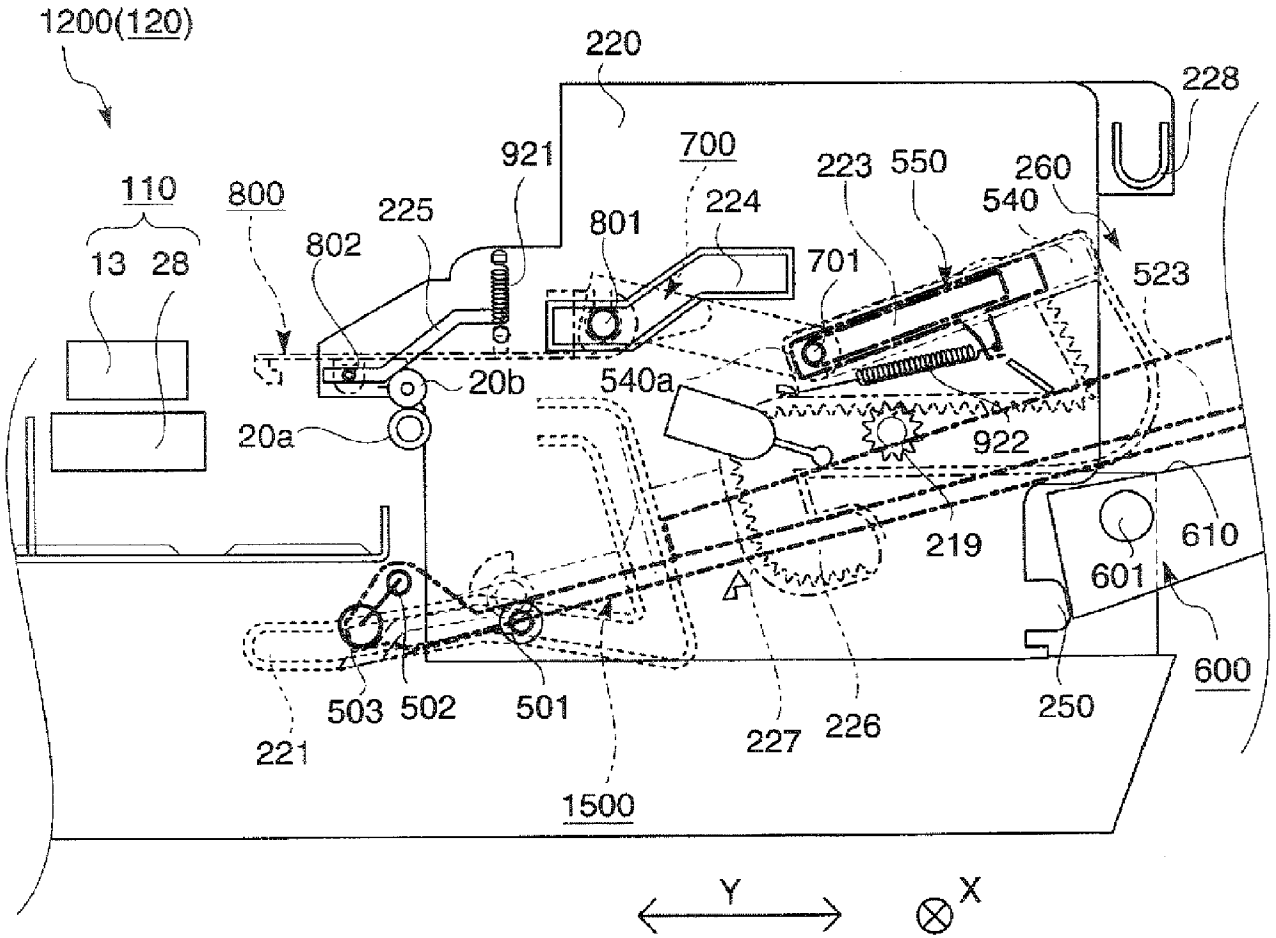

As shown in FIG. 35, when the pinion 219 further rotates in the clockwise direction from the state shown in FIG. 34, the pinion 219 tends to further move the first ejection stacker 1500 to the downstream side in the sheet conveying direction via the rack 227. Accordingly, the first ejection stacker 1500 further moves to the downstream side in the sheet conveying direction while being guided by engagement between the first projection 501 and the first groove 221, and while being guided by engagement between the pinion 219 and the rack 227. At this time, the third projection 701 of the connecting arm 700 moves to the upstream side in the sheet conveying direction along the third groove 223 of the first ejection stacker 1500, and then abuts on the upstream end of the third groove 223.

Figure 36:
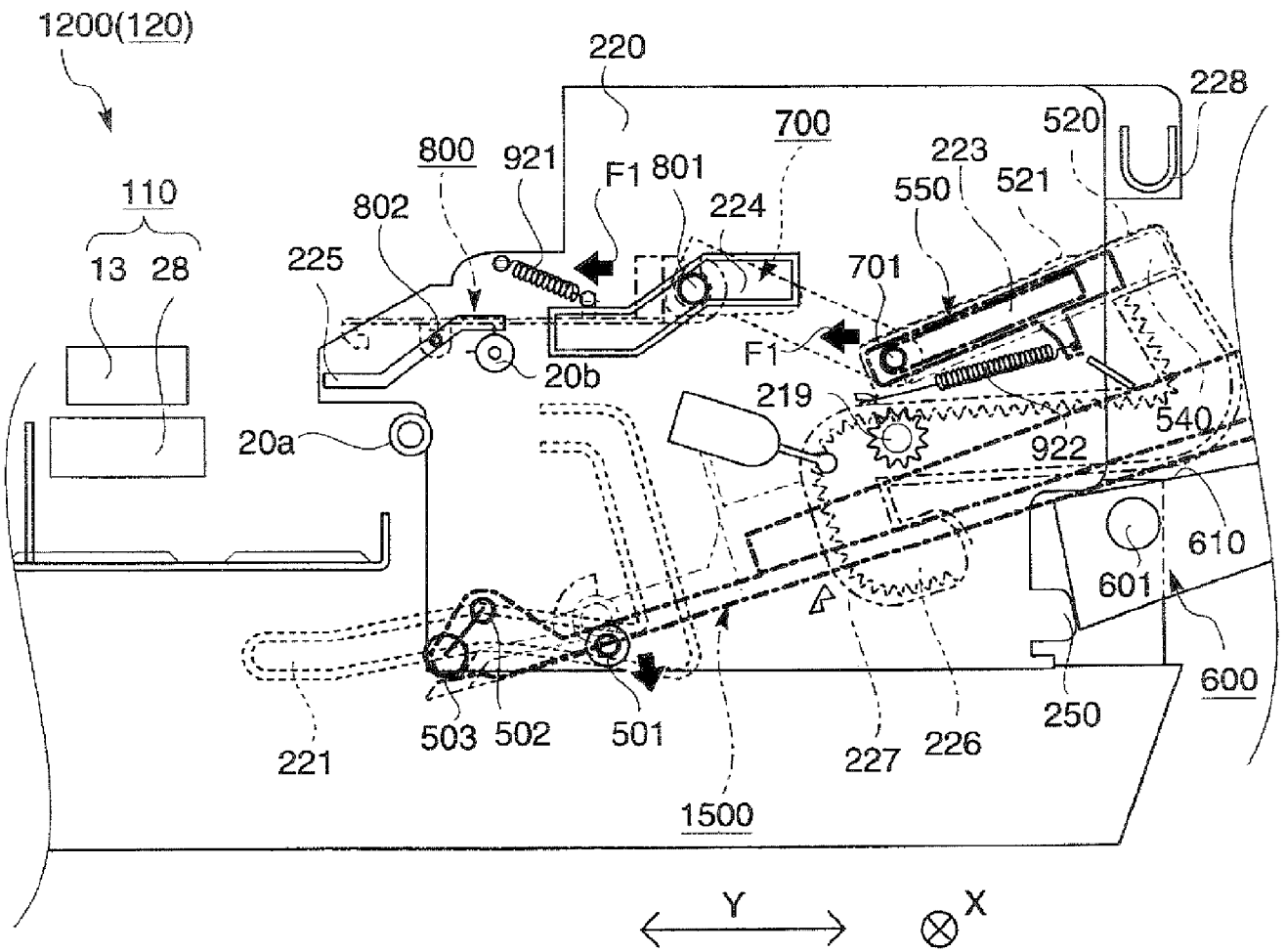

As shown in FIG. 36, when the pinion 219 further rotates in the clockwise direction from the state shown in FIG. 35, the first ejection stacker 1500 will further move to the downstream side in the sheet conveying direction. At this time, since the third projection 701 of the connecting arm 700 abuts on the upstream end of the third groove 223 of the first ejection stacker 500 in the sheet conveying direction, the first ejection stacker 1500 moves the ejector frame 800 to the downstream side in the sheet conveying direction via the connecting arm 700 against the aforementioned biasing force F1 of the first spring 921.

Moreover, a force that the third projection 701 of the connecting arm 700 tends to pull the upstream end of the third groove 223 of the first ejection stacker 1500 to the upstream side is generated by the aforementioned biasing force F1 of the first spring 921. Accordingly, the force that tends to pivot the first ejection stacker 1500 in the counterclockwise direction about a portion of the rack 227 meshing with the pinion 219 is generated in the first ejection stacker 1500. The first projection 501 located opposite to the third projection 701 with respect to the fulcrum is pressed against the bottom faces of the first groove 221 by the force that tends to pivot the first ejection stacker 1500 in the counterclockwise direction. Accordingly, the posture of the first ejection stacker 1500 can be further stabilized during its movement.

As shown in FIG. 37, when the pinion 219 further rotates in the clockwise direction from the state shown in FIG. 36, the pinion 219 tends to move downward along the sixth groove 226. That is, the pinion 219 tends to move the first ejection stacker 1500 upward via the rack 227. At this time, the force that tends to pivot the first ejection stacker 1500 in the counterclockwise direction about a portion of the rack 227 meshing with the pinion 219 is generated in the first ejection stacker 1500 by the biasing force F1 of the first spring 921. Accordingly, when the pinion 219 rotates in the clockwise direction, the first ejection stacker 1500 is pivoted about the first projection 501 so that the downstream end of the first ejection stacker 1500 may ascend further. Then, the contact face 520 provided above a downstream portion of the first ejection stacker 500 in the sheet conveying direction abuts on the posture regulator 228 of the base 220.

In a state where the contact face 520 abuts on the posture regulator 228, a portion where the third projection 701 and the third groove 223 abut on each other, i.e., a portion on which the biasing force F1 of the first spring 921 acts is located between the portion of the rack 227 meshing with the pinion 219 and a portion of the contact face 520 abutting on the posture regulator 228. Accordingly, the posture regulator 228 is able to abut on the contact face 520 to regulate that the first ejection stacker 1500 is pivoted in the counterclockwise direction about the portion of the rack 227 meshing with the pinion 219 by the biasing force F1 of the first spring 921.

As shown in FIG. 38, when the pinion 219 further rotates in the clockwise direction from the state shown in FIG. 37, the first ejection stacker 1500 pivots about its downstream portion in the sheet conveying direction so that its upstream end in the sheet conveying direction may ascend further. At this time, the second contact portion 544 pushes up the projection 231 of the position detector 230 upward from the bottom, turning on the position detector.

A position regulator 560 which determines the position of the first ejection stacker 1500 in the second position is provided in the first ejection stacker 1500. The position regulator 560 comprises: a base member 562 fixed to the first ejection stacker 1500, and a regulating lever 561 which is pivotably provided and which is biased toward the base member 562 by a biasing member (not shown). As shown in FIG. 38, when the regulating lever 561 abuts on a rotary shaft of the ejecting drive roller 20*a*, the regulating lever 561 is pivoted in a direction separating from the base member 562 against the biasing force. At this time, the inclination, i.e., posture of the first ejection stacker 1500 is a posture in which the tray guiding face 523 of the first ejection stacker 1500 becomes parallel to the sheet conveying direction (Y).

Here, the term "parallel" means that the tray guiding face 523 is substantially parallel to the primary scanning direction X and the sheet conveying direction (Y) to such a degree that the disk tray Q can be guided to the recording section 110, and the disk tray Q having been subjected to the recording can be received.

With the movement of the first ejection stacker 1500, the ejector frame 800 receives the biasing force F1 of the first spring 921, and then moves to the upstream side in the sheet conveying direction.

As shown in FIG. 39, when the pinion 219 further rotates in the clockwise direction from the state shown in FIG. 38, the pinion 219 tends to move to the downstream side in the sheet conveying direction along the sixth groove 226. That is, the pinion 219 tends to move the first ejection stacker 1500 to the upstream side in the sheet conveying direction in cooperation with the biasing force F1 of the first spring 921 via the rack 227. Accordingly, the first ejection stacker 1500 moves to the upstream side in the sheet conveying direction while being guided by engagement between the first projection 501 and the first groove 221. That is, the posture of the first ejection stacker 1500 is regulated by the engagement between the first projection 501 and the first groove 221 and the engagement between the pinion 219 and the rack 227. Accordingly, the first ejection stacker moves in parallel to the upstream side in the sheet conveying direction with the posture in which the tray guiding face 523 becomes parallel to the sheet conveying direction (Y).

Then, the shaft of the ejecting drive roller 20*a* is nipped by the base member 562 and regulating lever 561 of the position regulator 560. That is, the position and posture of the first ejection stacker 1500 are determined with high precision by the abutment between the base member 562 and the rotary shaft of the ejecting drive roller 20*a*. The second contact portion 544 approaches the pivot center of the projection 231 with the state where it has abutted on the bottom of the projection 231 of the position detector 230. Accordingly, the projection 231 can be pushed upward positively, turning on the position detector 230.

Moreover, with the movement of the first ejection stacker 1500, the ejector frame 800 receives the biasing force F1 of the first spring 921, and then moves to the upstream side in the sheet conveying direction.

Although the force that tends to pivot the first ejection stacker 1500 in the counterclockwise direction about the portion of the rack 227 meshing with the pinion 219 by the biasing force F1 of the first spring 921 is generated in the first ejection stacker 1500, the first projection 1500 of the first ejection stacker 1500 is pressed against the bottom of the first groove 221 of the base 220. Thus, the first ejection stacker 500 can maintain its posture with high precision.

The first ejection stacker 1500 abuts on a portion of the base 220 in a position where the bottoms of the second ejecting follower rollers 503 of the first ejection stacker 1500 abut on the top of the ejecting drive roller 20*a*, and thereby the first motor 901 stops driving of the pinion 219.

When the pinion 219 rotates in the counterclockwise direction from the state shown in FIG. 39, the pinion 219 tends to move to the upstream side in the sheet conveying direction along the sixth groove 226. That is, the pinion 219 tends to move the first ejection stacker 1500 to the downstream side in the sheet conveying direction against the biasing force F1 of the first spring 921 via the rack 227. Accordingly, the first ejection stacker 1500 moves to the downstream side in the sheet conveying direction while being guided by engagement between the first projection 501 and the first groove 221, and while being guided by engagement between the pinion 219 and the rack 227. Accordingly, the first ejection stacker 1500 moves in parallel to the downstream side in the sheet conveying direction with the posture in which the tray guiding face 523 becomes parallel to the sheet conveying direction (Y). Accordingly, the shaft of the ejecting drive roller 20*a* is released from the nipping by the base member 562 and regulating lever 561 of the position regulator 561. That is, the first ejection stacker 500 can be released from regulation of the posture and position by the position regulator 560.

The ejector frame 800 moves to the downstream side in the sheet conveying direction with the movement of the first ejection stacker 1500.

As shown in FIG. 38, when the pinion 219 rotates in the counterclockwise direction from the state shown in FIG. 39, the first ejection stacker 1500 will move to the downstream side in the sheet conveying direction against the biasing force F1 of the first spring 921. At this time, the second ejecting follower rollers 503 of the first ejection stacker 1500 are separated from the ejecting drive roller 20*a*. The projection 521 of the first ejection stacker 1500 abuts on the separated posture regulator 228 of the base 220. Then, the first projection 501 of the first ejection stacker 1500 is separated from the bottom face of the first groove 221 by the shape of the first groove 221. Accordingly, the force that tends to pivot the first ejection stacker 1500 in the counterclockwise direction about the portion of the rack 227 meshing with the pinion 219 is generated in the first ejection stacker 1500 by the biasing force F1 of the first spring 921. At this time, the posture of the first ejection stacker 1500 is regulated by the posture regulator 228 abutting on the abutting portion 521. The regulating lever 561 of the position regulator 560 is pivoted in a direction closing to the base member 562, while being regulated by the shaft of the ejecting drive roller 20*a*.

As shown in FIG. 37, when the pinion 219 further rotates in the counterclockwise direction from the state shown in FIG. 38, the first ejection stacker 1500 pivots about its downstream portion in the sheet conveying direction as a fulcrum so that its upstream end in the sheet conveying direction may descend further.

At this time, the second contact portion 544 is in a state where it is separated from the projection 231 bottom of the position detector 230. Accordingly, the projection 231 can return to its neutral state and the position detector 230 will be turned off.

As shown in FIG. 36, when the pinion 219 further rotates in the counterclockwise direction from the state shown in FIG. 37, the pinion 219 tends to move to the downstream side in the sheet conveying direction along the sixth groove 226. That is, the pinion 219 tends to move the first ejection stacker 1500 to the upstream side in the sheet conveying direction in cooperation with the biasing force F1 of the first spring 921 via the rack 227. Accordingly, the first ejection stacker 1500 moves to the upstream side in the sheet conveying direction while being guided by engagement between the first projection 501 and the first groove 221, and while being guided by engagement between the pinion 219 and the rack 227.

As shown in FIG. 35, when the pinion 219 further rotates in the counterclockwise direction from the state shown in FIG. 36, the first ejection stacker 500 moves in parallel to the upstream side in the sheet conveying direction with the posture in which its upstream portion in the sheet conveying direction descends and its downstream portion ascends, while being guided by engagement between the first projection 501 and the first groove 221, and while being guided by engagement between the pinion 219 and the rack 227. Also, with movement of the first ejection stacker 1500, the ejector frame 800 moves, and the bottoms of the first ejecting follower rollers 20*b* of the ejector frame 800 abut on the top of the ejecting drive roller 20*a*. At this time, the fourth projection 801 and the fifth projection 802 of the ejector frame 800 abut on the upstream ends of the fourth groove 224 and the fifth groove 225 of the base 220 in the sheet conveying direction, respectively, and thereby the ejector frame 800 stops.

Also, since the position of the ejector frame 800 is a position that the ejector frame 800 takes when the first ejection stacker 1500 is in the first position, the biasing force F1 of the first spring 921 does not acting on the ejector frame 800. Accordingly, the biasing force F1 of the first spring 921 does not act on the first ejection stacker 1500 either.

As shown in FIG. 34, when the pinion 219 rotates in the counterclockwise direction from the state shown in FIG. 35, the first ejection stacker 1500 will move in parallel to the upstream side in the sheet conveying direction. At this time, the third projection 701 of the connecting arm 700 is separated from the upstream end of the third groove 223 of the first ejection stacker 1500 in the sheet conveying direction, and then moves to the downstream side.

Here, the first ejection stacker 1500 is provided to move in parallel to the upstream side in the sheet conveying direction so that the position of the downstream end of the first ejection stacker 1500 in the sheet conveying direction may be located upstream of the upstream end of the second ejection stacker 600.

As shown in FIG. 33, when the pinion 219 rotates in the counterclockwise direction from the state shown in FIG. 34, the first ejection stacker 1500 will move in parallel to the upstream side in the sheet conveying direction. At this time, the third projection 701 of the connecting arm 700 moves to the downstream side in the sheet conveying direction along the third groove 223 of the first ejection stacker 1500, and then abuts on the downstream end of the third groove 223. Thereafter, when the first ejection stacker 1500 further moves in parallel to the upstream side in the sheet conveying direction, the slider 550 will be regulated by the third projection 701. Accordingly, with respect to the first ejection stacker 1500, the slider 550 is separated from the upstream end 540*a* of the slider guiding groove 540 in the sheet conveying direction, and gradually moves to the downstream side in the sheet conveying direction along the slider guiding groove 540.

At this time, since the length of the second spring 922 will increases gradually, the biasing force F2 of the second spring 922 increases gradually. Then, the increased biasing force F2 of the second spring 922 acts on the ejector frame 800 to the upstream side via the connecting arm 700.

As shown in FIG. 32, when the pinion 219 rotates in the counterclockwise direction from the state shown in FIG. 33, the first ejection stacker 1500 will further move in parallel to the upstream side in the sheet conveying direction.

At this time, since the slider 550 is regulated by the third projection 701, the slider 550 further moves to the downstream side in the sheet conveying direction inside the slider guiding groove 540 with respect to the first ejection stacker 1500. Accordingly, the biasing force F2 of the second spring 922 to act on the ejector frame 800 increases further.

As shown in FIG. 31, when the pinion 219 further rotates in the counterclockwise direction from the state shown in FIG. 32, the pinion 219 tends to move upward along the sixth groove 226. That is, the pinion 219 tends to move the first ejection stacker 1500 downward via the rack 227.

At this time, the slider 550 approaches the downstream end of the slider guiding groove 540 most closely. That is, the extension of the second spring 922 becomes the longest. Accordingly, the biasing force F2 of the second spring 922 to act on the ejector frame 800 becomes a maximum value. As a result, when the first ejection stacker moves from the second position to the first position, it can be positively moved to the position that the ejector frame 800 should take.

As shown in FIG. 30, when the pinion 219 further rotates in the counterclockwise direction from the state shown in FIG. 31, the first ejection stacker 500 pivots in the clockwise direction about the first projection 501 so that its downstream end in the sheet conveying direction may descend so as to further reduce a height difference between the upstream and downstream ends thereof.

At this time, the slider 550 gradually moves to the upstream side of the slider guiding groove 540 in the sheet conveying direction. Accordingly, the biasing force F2 of the second spring 922 to act on the ejector frame 800 decreases gradually. The first contact portion 543 abuts on the top of the projection 231 of the position detector 230 to rotate the projection 231 downward. Accordingly, the position detector 230 will be turned on.

As shown in FIG. 29, when the pinion 219 further rotates in the counterclockwise direction from the state shown in FIG. 30, the first ejection stacker 1500 pivots in the clockwise direction about the first projection 501 so that its downstream end in the sheet conveying direction may descend so as to further reduce a height difference between the upstream and downstream ends thereof. At this time, the first ejection stacker 1500 abuts on a portion of the base 220 to stop driving of the first motor 901 to stop the rotation of the pinion 219. Accordingly, the ejection stacker 1500 can be positioned in the first position with precision.

The first contact portion 543 pushes up the projection 231 of the position detector 230 downward from the bottom, positively turning on the position detector 230.

As described, since the stacker position changer 1200 comprises the first spring 921 and the second spring 922 separately, the desired biasing forces F1 and F2 can be obtained with desired timing according to purposes. As a result, the load of the first motor 901 can be reduced as compared with the first embodiment.

In the second embodiment, since the first ejection stacker 1500 comprises the slider 550, the first spring 921 and the second spring 922 can be configured that they may not act simultaneously. Accordingly, the load of the first motor 901 can be reduced further.

Next, a stacker position changer 2200 according to a third embodiment of the invention will be described with reference to FIGS. 40 to 43.

In this embodiment, the first ejection stacker 2500 comprises a position regulator 570 which regulates the position and posture of the first ejection stacker 2500 in the second position.

The position regulator 570, comprises a base member 572 formed integrally the first ejection stacker 2500, and a regulating lever 571 which pivots about a pivot shaft 573. One end of a lever biasing spring 576 is engaged with a lever-side spring engaging portion 574 of the regulating lever 571, and the other end of the lever biasing spring 576 is engaged with a stacker-side spring engaging portion 580 of the first ejection stacker 2500. Accordingly, the regulating lever 571 is always biased towards the base member 572 and will be in a closed state if any other force does not act.

The stacker position changer 2200 and first ejection stacker 2500 of this embodiment are the same as those of the first embodiment except for the position regulator 570. Sine the other members are the same as those of the first embodiment and are denoted by the same reference numerals, and the repetitive explanations for those will be omitted.

Figure 41:
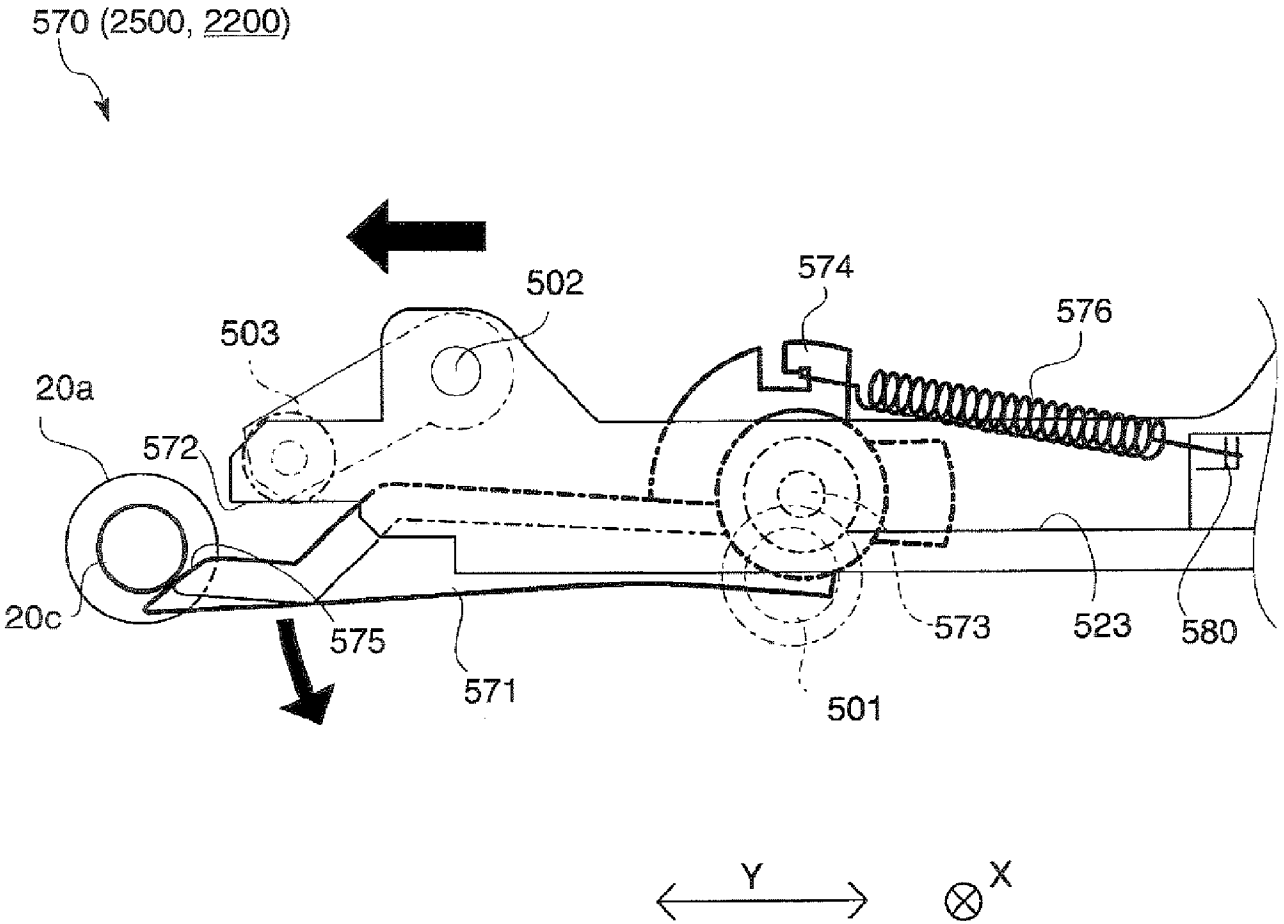
FIGS. 41 and 42 are side views showing operations of the position regulator of FIG. 40.

Like the first embodiment, when completion of movement of the first ejection stacker 2500 from the first position to the second position shown in FIGS. 21 and 22, a tapered portion 575 provided at the tip end of the regulating lever 571 first abuts on the rotary shaft 20*c* of the ejecting drive roller 20*a*, as shown in FIG. 41. Then, with the movement of the first ejection stacker 2500, the rotary shaft 20*c* of the ejecting drive roller 20*a* pivots the regulating lever 571 against the biasing force of the lever biasing spring 576 so that the regulating lever 571 is separated from the base member 572.

Figure 42:
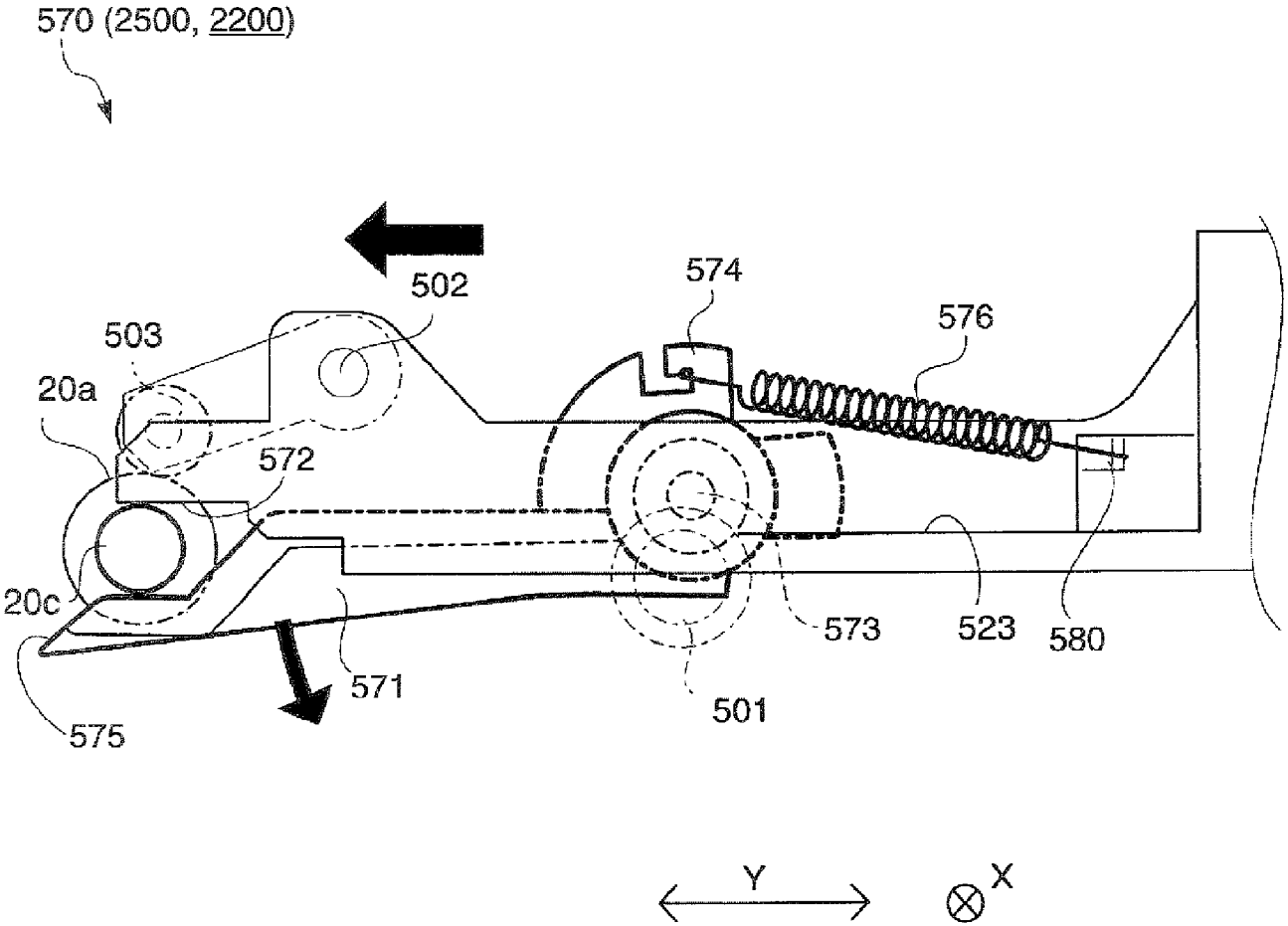

When movement to the second position is completed, the rotary shaft 20*c* of the ejecting drive roller 20*a* abuts on the regulating lever 571 and the base member 572, as shown in FIG. 42. That is, the position regulator 570 is provided so as to nip the rotary shaft 20*c* of the ejecting drive roller 20*a* with the base member 572 and the regulating lever 571, and so as to regulate the position and posture of the first ejection stacker 2500 with respect to the position of a portion where the base member 572 and the rotary shaft 20*c* of the ejecting drive roller 20*a* abut on each other, while being biased by the biasing force of the lever biasing spring 576.

Accordingly, the second ejecting follower rollers 503 provided on the side of the first ejection stacker 2500 can be positioned with respect to the ejecting drive roller 20*a* with high precision. In particular, the second ejecting follower rollers can be positioned with high precision in directions orthogonal to the primary scanning direction X and the sheet conveying direction (Y). As a result, the disk tray Q can be nipped positively and can be moved in the sheet conveying direction. Also, when the position is regulated, the regulating lever 571 may first abut on the rotary shaft 20*c* of the ejecting drive roller 20*a*. Accordingly, when movement of the first ejection stacker 2500 from the first position to the second position is completed, a so-called overshoot that an upstream portion of the first ejection stacker 2500 in the sheet conveying direction ascends excessively can be prevented.

Furthermore, in the second position, the degree of parallelism of tray guiding face 523 with respect to the width direction and conveying direction of a sheet P and a disk tray Q on which recording is performed can be improved further.

Also, when the first ejection stacker 2500 moves from the second position to the first position, it will be in a state shown in FIG. 41 (FIG. 21) from FIG. 42 (FIG. 22). That is, with movement of the first ejection stacker 2500, the rotary shaft 20*c* of the ejecting drive roller 20*a* is released from nipping of the position regulator 570. Accordingly, the regulating lever 571 will be in a state where it is pivoted towards the base member 572 by the biasing force of the lever biasing spring 576, thereby being the closed state. Then, the position regulator 570 moves to the first position while it remains closed. Accordingly, there is no possibility that the position regulator 570 may collide with other members during its movement, and there is no possibility that the position regulator 570 may hinder the arrangement of the sheet feeding cassette 30 (refer to FIGS. 1 to 9) provided in a lower portion. That is, a limited space can be effectively utilized by moving the position regulator 570 in its closed state.

If there is an extra space, the position regulator 570 may be constituted by fixed two members forming a U-shape.

Figure 43:
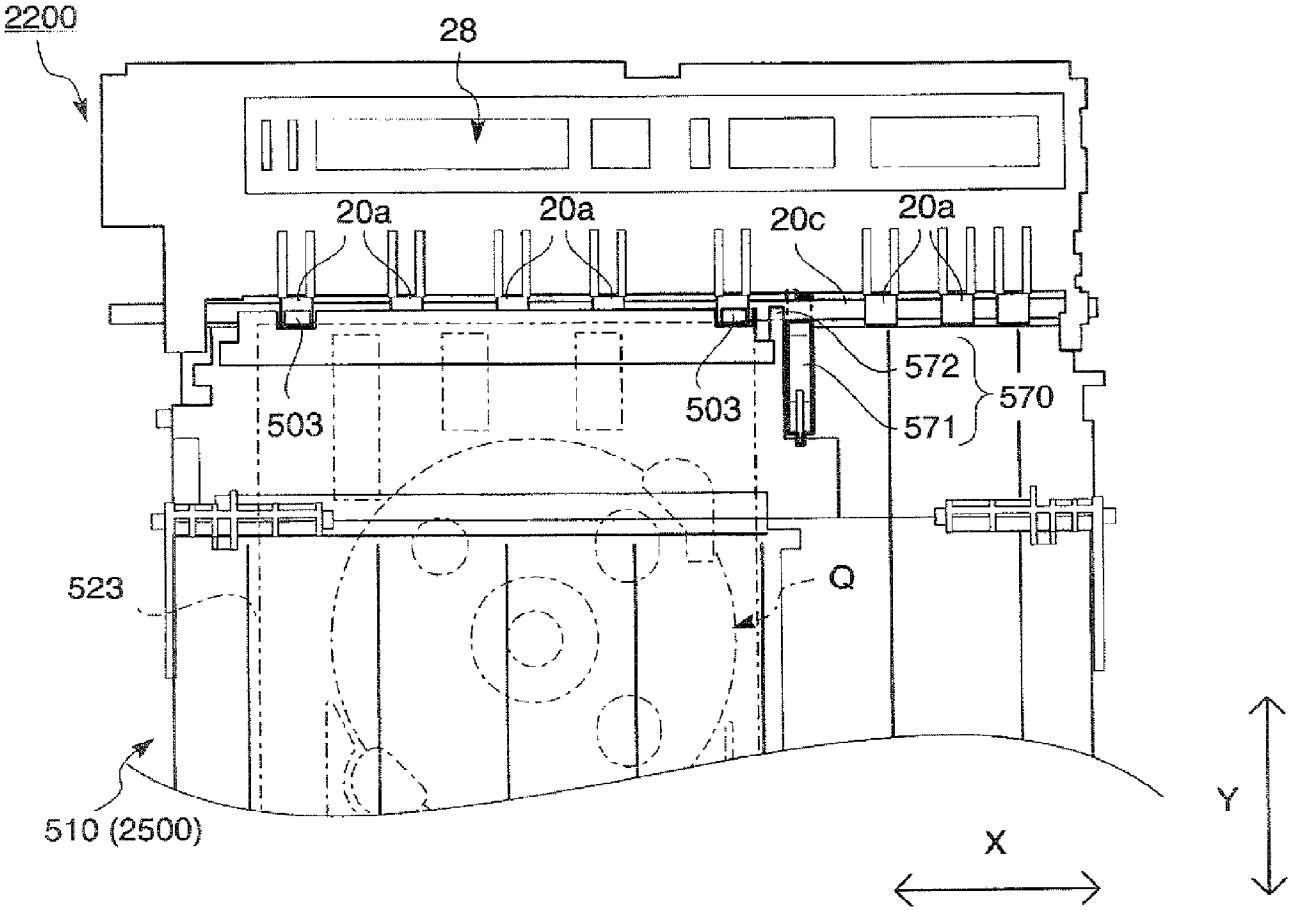
FIG. 43 is a plan view showing the location of the position regulator of FIG. 40.

As shown in FIG. 43, the position regulator 570 is provided outside the conveying path (tray guiding face 523) of the disk tray Q in the vicinity of the second ejecting follower rollers 503 in the primary scanning direction X of the first ejection stacker 2500. Accordingly, the second ejecting follower rollers 503 can be positioned with higher precision with respect to the rotary shaft 20*c* of the ejecting drive roller 20*a*. In addition, it is preferable that the position regulator 570 are provided on both sides of the conveying path (tray guiding face 523) of the disk tray Q outside the conveying path.

The configuration described as the third embodiment may be applied to the configuration described as the second embodiment appropriately.

Although only some exemplary embodiments of the invention have been described in detail above, those skilled in the art will readily appreciated that many modifications are possible in the exemplary embodiments without materially departing from the novel teachings and advantages of the invention. Accordingly, all such modifications are intended to be included within the scope of the invention.

The disclosures of Japanese Patent Application Nos. 2006-74094 filed Mar. 17, 2006; 2006-112338 filed Apr. 14, 2006, 2006-112398 filed Apr. 14, 2006; 2006-249685 filed Sep. 14, 2006; and 2006-250935 filed Sep. 15, 2006, including specifications, drawings and claims are incorporated herein by reference in their entirety.

What is claimed is:

1. A recording apparatus comprising:

a recording section, including a recording head operablec to record information on a first medium and a second medium;

a first stacker, having a first face and a second face, and being movable between a first position and a second position;

a second stacker, having a third face and being movable between a third position opening at least a part of a front section of the recording apparatus and a fourth position closing the front section;

a power source, disposed inside the recording apparatus:

a stacker position changer, operable to move the first stacker between the first position and the second position with the aid of power supplied from the power source; and a controller, operable to cause the stacker position changer to move the first stacker from the first position to the second position, in a case where the second stacker is in the fourth position when the recording is performed with respect to the first medium, wherein;

the first face is adapted to receive the first medium conveyed from the recording section in a first direction, when the first stacker is placed in the first position;

the second face is adapted to guide the first medium and the second medium conveyed to the recording section in a third direction opposite to the first direction, and to receive the first medium and the second medium conveyed from the recording section in the first direction, when the first stacker is placed in the second position;

the third face is adapted to receive the first medium conveyed from the recording section together with the first stacker placed in the first position; and the first stacker is adapted to come in contact with the second stacker placed in the fourth position in accordance with the movement from the first position to the second position, thereby causing the second stacker to move to the third position;

wherein the controller is operable to cause the stacker position changer to move the first stacker with a first speed when the first stacker comes in contact with the second stacker, and with a second speed higher than the first speed after the first stacker comes in contact with the second stacker.

* * * * *